US008420921B2

(12) United States Patent
Kobayashi

(10) Patent No.: US 8,420,921 B2
(45) **Date of Patent: *Apr. 16, 2013**

(54) INFORMATION PROCESSING APPARATUS, SOUND ANALYSIS METHOD, AND PROGRAM

(75) Inventor: Yoshiyuki Kobayashi, Tokyo (JP)

(73) Assignee: Sony Corporation, Tokyo (JP)

( * ) Notice: Subject to any disclaimer, the term of this patent is extended or adjusted under 35 U.S.C. 154(b) by 681 days.

This patent is subject to a terminal disclaimer.

(21) Appl. No.: 12/622,235

(22) Filed: Nov. 19, 2009

(65) Prior Publication Data

US 2010/0186576 A1 Jul. 29, 2010

(30) Foreign Application Priority Data

Nov. 21, 2008 (JP) ..... P2008-298567

(51) Int. Cl.
*G10H 1/00* (2006.01)

(52) U.S. Cl.
USPC ..... 84/613; 84/637

(58) Field of Classification Search ..... 84/613, 84/637
See application file for complete search history.

(56) References Cited

U.S. PATENT DOCUMENTS

| | | | | |
|---|---|---|---|---|
| 5,256,832 | A * | 10/1993 | Miyake | 84/636 |
| 6,060,655 | A * | 5/2000 | Minamitaka | 84/650 |
| 6,495,747 | B2 * | 12/2002 | Shimaya et al. | 84/477 R |
| 7,194,686 | B1 * | 3/2007 | Suzuki et al. | 715/716 |
| 8,097,801 | B2 * | 1/2012 | Gannon | 84/613 |
| 8,178,770 | B2 * | 5/2012 | Kobayashi | 84/613 |
| 2010/0126332 | A1 * | 5/2010 | Kobayashi | 84/613 |
| 2010/0170382 | A1 * | 7/2010 | Kobayashi | 84/613 |
| 2010/0186576 | A1 * | 7/2010 | Kobayashi | 84/612 |
| 2010/0211200 | A1 * | 8/2010 | Kobayashi | 700/94 |
| 2012/0101606 | A1 * | 4/2012 | Miyajima | 700/94 |
| 2012/0125179 | A1 * | 5/2012 | Kobayashi | 84/611 |
| 2012/0137855 | A1 * | 6/2012 | Gannon | 84/613 |

FOREIGN PATENT DOCUMENTS

| | | |
|---|---|---|
| JP | 2005-275068 | 10/2005 |
| JP | 2008-102405 | 5/2008 |
| JP | 2008-123011 | 5/2008 |

* cited by examiner

*Primary Examiner* — David S. Warren
(74) *Attorney, Agent, or Firm* — Finnegan, Henderson, Farabow, Garrett & Dunner LLP

(57) ABSTRACT

An information processing apparatus is provided which includes a beat analysis unit for detecting positions of beats included in an audio signal, a structure analysis unit for calculating similarity probabilities, each being a probability of similarity between contents of sound of beat sections divided by each beat position detected by the beat analysis unit, and a bar detection unit for determining a likely bar progression of the audio signal based on bar probabilities determined according to the similarity probabilities calculated by the structure analysis unit, the bar probabilities indicating to which ordinal in which meter respective beats correspond.

18 Claims, 69 Drawing Sheets
(4 of 69 Drawing Sheet(s) Filed in Color)

- INPUT DATA:
  PARTIAL LOG SPECTRUM WITH SPECIFIC WINDOW WIDTH
- TEACHER DATA: BEAT PROBABILITY
  (1: BEAT, 0: NOT BEAT)
- LEARNING RESULT:
  BEAT PROBABILITY FORMULA $$\text{BEAT SCORE } BS(k,d) = \sum_{n} P(F_{k+nd}),\ \{F_{k+nd} \in F\}$$

NUMBER OF SUPPLEMENTARY BEATS $B_{fill} = Round\left(\frac{F_{h+1} - F_h}{d_h}\right) - 1$

- INPUT DATA:
  LOG SPECTRA OF A PLURALITY OF MUSIC PIECES
- TEACHER DATA:
  TEMPO DECIDED TO BE CORRECT BY HUMAN BEING LISTENING TO EACH MUSIC PIECE
- LEARNING RESULT:
  ESTIMATED TEMPO DISCRIMINATION FORMULA $$\text{AVERAGE BEAT PROBABILITY} \quad BP_{AVG}(r) = \frac{\sum_{F(h) \in F(r)} BP(h)}{m(r)}$$

F(r): GROUP OF BEAT POSITIONS AFTER REVISION ACCORDING TO BASIC MULTIPLIER r
m(r): NUMBER OF BEAT POSITIONS INCLUDED IN F(r)

| KEY TYPE | | Maj | m |
|---|---|---|---|
| ROOT | B | 0.00 | 0.00 |
| | : | : | : |
| | : | : | : |
| | C# | 0.00 | 0.00 |
| | C | 0.90 | 0.03 |

KEY PROBABILITY

FIG.49

KEY TRANSITION PROBABILITY (Maj → Maj) Pr (Δk)

| KEY TYPE | MODULATION AMOUNT | PROBABILITY VALUE |
|---|---|---|
| Maj → Maj | +5 (-7) | 0.0001 |
| Maj → Maj | +4 (-8) | 0.0001 |
| Maj → Maj | +3 (-9) | 0.0001 |
| Maj → Maj | +2 (-10) | 0.0001 |
| Maj → Maj | +1 (-11) | 0.0002 |
| Maj → Maj | 0 | 0.9987 |

| KEY TYPE | MODULATION AMOUNT | PROBABILITY VALUE |
|---|---|---|
| Maj → Maj | +11 (-1) | 0.0000 |
| Maj → Maj | +10 (-2) | 0.0001 |
| Maj → Maj | +9 (-3) | 0.0001 |
| Maj → Maj | +8 (-4) | 0.0001 |
| Maj → Maj | +7 (-5) | 0.0001 |
| Maj → Maj | +6 (-6) | 0.0000 |

KEY TRANSITION PROBABILITY (Maj → m)

:

KEY TRANSITION PROBABILITY (m → Maj)

:

KEY TRANSITION PROBABILITY (m → m)

:

FIG.57

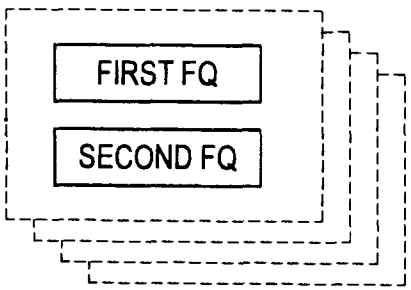

- INDEPENDENT VARIABLE:
  A PLURALITY OF FIRST AND SECOND FQ OF AUDIO SIGNAL WHOSE CORRECT METRES (X) AND CORRECT ORDINALS OF BEATS (Y) ARE KNOWN

- DUMMY DATA (TEACHER DATA):
  WHEN LEARNING FORMULA FOR 1st BEAT IN 1/4 METRE ··· 1 WHEN 1st BEAT IN 1/4 METRE, OTHERWISE 0
  WHEN LEARNING FORMULA FOR 1st BEAT IN 2/4 METRE ··· 1 WHEN 1st BEAT IN 2/4 METRE, OTHERWISE 0
  ⋮

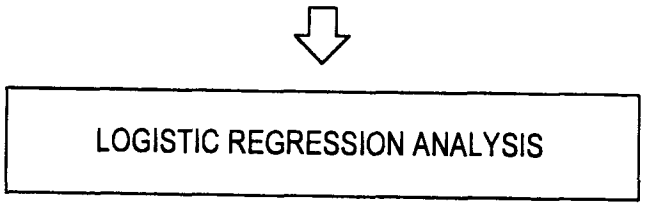

- BAR PROBABILITY FORMULA
  FOR DISCRIMINATING 1st BEAT IN 1/4 METRE → $BR_{1,1}$ (FIRST FQ, SECOND FQ) = ...
  FOR DISCRIMINATING 1st BEAT IN 2/4 METRE → $BR_{2,1}$ (FIRST FQ, SECOND FQ) = ...
  ⋮

FIG.60

| | AFTER CHANGE | | | |
|---|---|---|---|---|
| BEFORE CHANGE | SINGLE METRE | DUPLE METRE | TRIPLE METRE | QUADRUPLE METRE |
| SINGLE METRE | 0.50 | 0.10 | 0.20 | 0.20 |
| DUPLE METRE | 0.50 | 0.10 | 0.20 | 0.20 |
| TRIPLE METRE | 0.05 | 0.03 | 0.90 | 0.02 |
| QUADRUPLE METRE | 0.05 | 0.03 | 0.02 | 0.90 |

FIG.65

- INDEPENDENT VARIABLE:
  EXTENDED ROOT FQ FOR RESPECTIVE BEAT SECTIONS WHOSE CORRECT CHORDS ARE KNOWN

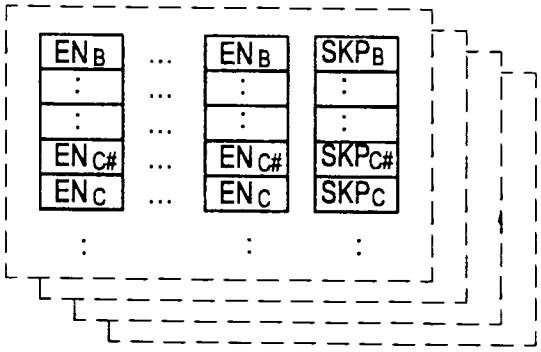

- DUMMY DATA (TEACHER DATA):
  - WHEN LEARNING FOR MAJOR CHORD ··· 1 WHEN MAJOR CHORD, OTHERWISE 0
  - WHEN LEARNING FOR MINOR CHORD ··· 1 WHEN MINOR CHORD, OTHERWISE 0
  - WHEN LEARNING FOR 7th CHORD ··· 1 WHEN 7th CHORD, OTHERWISE 0
  - WHEN LEARNING FOR 9th CHORD ··· 1 WHEN 9th CHORD, OTHERWISE 0

⇩

LOGISTIC REGRESSION ANALYSIS

⇩

- EXTENDED CHORD PROBABILITY FORMULA

MAJOR CHORD → CP' major (x1, x2, ...) = ...
MINOR CHORD → CP' minor (x1, x2, ...) = ...
7th CHORD → CP' seven (x1, x2, ...) = ...
9th CHORD → CP' nine (x1, x2, ...) = ...

INFORMATION PROCESSING APPARATUS, SOUND ANALYSIS METHOD, AND PROGRAM

BACKGROUND OF THE INVENTION

1. Field of the Invention

The present invention relates to an information processing apparatus, a sound analysis method, and a program.

2. Description of the Related Art

Recently, a technology for analyzing an audio signal recorded with sounds of a played music piece, and for detecting positions of beats, progression of chords, progression of bars, or the like, of the music piece has been developed.

For example, JP-A-2008-102405 discloses a signal processing apparatus that detects, from an audio signal, positions of beats included in a music piece, extracts feature quantity (FQ) for chord discrimination for each of the detected beat positions, and then discriminates the type of chord of each of the beat positions based on the extracted feature quantity.

SUMMARY OF THE INVENTION

However, an actual tempo of a music piece that is played includes not only fluctuations in tempo which appear on the musical score, but also fluctuations in tempo which are due to the arrangement by a player or a conductor and which do not appear on the musical score. In such a case, with a music piece analysis technology of the related art, it is difficult to accurately detect, reflecting the fluctuations in tempo, the positions or types (for example, the meter, the ordinal of beats, or the like) of beats.

In light of the foregoing, it is desirable to provide a novel and improved information processing apparatus, sound analysis method and program that are capable of improving accuracy of detection of the positions of beats included in an audio signal or the types of the beats.

According to an embodiment of the present invention, there is provided an information processing apparatus including a beat analysis unit for detecting positions of beats included in an audio signal, a structure analysis unit for calculating similarity probabilities, each being a probability of similarity between contents of sound of beat sections divided by each beat position detected by the beat analysis unit, and a bar detection unit for determining a likely bar progression of the audio signal based on bar probabilities determined according to the similarity probabilities calculated by the structure analysis unit, the bar probabilities indicating to which ordinal in which meter respective beats correspond.

The structure analysis unit may include a feature quantity calculation unit for calculating a specific feature quantity by using average energies of respective pitches of each beat section, a correlation calculation unit for calculating, for the beat sections, correlations between the feature quantities calculated by the feature quantity calculation unit, and a similarity probability generation unit for generating the similarity probabilities according to the correlations calculated by the correlation calculation unit.

The bar detection unit may include a bar probability calculation unit for calculating the bar probabilities based on specific feature quantities extracted from the audio signal, a bar probability correction unit for correcting, according to the similarity probabilities, the bar probabilities calculated by the bar probability calculation unit, and a bar determination unit for determining the likely bar progression of the audio signal based on the bar probabilities corrected by the bar probability correction unit.

The feature quantity calculation unit may compute the feature quantity by weighting and summing over a plurality of octaves values of notes bearing same name, the values being included in the average energies of respective pitches.

The correlation calculation unit may calculate the correlation between the beat sections by using the feature quantities, each feature quantity being for a beat section being focused and one or more beat sections around the beat section being focused.

The bar probability calculation unit may calculate the bar probability based on a first feature quantity varying depending on a type of chord or a type of key for each beat section and a second feature quantity varying depending on a beat probability indicating a probability of a beat being included in each specific time unit of the audio signal.

The bar determination unit may determine the likely bar progression by searching for a path according to which an evaluation value varying depending on the bar probability becomes optimum, from among paths formed by sequentially selecting nodes among nodes specified with beats arranged in time series and meters and ordinals of each beat.

The bar detection unit may further include a bar redetermination unit for re-executing, in a case where both a first meter and a second meter are included in the bar progression determined by the bar determination unit, a path search with a less frequently appearing meter among the first meter and the second meter excluded from a subject of a search.

The beat analysis unit may include an onset detection unit for detecting onsets included in the audio signal, each onset being a time point a sound is produced, based on beat probabilities, each indicating a probability of a beat being included in each specific time unit of the audio signal, a beat score calculation unit for calculating, for each onset detected by the onset detection unit, a beat score indicating a degree of correspondence of the onset to a beat with a conceivable beat interval, a beat search unit for searching for an optimum path formed from the onsets showing a likely tempo fluctuation, based on the beat score calculated by the beat score calculation unit, and a beat determination unit for determining, as beat positions, positions of the onsets on the optimum path and positions supplemented according to the beat interval.

The beat analysis unit may further include a beat re-search unit for limiting a search range and re-executing a search for the optimum path, in a case a fluctuation in tempo of the optimum path determined by the beat search unit is small.

The beat search unit may determine the optimum path by using an evaluation value varying depending on the beat score, from among paths formed by sequentially selecting along a time axis nodes specified with the onsets and the beat intervals.

The beat search unit may determine the optimum path by further using an evaluation value varying depending on an amount of change in tempo between nodes before and after a transition.

The beat search unit may determine the optimum path by further using an evaluation value varying depending on a degree of matching between an interval between onsets before and after a transition and a beat interval at a node before or after the transition.

The beat search unit may determine the optimum path by further using an evaluation value varying depending on number of onsets skipped in a transition between nodes.

The beat analysis unit may further include a tempo revision unit for revising the beat positions determined by the beat determination unit, according to an estimated tempo estimated from a waveform of the audio signal by using an estimated tempo discrimination formula obtained in advance by learning.

The tempo revision unit may determine a multiplier for revision to be used for revising the beat positions, by evaluating, for each of a plurality of multipliers, a likelihood of a revised tempo by using an average beat probability for revised beat positions and the estimated tempo.

According to another embodiment of the present invention, there is provided an information processing apparatus including an onset detection unit for detecting onsets included in an audio signal, each onset being a time point a sound is produced, based on beat probabilities, each indicating a probability of a beat being included in each specific time unit of the audio signal, a beat score calculation unit for calculating, for each onset detected by the onset detection unit, a beat score indicating a degree of correspondence of the onset to a beat of a conceivable beat interval, a beat search unit for searching for an optimum path formed from the onsets showing a likely tempo fluctuation, based on the beat score calculated by the beat score calculation unit, and a beat determination unit for determining, as beat positions, positions of the onsets on the optimum path and positions supplemented according to the beat interval.

According to another embodiment of the present invention, there is provided a sound analysis method including the steps of detecting positions of beats included in an audio signal, calculating similarity probabilities, each being a probability of similarity between contents of sound of beat sections divided by each detected beat position, and determining a likely bar progression of the audio signal based on bar probabilities determined according to the calculated similarity probabilities and indicating to which ordinal in which meter respective beats correspond.

According to another embodiment of the present invention, there is provided a program for causing a computer controlling an information processing apparatus to function as a beat analysis unit for detecting positions of beats included in an audio signal, a structure analysis unit for calculating similarity probabilities, each being a probability of similarity between contents of sound of beat sections divided by each beat position detected by the beat analysis unit, and a bar detection unit for determining a likely bar progression of the audio signal based on bar probabilities determined according to the similarity probabilities calculated by the structure analysis unit, the bar probabilities indicating to which ordinal in which meter respective beats correspond.

According to the embodiments of the present invention described above, accuracy of detection of the positions of beats included in an audio signal or the types of the beats can be improved.

The patent or application file contains at least one drawing executed in color. Copies of this patent or patent application publication with color drawing(s) will be provided by the Office upon request and payment of the necessary fee.

BRIEF DESCRIPTION OF THE DRAWINGS

FIG. 49 is an explanatory diagram showing an example of a key transition probability;

FIG. 57 is an explanatory diagram for describing a learning process for a bar probability formula;

FIG. 60 is an explanatory diagram showing an example of a meter change probability;

FIG. 65 is an explanatory diagram for describing a learning process for an extended chord probability formula;

DETAILED DESCRIPTION OF EMBODIMENT

Figure 1:
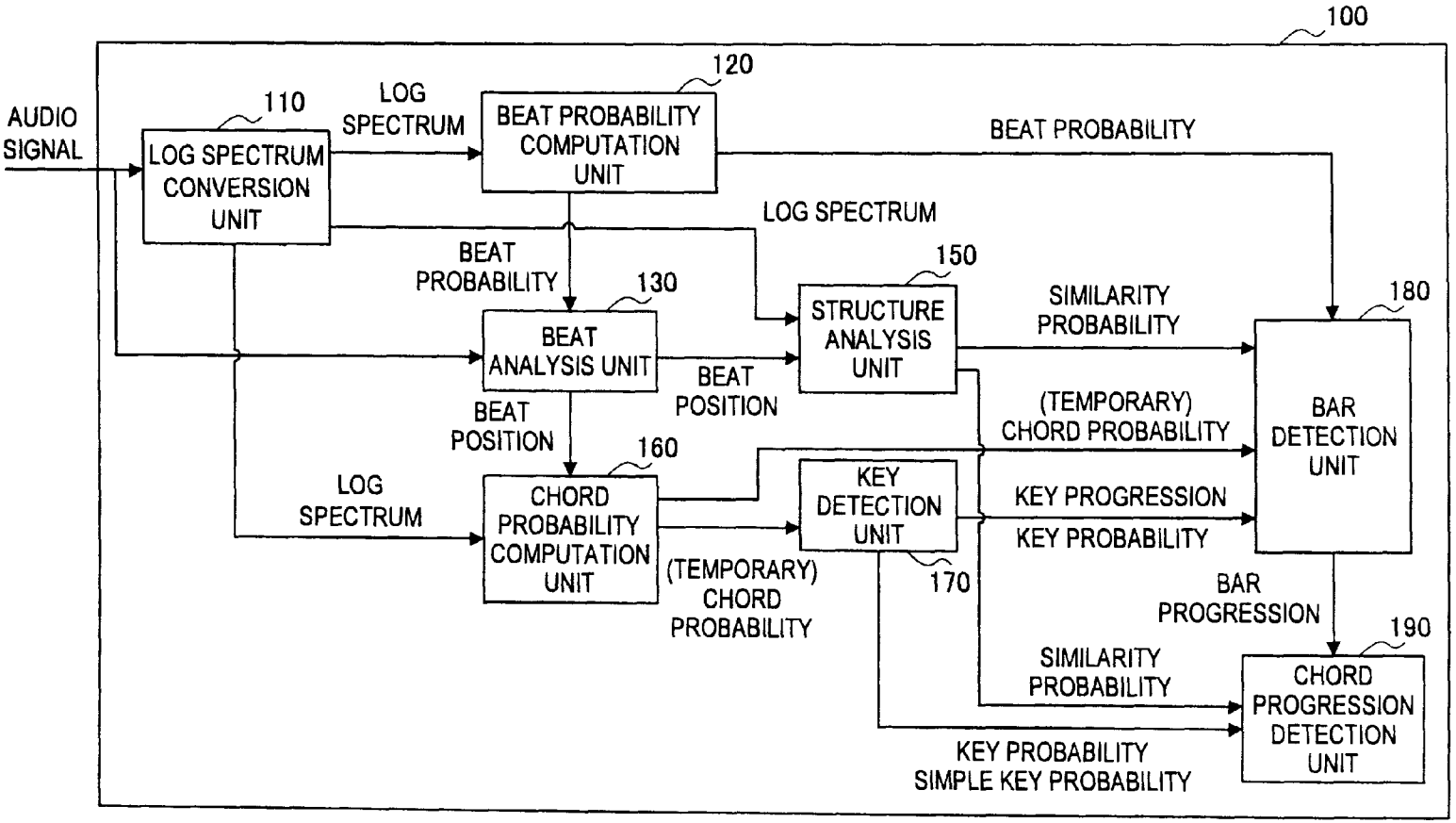
FIG. 1 is a block diagram showing a logical configuration of an information processing apparatus according to an embodiment.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Furthermore, the "DETAILED DESCRIPTION OF EMBODIMENT" will be described in the order shown below.

1. Overall Configuration of Information Processing Apparatus according to an Embodiment
2. Description of Each Unit of Information Processing Apparatus according to an Embodiment
   2-1. Log Spectrum Conversion Unit
   2-2. Beat Probability Computation Unit
   2-3. Beat Analysis Unit
   2-4. Structure Analysis Unit
   2-5. Chord Probability Computation Unit
   2-6. Key Detection Unit
   2-7. Bar Detection Unit
   2-8. Chord Progression Detection Unit
3. Feature of Information Processing Apparatus according to Present Embodiment
4. Conclusion 1. <Overall Configuration of Information Processing Apparatus According to an Embodiment>

First, an overall configuration of an information processing apparatus 100 according to an embodiment of the present invention will be described.

FIG. 1 is a block diagram showing a logical configuration of the information processing apparatus 100 according to the embodiment of the present invention. Referring to FIG. 1, the information processing apparatus 100 includes a log spectrum conversion unit 110, a beat probability computation unit 120, a beat analysis unit 130, a structure analysis unit 150, a chord probability computation unit 160, a key detection unit 170, a bar detection unit 180, and a chord progression detection unit 190.

The information processing apparatus 100 first obtains an audio signal, which is recorded sound of a music piece, in an arbitrary format. The format of an audio signal to be handled by the information processing apparatus 100 may be any compressed or non-compressed format such as WAV, AIFF, MP3, or ATRAC.

The information processing apparatus 100 takes the audio signal as an input signal, and performs processing by each unit shown in FIG. 1. A processing result of the audio signal by the information processing apparatus 100 may include, for example, the positions on the time axis of beats included in the audio signal, the positions of the bars, a key or chord at each beat position, or the like.

The information processing apparatus 100 may be a general-purpose computer, such as a personal computer (PC) or a workstation, for example. Also, the information processing apparatus 100 may be any digital device, such as a mobile phone terminal, a mobile information terminal, a game terminal, a music playback device, or a television. Furthermore, the information processing apparatus 100 may be a device dedicated to music processing.

In the following, each unit of the information processing apparatus 100 shown in FIG. 1 will be described in detail.

2. <Description of Each Unit of Information Processing Apparatus According to an Embodiment>

(2-1. Log Spectrum Conversion Unit)

The log spectrum conversion unit 110 converts the waveform of an audio signal, which is an input signal, to a log spectrum expressed in two dimensions: time and pitch. As a method of converting the waveform of the audio signal to a log spectrum, a method disclosed in JP-A-2005-275068 may be used, for example.

According to the method disclosed in JP-A-2005-275068, first, the audio signal is divided into signals for a plurality of octaves by band division and down-sampling. Then, signals for 12 pitches are respectively extracted from signals of each octave by a bandpass filter, which passes the frequency bands of the 12 pitches. As a result, a log spectrum showing energy of a note of the respective 12 pitches over a plurality of octaves can be obtained.

Figure 2:
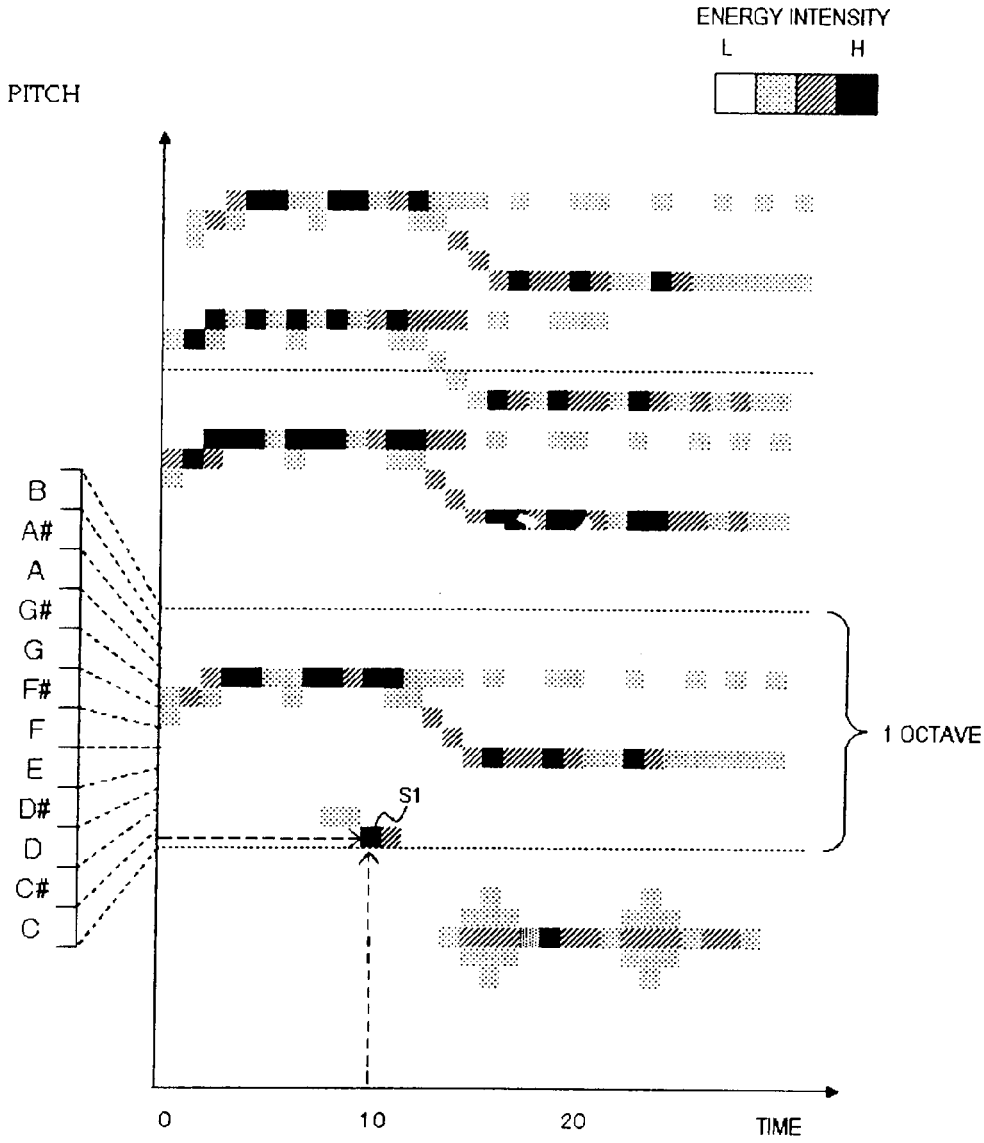
FIG. 2 is an explanatory diagram showing an example of a log spectrum.

FIG. 2 is an explanatory diagram showing an example of the log spectrum output from the log spectrum conversion unit 110.

Referring to the vertical axis of FIG. 2, the input audio signal is divided into four octaves, and each octave is further divided into 12 pitches: "C," "C#," "D," "D#," "E," "F," "F#," "G," "G#," "A," "A#," and "B." On the other hand, the horizontal axis of FIG. 2 shows frame numbers at a time of sampling the audio signal along the time axis. For example, when the audio signal is sampled at a sampling frequency 128 (Hz), 1-frame time period corresponds to 1(sec)/128=7.8125 (msec).

The intensity of colours plotted on the two-dimensional plane of time-pitch shown in FIG. 2 indicates the intensity of the energy of each pitch at each position on the time axis. For example, in FIG. 2, pitch C at the tenth frame for the octave second from the bottom (S1 in the figure) is plotted with dark colour, thus indicating that the energy of the note is high, i.e that the note is produced strongly.

Figure 3:
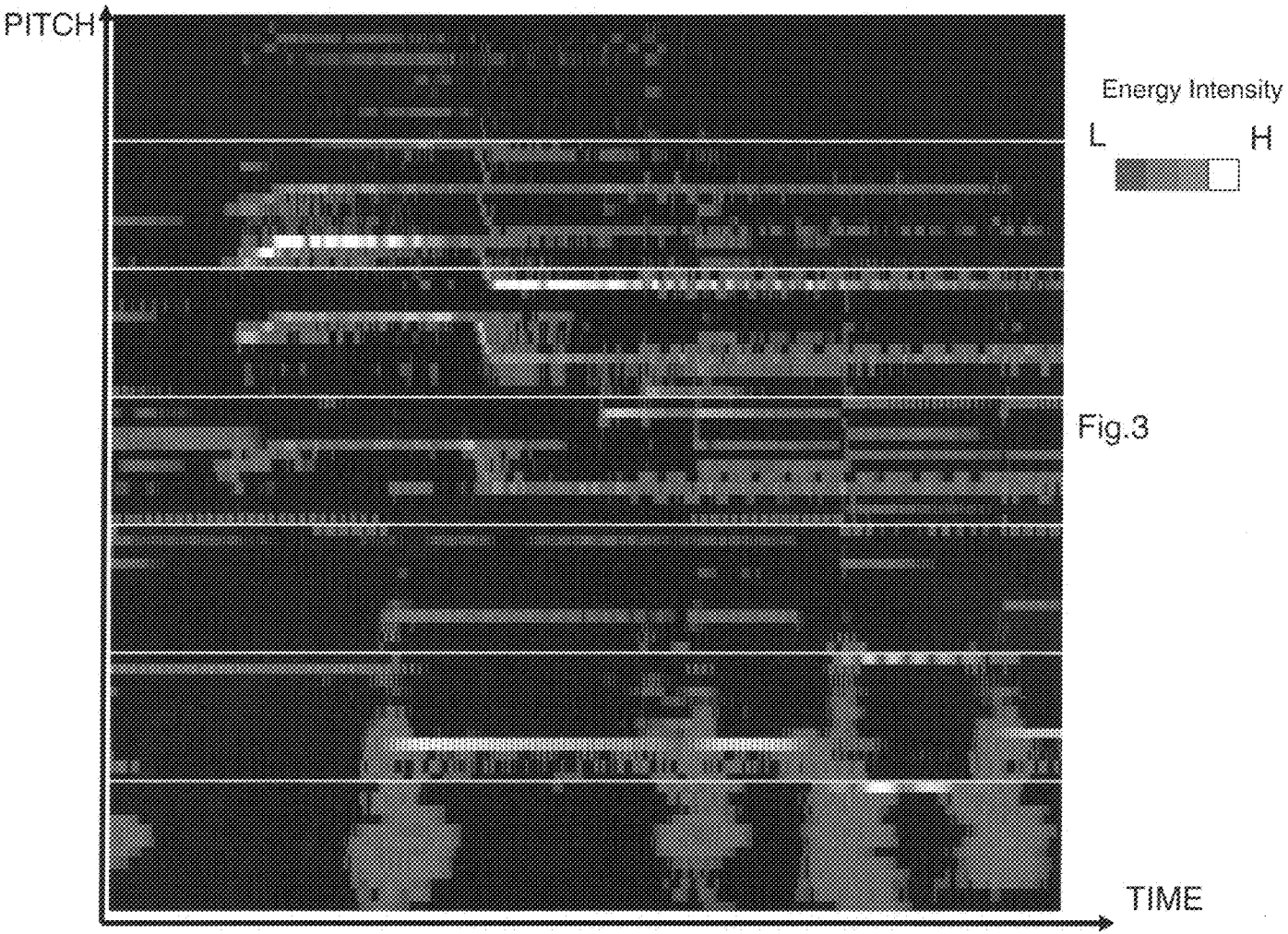
FIG. 3 is an explanatory diagram showing another example of the log spectrum.

Moreover, the log spectrum output from the log spectrum conversion unit 110 is not limited to such an example. FIG. 3 shows an example of a log spectrum where an audio signal different from that shown in FIG. 2 is divided into eight octaves.

(2-2. Beat Probability Computation Unit)

The beat probability computation unit 120 computes, for each of specific time units (for example, 1 frame) of the log spectrum input from the log spectrum conversion unit 110, the probability of a beat being included in the time unit (hereinafter referred to as "beat probability"). Moreover, when the specific time unit is 1 frame, the beat probability may be considered to be the probability of each frame coinciding with a beat position (position of a beat on the time axis). A beat probability formula obtained as a result of machine learning employing the learning algorithm disclosed in JP-A-2008-123011 is used for the computation of the beat probability, for example.

According to the method disclosed in JP-A-2008-123011, first, a set of content data, such as an audio signal, and teacher data for feature quantity to be extracted from the content data is supplied to a learning device. Next, the learning device generates a plurality of feature quantity extraction formulae for computing feature quantity from the content data, by combining randomly selected operators. Then, the learning device compares the feature quantities calculated according to the generated feature quantity extraction formulae with the input teacher data and evaluates the feature quantities. Furthermore, the learning device generates next-generation feature quantity extraction formulae based on the evaluation result of the feature quantity extraction formulae. By repeating the cycle of the generation of the feature quantity extraction formulae and the evaluation several times, a feature quantity extraction formula capable of extracting teacher data from the content data with high accuracy can be finally obtained.

Figure 4:
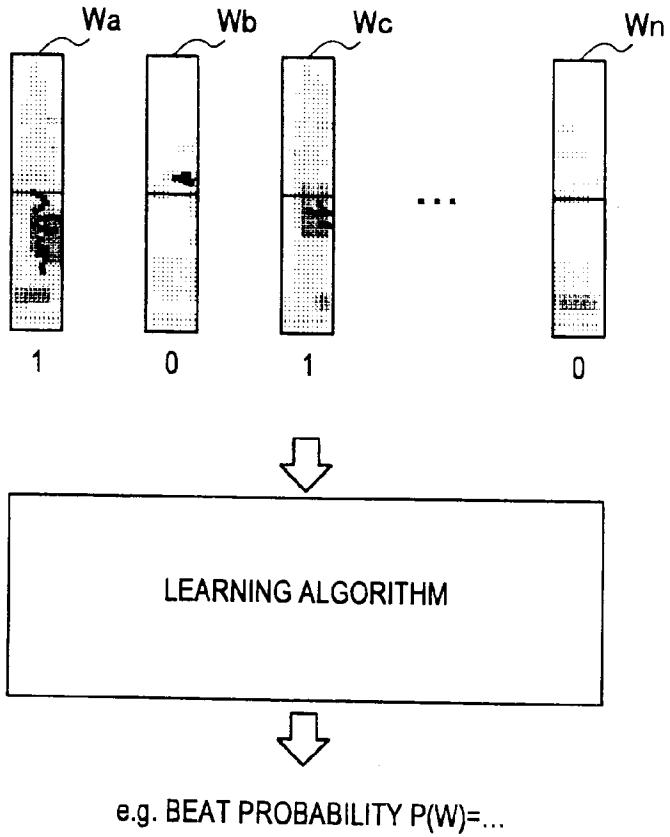
FIG. 4 is an explanatory diagram for describing a learning process for a beat probability formula.

The beat probability formula used by the beat probability computation unit 120 is obtained by a learning process as shown in FIG. 4, by employing such a learning algorithm. Moreover, in FIG. 4, an example is shown where the time unit used for the computation of the beat probability is 1 frame.

First, fragments of a log spectrum (hereinafter referred to as "partial log spectrum") which has been converted from an audio signal of a music piece whose beat positions are known and beat probability as the teacher data for each of the partial log spectra are supplied to the learning algorithm. Here, the window width of the partial log spectrum is determined taking into consideration the trade-off between the accuracy of the computation of the beat probability and the processing cost. For example, the window width of the partial log spectrum may include 7 frames preceding and following the frame for which the beat probability is to be calculated (i.e. 15 frames in total).

Furthermore, the beat probability as the teacher data is, for example, data indicating whether a beat is included in the centre frame of each partial log spectrum, based on the known beat positions and by using a true value (1) or a false value (0). The positions of bars are not taken into consideration here, and when the centre frame corresponds to the beat position, the beat probability is 1; and when the centre frame does not correspond to the beat position, the beat probability is 0. In the example shown in FIG. 4, the beat probabilities of partial log spectra Wa, Wb, Wc, . . . , Wn are given respectively as 1, 0, 1, . . . , 0.

A beat probability formula (P(W)) for computing the beat probability from the partial log spectrum is obtained in advance by the above-described learning algorithm, based on a plurality of sets of input data and teacher data as described.

Then, the beat probability computation unit 120 cuts out, for each of the frames of input log spectrum, a partial log spectrum having a window width of over several frames preceding and following the frame, and computes, for one partial log spectrum at a time, the beat probability for each of a plurality of partial log spectra by applying the beat probability formula obtained as a result of learning.

Figure 5:
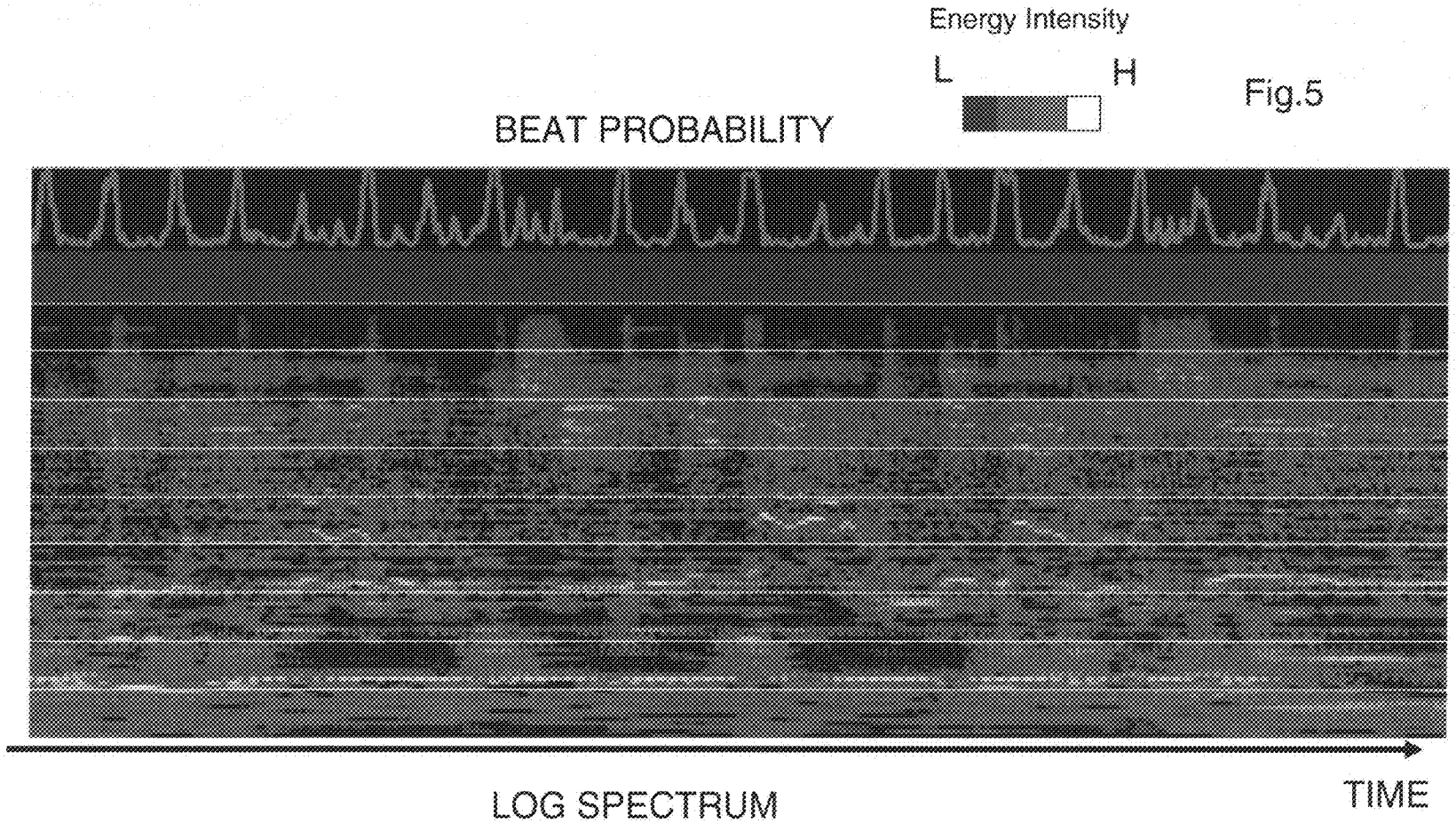
FIG. 5 is an explanatory diagram showing an example of a beat probability computed by the beat probability formula.

FIG. 5 is an explanatory diagram showing an example of the beat probability computed by the beat probability computation unit 120.

Referring to FIG. 5, first, an example of the log spectrum to be input to the beat probability computation unit 120 from the log spectrum conversion unit 110 is shown in the upper part of FIG. 5. Also, in the lower part of FIG. 5, the beat probability computed by the beat probability computation unit 120 from the log spectrum shown in the upper part is shown with a polygonal line on the time axis. For example, at frame position F1, a partial log spectrum W1 is cut out from the log spectrum, and the beat probability is computed to be 0.95 by the beat probability formula. On the other hand, at frame position F2, a partial log spectrum W2 is cut out from the log spectrum, and the beat probability is computed to be 0.1 by the beat probability formula. That is, it can be understood that the possibility of the frame position F1 corresponding to a beat position is high, and the possibility of the frame position F2 corresponding to a beat position is low.

The beat probability of each frame computed in this manner by the beat probability computation unit 120 is output to the beat analysis unit 130 and the bar detection unit 180 described later.

Moreover, the beat probability formula used by the beat probability computation unit 120 may be learnt by another learning algorithm. However, it should be noted that, generally, the log spectrum includes a variety of parameters, such as a spectrum of drums, an occurrence of a spectrum due to utterance, and a change in a spectrum due to change of chord. In case of a spectrum of drums, it is highly probable that the time point of beating the drum is the beat position. On the other hand, in case of a spectrum of voice, it is highly probable that the beginning time point of utterance is the beat position. To compute the beat probability with high accuracy by collectively using the variety of parameters, it is suitable to use the learning algorithm disclosed in JP-A-2008-123011.

(2-3. Beat Analysis Unit)

The beat analysis unit 130 determines the position, on the time axis, of a beat included in the audio signal, i.e. the beat position, based on the beat probability input from the beat probability computation unit 120.

Figure 6:
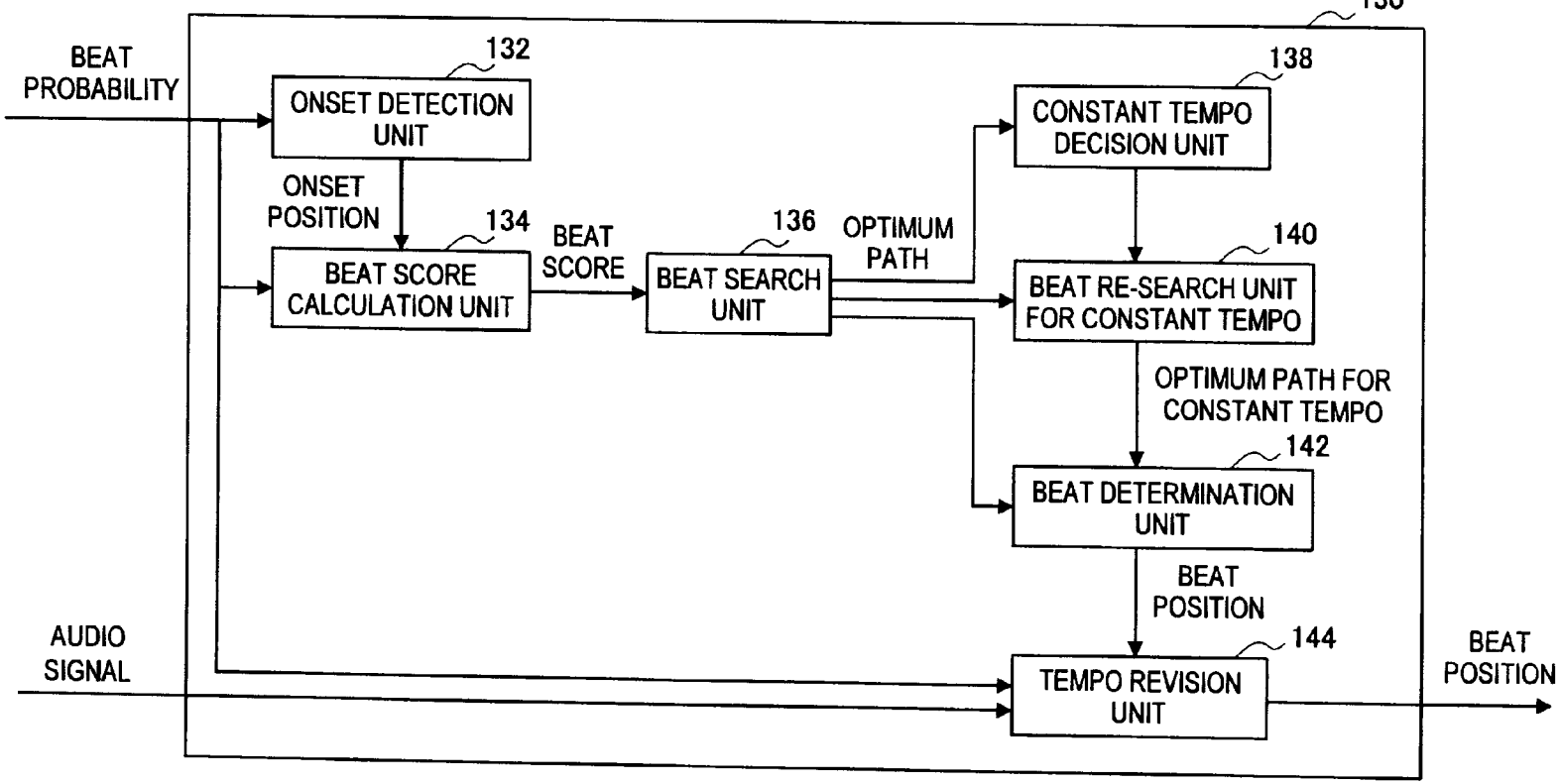
FIG. 6 is a block diagram showing a detailed configuration of a beat analysis unit.

FIG. 6 is a block diagram showing a detailed configuration of the beat analysis unit 130. Referring to FIG. 6, the beat analysis unit 130 includes an onset detection unit 132, a beat score calculation unit 134, a beat search unit 136, a constant tempo decision unit 138, a beat re-search unit 140 for constant tempo, a beat determination unit 142, and a tempo revision unit 144.

(2-3-1. Onset Detection Unit)

The onset detection unit 132 detects onsets included in the audio signal based on the beat probability, described using FIG. 5, input from the beat probability computation unit 120. In this specification, an onset is a time point in an audio signal at which a sound is produced, and more specifically, is treated as a point at which the beat probability is above a specific threshold value and takes a maximal value.

Figure 7:
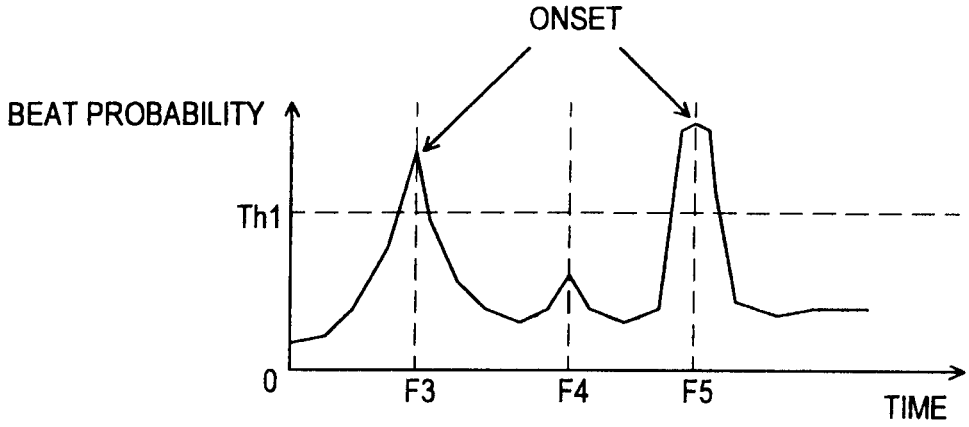
FIG. 7 is an explanatory diagram showing an example of onsets detected from the beat probability.

FIG. 7 is an explanatory diagram showing an example of the onsets detected from the beat probability computed for an audio signal.

In FIG. 7, as with the lower part of FIG. 5, the beat probability computed by the beat probability computation unit 120 is shown with a polygonal line on the time axis. With this beat probability, the points taking a maximal value are three points, i.e. frames F3, F4 and F5. Among these, regarding the frames F3 and F5, the beat probabilities at the time points are above a specific threshold value Th1 given in advance. On the other hand, the beat probability at the time point of the frame F4 is below the threshold value Th1. In this case, two points, i.e. the frames F3 and F5, are detected as the onsets.

Figure 8:
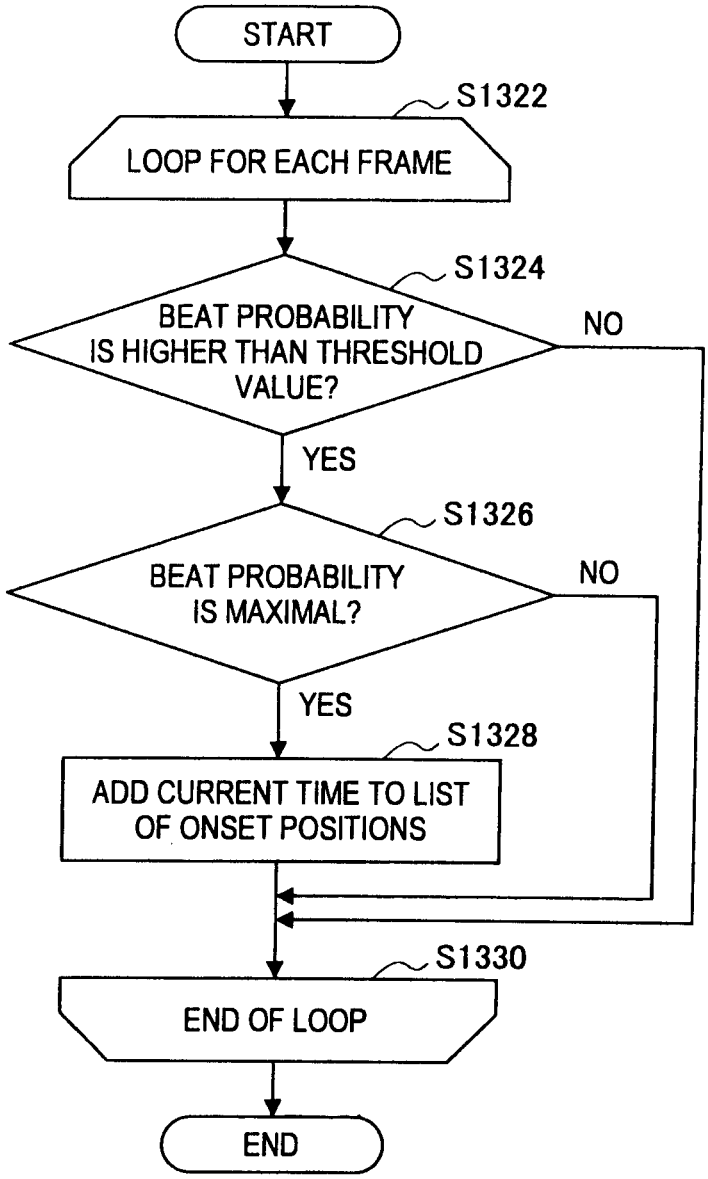
FIG. 8 is a flow chart showing an example of an onset detection process flow.

FIG. 8 is a flow chart showing an example of an onset detection process flow of the onset detection unit 132.

Referring to FIG. 8, first, the onset detection unit 132 sequentially executes a loop for the frames, starting from the first frame, with regard to the beat probability computed for each frame (S1322). Then, the onset detection unit 132 decides, with respect to each frame, whether the beat probability is above the specific threshold value (S1324), and whether the beat probability indicates a maximal value (S1326). Here, when the beat probability is above the specific threshold value and the beat probability indicates a maximal value, the process proceeds to S1328. On the other hand, when the beat probability is not above the specific threshold value, or the beat probability does not indicate a maximal value, the process of S1328 is skipped. At S1328, current times (or frame numbers) are added to a list of the onset positions (S1328). Then, when the processing regarding all the frames is over, the loop is ended (S1330).

With the onset detection process by the onset detection unit 132 as described above, a list of the positions of the onsets included in the audio signal, i.e. a list of times or frame numbers of respective onsets, is output.

Figure 9:
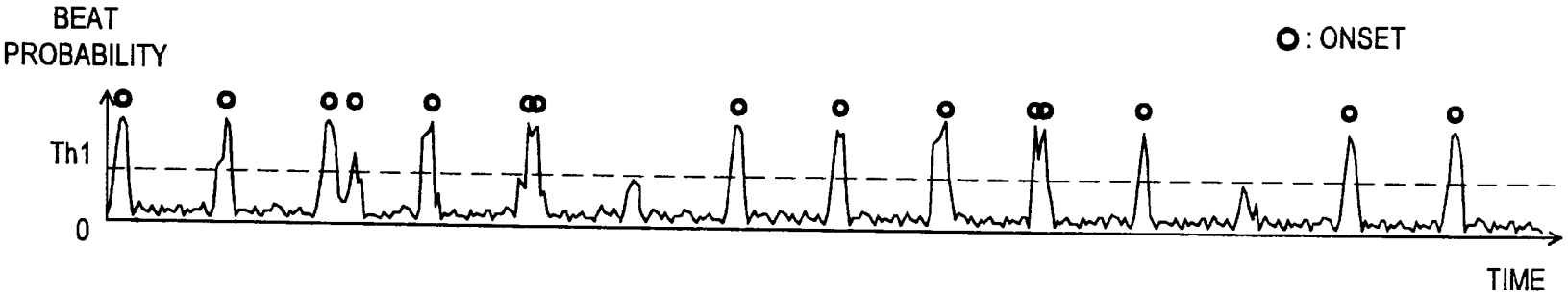
FIG. 9 is an explanatory diagram showing positions of the onsets detected by the onset detection unit in association with the beat probability.

FIG. 9 is an explanatory diagram showing the positions of the onsets detected by the onset detection unit 132 in relation to the beat probability.

In FIG. 9, the positions of the onsets detected by the onset detection unit 132 are shown with circles above the polygonal line showing the beat probability. It can be understood that 15 onsets indicating maximal values with the beat probabilities above the threshold value Th1 are detected. The list of the positions of the onsets detected by the onset detection unit 132 is output to the beat score calculation unit 134 described next.

(2-3-2. Beat Score Calculation Unit)

The beat score calculation unit 134 calculates, for each onset detected by the onset detection unit 132, a beat score indicating the degree of correspondence to a beat among beats forming a series of beats with a constant tempo (or a constant beat interval).

Figure 10:
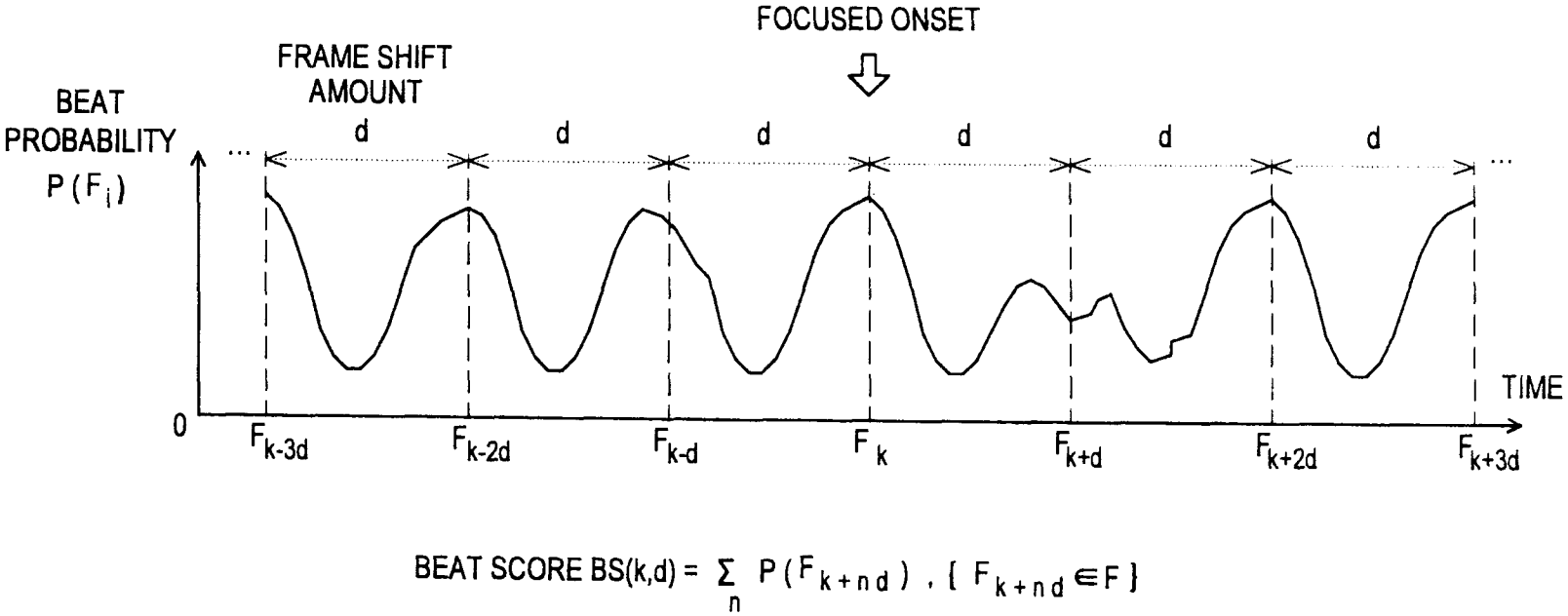
FIG. 10 is an explanatory diagram for describing a beat score calculation process.

FIG. 10 is an explanatory diagram for describing a beat score calculation process by the beat score calculation unit 134.

Referring to FIG. 10, among the onsets detected by the onset detection unit 132, the onset at a frame position $F_k$ (frame number k) is set as a focused onset. Furthermore, a series of frame positions $F_{k-3}$, $F_{k-2}$, $F_{k-1}$, $F_k$, $F_{k+1}$, $F_{k+2}$, and $F_{k+3}$ distanced from the frame position $F_k$ at integer multiples of a specific distance d is shown. In this specification, this specific distance d is referred to as a shift amount, and a frame position distanced at an integer multiple of the shift amount d is referred to as a shift position. The sum of the beat probabilities at all the shift positions ( . . . $F_{k-3}$, $F_{k-2}$, $F_{k-1}$, $F_k$, $F_{k+1}$, $F_{k+2}$, and $F_{k+3}$ . . . ) included in a group F of frames for which the beat probability has been calculated will be the beat score of the focused onset. That is, when the beat probability at a frame position $F_i$ is $P(F_i)$, a beat score BS(k,d) of the focused onset depending on the frame number k and the shift amount d is expressed by the following equation.

$$BS(k, d) = \sum_n P(F_{k+nd}), \{F_{k+nd} \in F\} \quad (1)$$

[Equation 1] The beat score BS(k,d) computed by Equation 1 can be said to be the score indicating the possibility of an onset at the k-th frame of the audio signal being in sync with a constant tempo having the shift amount d as the beat interval.

Figure 11:
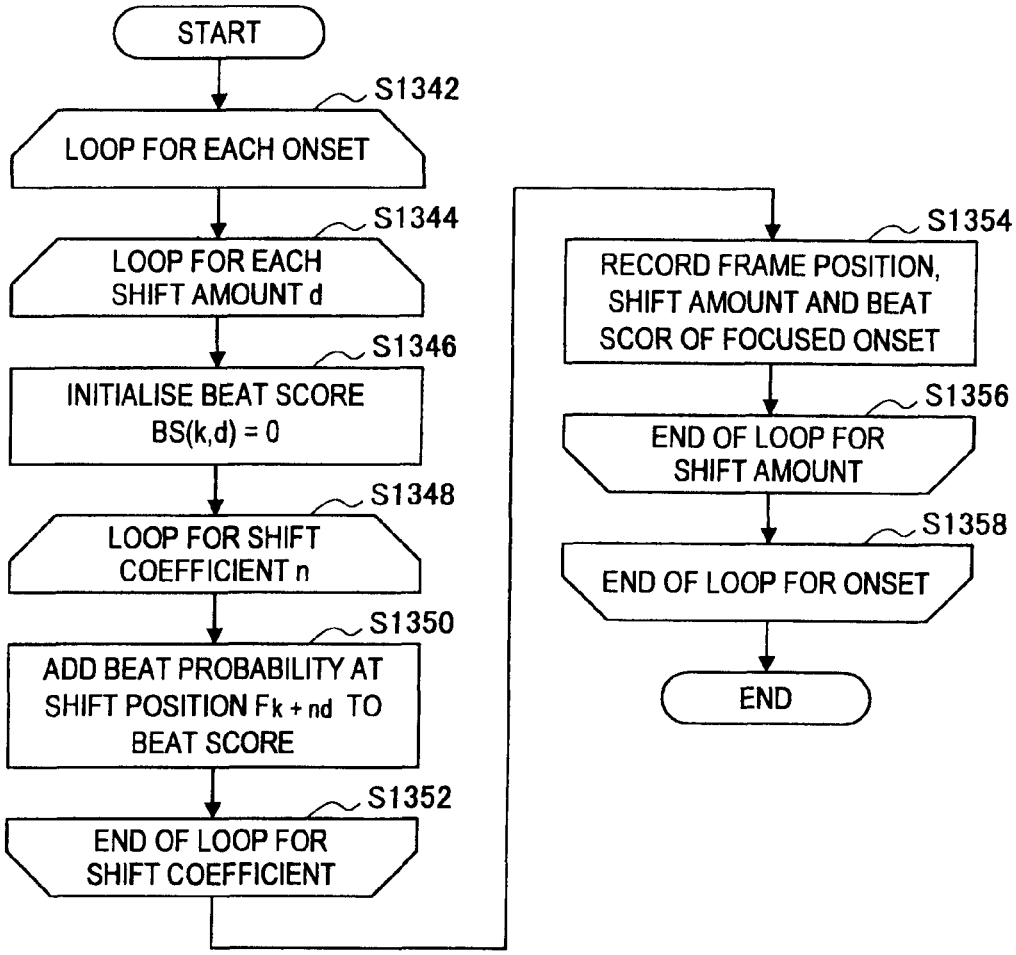
FIG. 11 is a flow chart showing an example of a beat score calculation process flow.

FIG. 11 is a flow chart showing an example of a beat score calculation process flow of the beat score calculation unit 134.

Referring to FIG. 11, first, the beat score calculation unit 134 sequentially executes a loop for the onsets, starting from the first onset, with regard to the onsets detected by the onset detection unit 132 (S1322). Furthermore, the beat score calculation unit 134 executes a loop for each of all the shift amounts d with regard to the focused onset (S1344). The shift amounts d, which are the subjects of the loop, are the values of the intervals at all the beats which may be used in a music performance. The beat score calculation unit 134 then initialises the beat score BS(k,d) (that is, zero is substituted into the beat score BS(K,d)) (S1346). Next, the beat score calculation unit 134 executes a loop for a shift coefficient n for shifting a frame position $F_d$ of the focused onset (S1348). Then, the beat score calculation unit 134 sequentially adds the beat probability $P(F_{k+nd})$ at each of the shift positions to the beat score BS(k,d) (S1350). Then, when the loop for all the shift coefficients n is over (S1352), the beat score calculation unit 134 records the frame position (frame number k), the shift amount d and the beat score BS(k,d) of the focused onset (S1354). The beat score calculation unit 134 repeats this computation of the beat score BS(k,d) for every shift amount of all the onsets (S1356, S1358).

With the beat score calculation process by the beat score calculation unit 134 as described above, the beat score BS(k, d) across a plurality of the shift amounts d is output for every onset detected by the onset detection unit 132.

Figure 12:
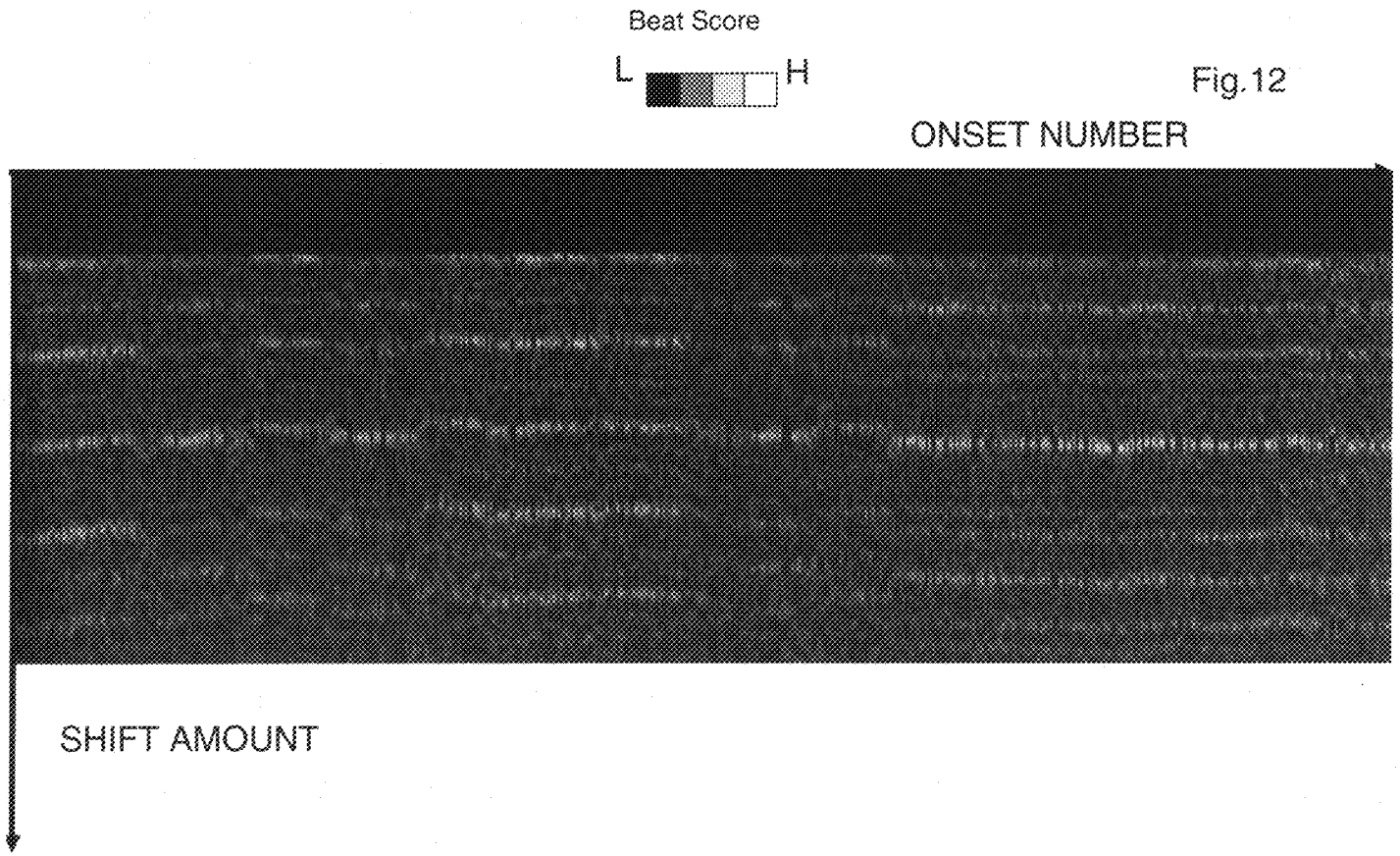
FIG. 12 is a beat score distribution chart visualizing beat scores output from a beat score calculation unit.

FIG. 12 is a beat score distribution chart visualizing the beat scores output from the beat score calculation unit 134.

In FIG. 12, the onsets detected by the onset detection unit 132 are shown in time series along the horizontal axis. On the other hand, the vertical axis in FIG. 12 indicates the shift amount for which the beat score for each onset has been computed. Furthermore, the intensity of the colour of each dot in the figure indicates the level of the beat score calculated for the onset at the shift amount. In this beat score distribution chart, in the vicinity of a shift amount d1, for example, the beat scores are high for all the onsets. This means that, when assuming that the music piece is played at a tempo at the shift amount d1, it is highly possible that many of the detected onsets correspond to the beats. The beat scores calculated by the beat score calculation unit 134 are output to the beat search unit 136 described next.

72(2-3-3. Beat Search Unit)

The beat search unit 136 searches for a path of onset positions showing a likely tempo fluctuation, based on the beat scores calculated by the beat score calculation unit 134. A Viterbi algorithm based on hidden Markov model may be used as the path search method by the beat search unit 136, for example.

Figure 13:
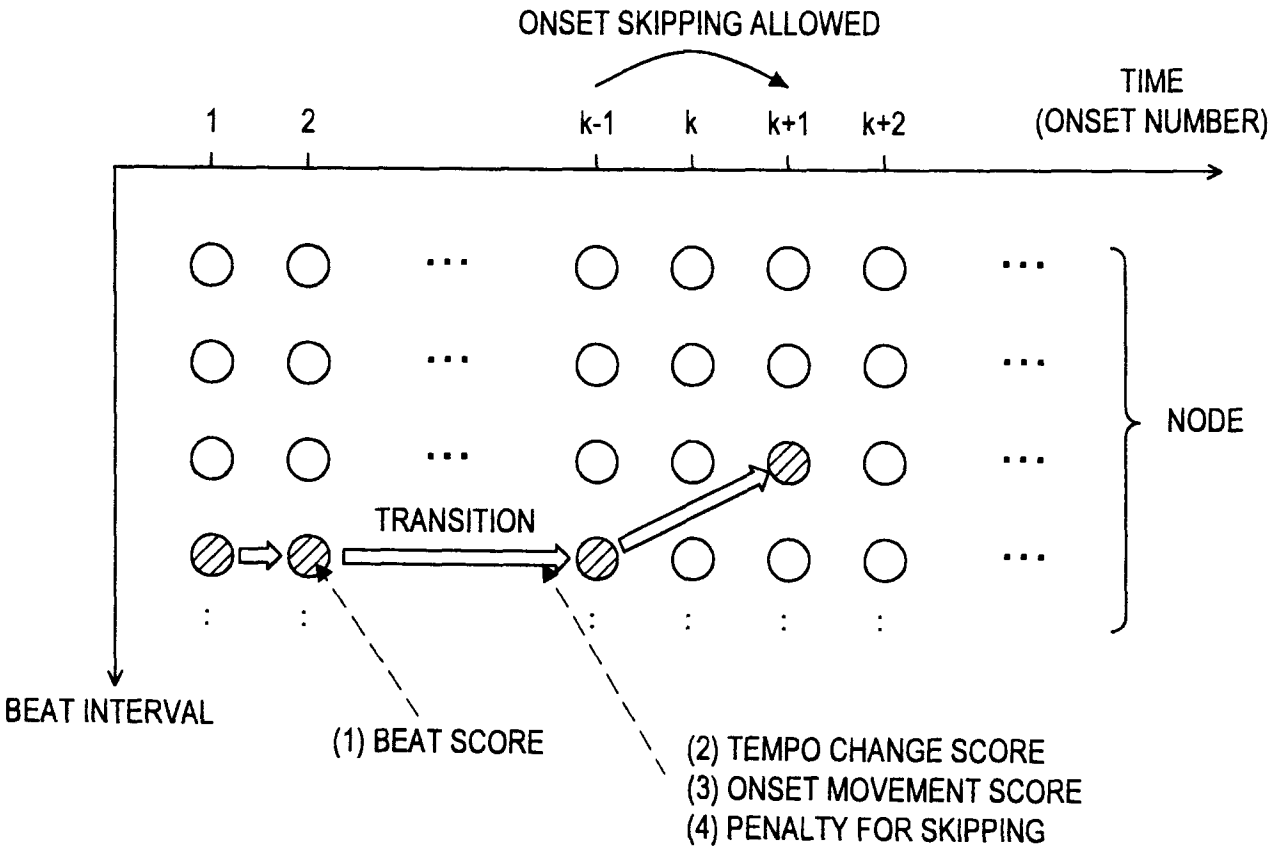
FIG. 13 is an explanatory diagram for describing a path search by a beat search unit.

FIG. 13 is an explanatory diagram for describing a path search by the beat search unit 136.

When applying the Viterbi algorithm for the path search by the beat search unit 136, the onset number described in relation to FIG. 12 is used as the unit of the time axis (horizontal axis in FIG. 13). Also, the shift amount used for the computation of beat score is used as an observation sequence (vertical axis in FIG. 13).

That is, the beat search unit 136 takes each of all the pairs of the onsets for which the beat scores have been calculated by the beat score calculation unit 134 and the shift amounts as a node, which is a subject of the path search. Moreover, as described above, the shift amount of each node is equivalent, in its meaning, to the beat interval assumed for the node. Thus, in the following description, the shift amount of each node is referred to as the beat interval.

With regard to the node as described, the beat search unit 136 sequentially selects, along the time axis, any of the nodes, and evaluates a path formed from a series of selected nodes by using an evaluation value described later. At this time, in the node selection, the beat search unit 136 is allowed to skip onsets. For example, in FIG. 13, after the k−1st onset, the k-th onset is skipped and the k+1st onset is selected. This is because normally onsets that are beats and onsets that are not beats are mixed in the onsets, and a likely path has to be searched from among paths including paths not going through onsets that are not beats.

For example, for the evaluation of a path, four evaluation values may be used, namely (1) beat score, (2) tempo change score, (3) onset movement score, and (4) penalty for skipping. Among these, (1) beat score is the beat score calculated by the beat score calculation unit 134 for each node. On the other hand, (2) tempo change score, (3) onset movement score and (4) penalty for skipping are given to a transition between nodes.

Among the evaluation values to be given to a transition between nodes, (2) tempo change score is an evaluation value given based on the empirical knowledge that, normally, a tempo fluctuates gradually in a music piece. That is, in a transition between nodes in the path selection, a value given to the tempo change score is higher as the difference between the beat interval at a node before transition and the beat interval at a node after the transition is smaller.

Figure 14:
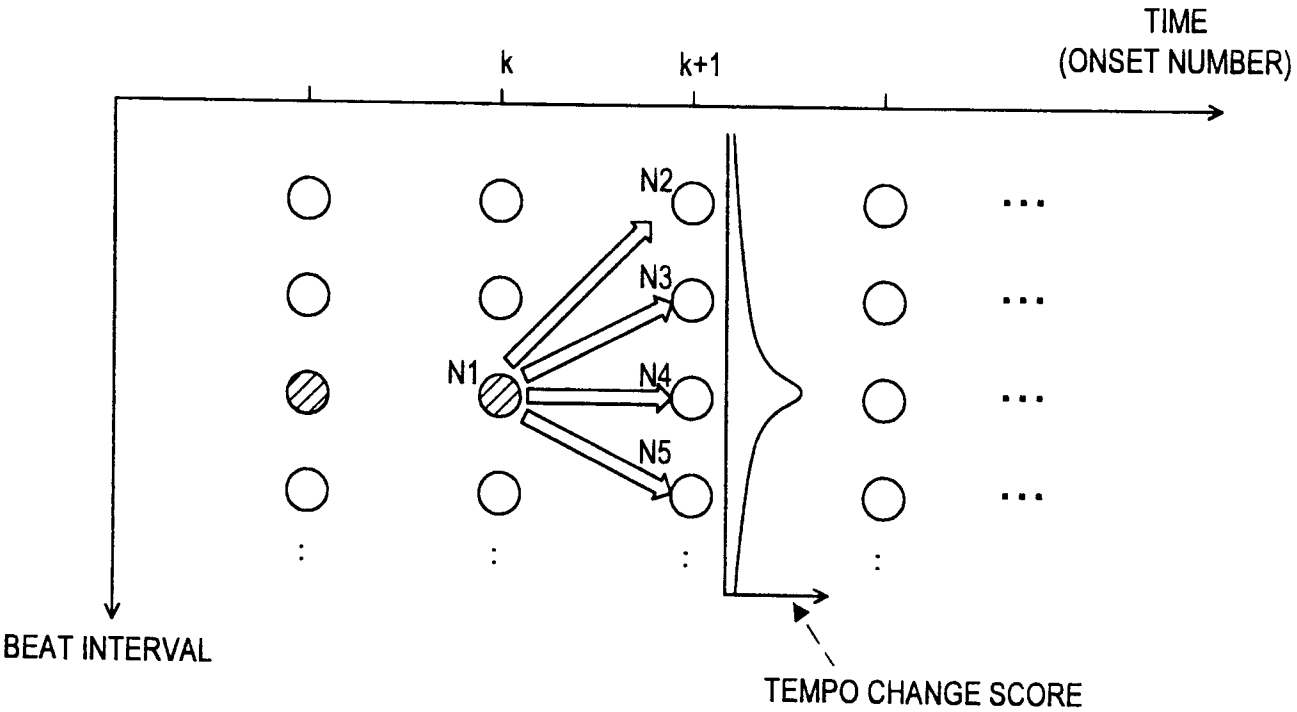
FIG. 14 is an explanatory diagram showing an example of a tempo change score.

FIG. 14 is an explanatory diagram showing an example of the tempo change score.

In FIG. 14, a node N1 is currently selected. The beat search unit 136 possibly selects any of nodes N2 to N5 as the next node (although other nodes might also be selected, for the sake of convenience of description, four nodes, i.e. nodes N2 to N5, will be described). Here, when the beat search unit 136 selects the node N4, since there is no difference between the beat intervals at the node N1 and the node N4, the highest value will be given as the tempo change score. On the other hand, when the beat search unit 136 selects the node N3 or N5, there is a difference between the beat intervals at the node N1 and the node N3 or N5, and thus, a lower tempo change score compared to when the node N4 is selected is given. Furthermore, when the beat search unit 136 selects the node N2, since the difference between the beat intervals at the node N1 and the node N2 is larger than when the node N3 or N5 is selected, an even lower tempo score is given.

Next, (3) onset movement score is an evaluation value given in accordance with whether the interval between the onset positions of the nodes before and after the transition matches the beat interval at the node before the transition.

Figure 15:
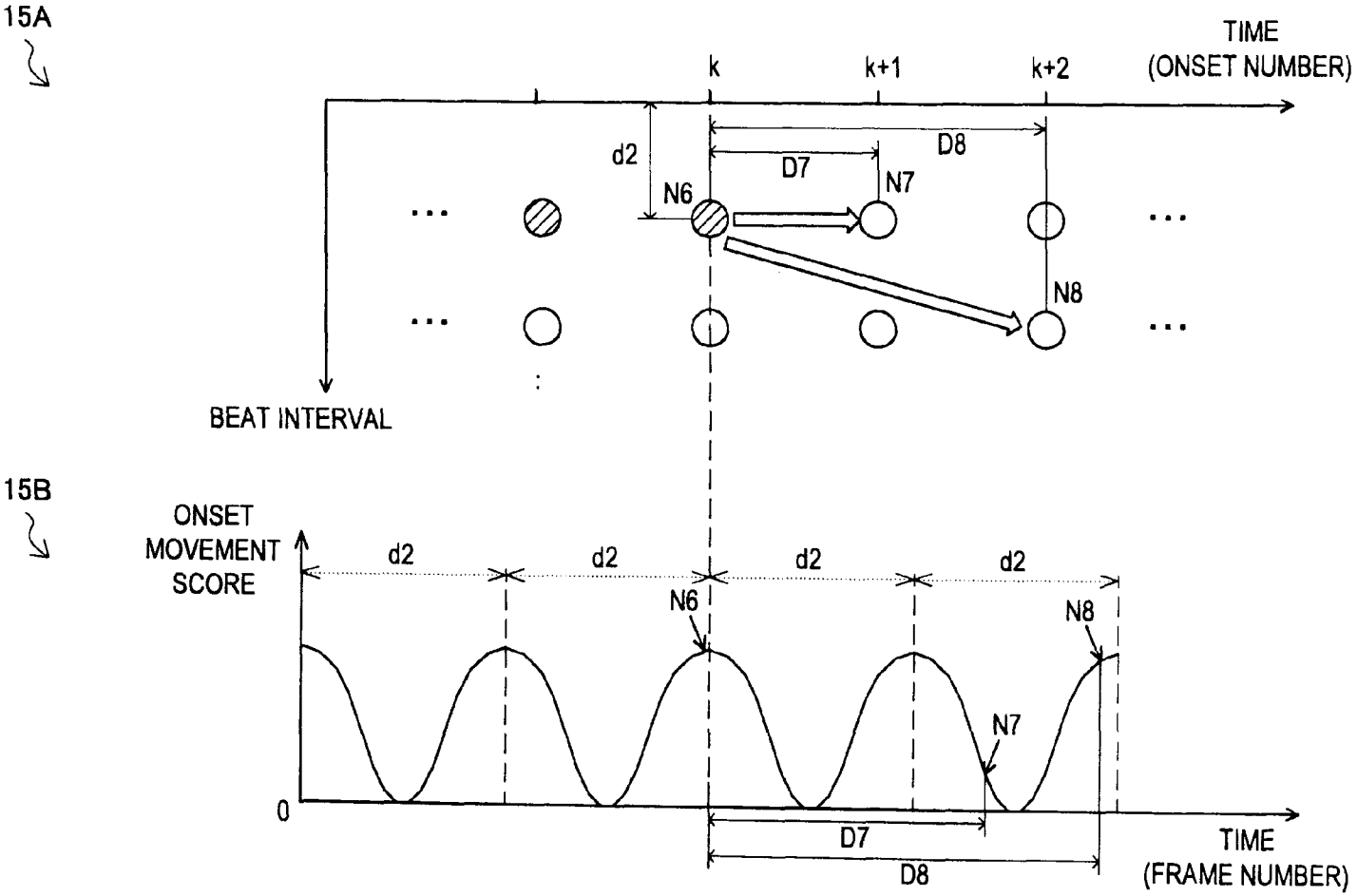
FIG. 15 is an explanatory diagram showing an example of an onset movement score.

FIG. 15 is an explanatory diagram showing an example of the onset movement score.

In FIGS. 15 (15A), a node N6 with a beat interval d2 for the k-th onset is currently selected. Also, two nodes, N7 and N8, among nodes which may be selected next by the beat search unit 136 are also shown. Among these, the node N7 is a node of the k+1st onset, and the interval between the k-th onset and the k+1st onset (for example, difference between the frame numbers) is D7. On the other hand, the node N8 is a node of the k+2nd onset, and the interval between the k-th onset and the k+2nd onset is D8.

Here, when assuming an ideal path where all the nodes on the path correspond, without fail, to the beat positions in a constant tempo, the interval between the onset positions of adjacent nodes is an integer multiple (same interval when there is no rest) of the beat interval at each node. Thus, as shown in FIGS. 15 (15B), the onset movement score is defined to be higher as the interval between the onset positions is closer to the integer multiple of the beat interval d2 at the node N6, in relation to the current node N6. In the example of FIGS. 15 (15B), since the interval D8 between the nodes N6 and N8 is closer to the integer multiple of the beat interval d2 at the node N6 than the interval D7 between the nodes N6 and N7, a higher onset movement score is given to the transition from the node N6 to the node N8.

Now, (4) penalty for skipping is an evaluation value for restricting an excessive skipping of onsets in a transition between nodes. That is, the score is lower as more onsets are skipped in one transition, and the score is higher as fewer onsets are skipped in one transition. Here, lower score means higher penalty.

Figure 16:
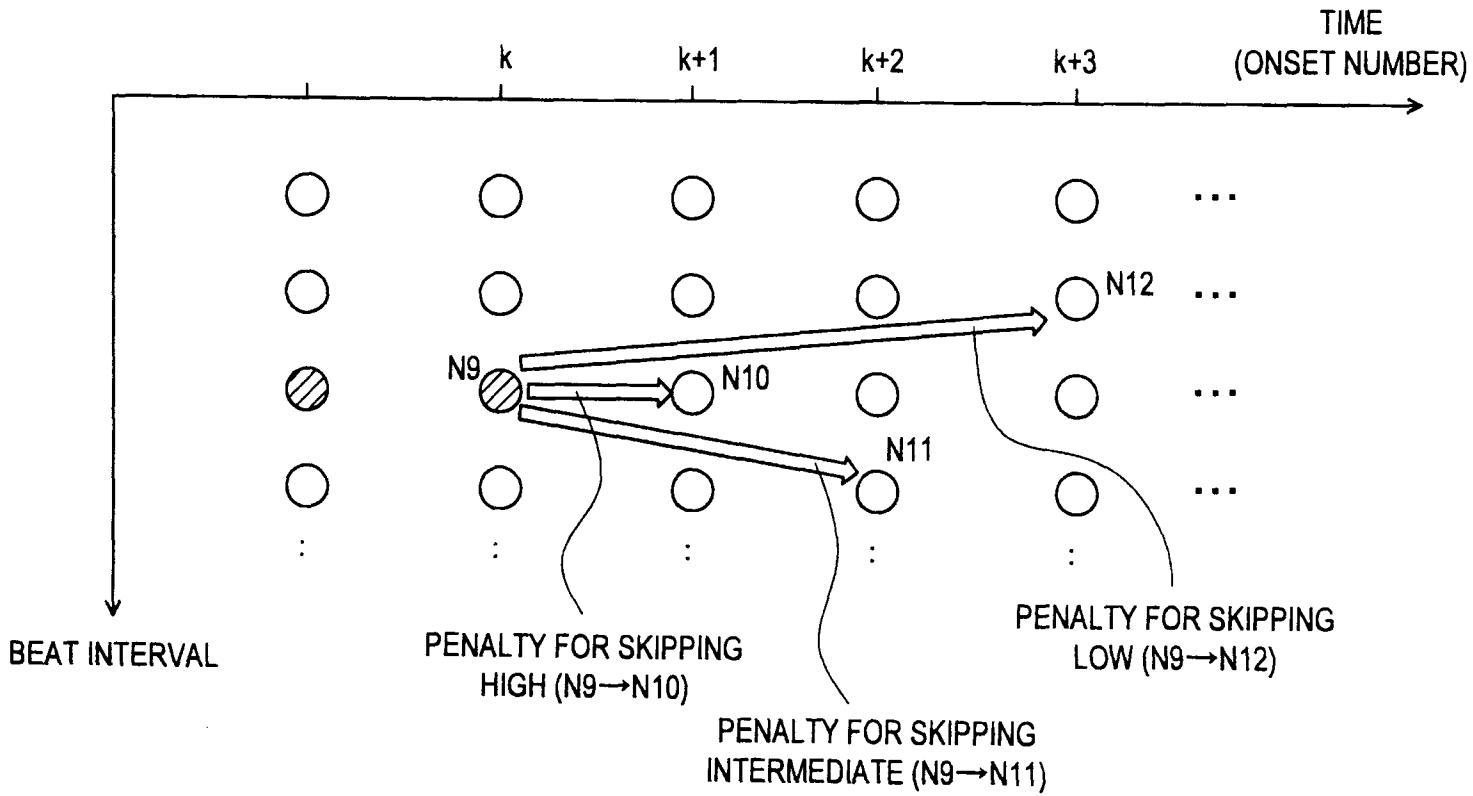
FIG. 16 is an explanatory diagram showing an example of a penalty for skipping.

FIG. 16 is an explanatory diagram showing an example of the penalty for skipping.

In FIG. 16, a node N9 of the k-th onset is currently selected. Also, three nodes, N10, N11 and N12, among nodes which may be selected next by the beat search unit 136 are also shown. Among these, the node N10 is the node of the k+1st onset, the node N11 is the node of the k+2nd onset, and the node N12 is the node of the k+3rd onset. That is, in case of transition from the node N9 to the node N10, no onset is skipped. On the other hand, in case of transition from the node N9 to the node N11, the k+1st onset is skipped. Also, in case of transition from the node N9 to the node N12, the k+1st and k+2nd onsets are skipped. At this time, the penalty for skipping takes a relatively high value in case of transition from the node N9 to the node N10, an intermediate value in case of transition from the node N9 to the node N11, and a low value in case of transition from the node N9 to the node N12. According to this, a phenomenon that a larger number of onsets are skipped to thereby make the interval between the nodes constant can be prevented.

Heretofore, the four evaluation values used for the evaluation of paths searched out by the beat search unit 136 have been described. The evaluation of paths described by using FIG. 13 is performed, with respect to a selected path, by sequentially multiplying by each other the evaluation values of the above-described (1) to (4) given to each node or for the transition between nodes included in the path. The beat search unit 136 determines, as the optimum path, the path whose product of the evaluation values is the largest among all the conceivable paths.

Figure 17:
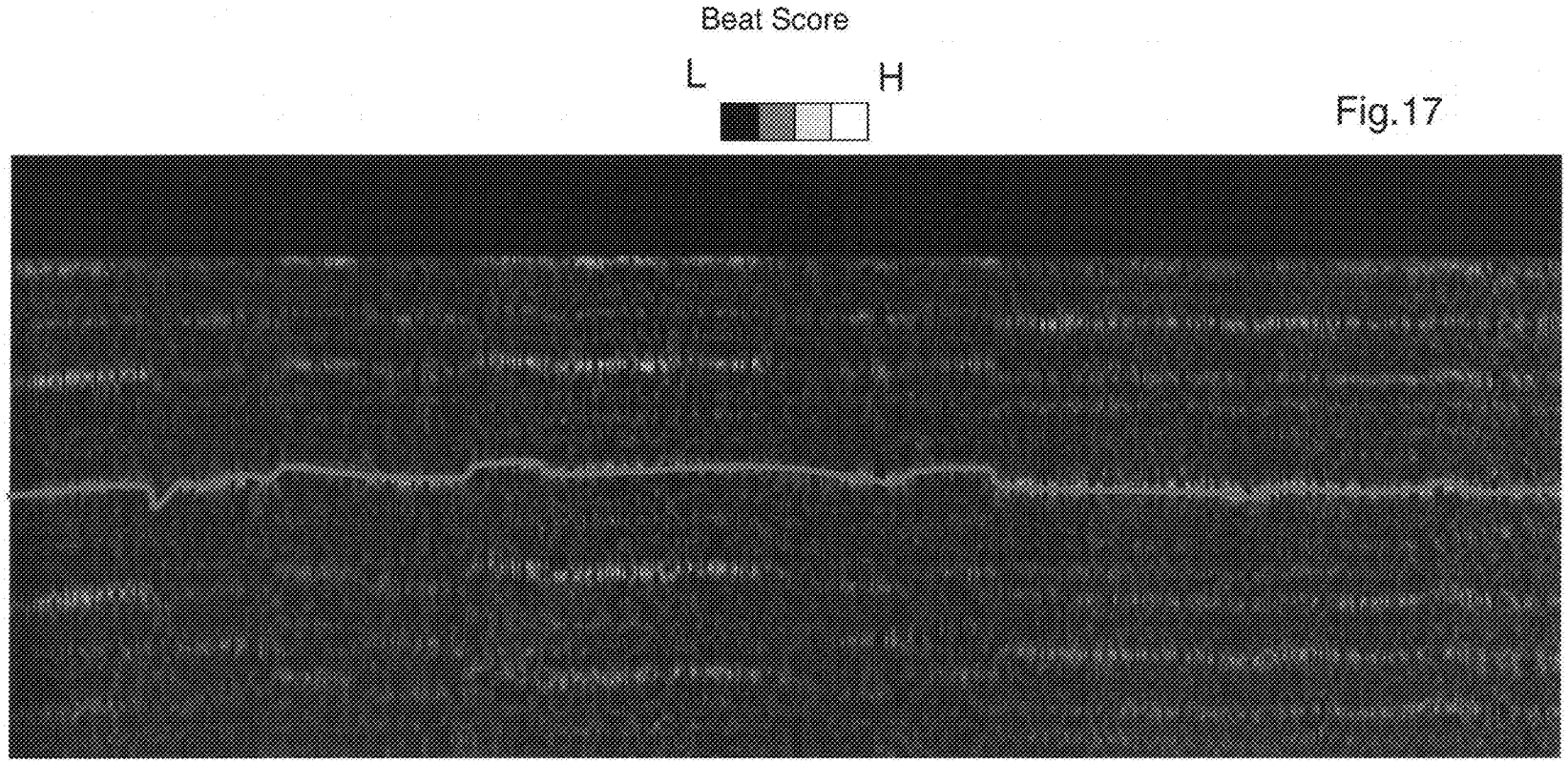
FIG. 17 is an explanatory diagram showing an example of a path determined to be the optimum path by the beat search unit.

FIG. 17 is an explanatory diagram showing an example of a path determined to be the optimum path by the beat search unit 136.

In FIG. 17, the optimum path determined by the beat search unit 136 is outlined by dotted-lines on the beat score distribution chart shown in FIG. 12. Referring to FIG. 17, it can be seen that the tempo of the music piece for which search is conducted by the beat search unit 136 fluctuates, in the example of the figure, centering on a beat interval d3. The optimum path (a list of nodes included in the optimum path) determined by the beat search unit 136 is output to the constant tempo decision unit 138, the beat re-search unit 140 for constant tempo, and the beat determination unit 142, respectively described in the following.

(2-3-4. Constant Tempo Decision Unit)

The constant tempo decision unit 138 decides whether the optimum path determined by the beat search unit 136 indicates a constant tempo with low variance of beat intervals (that is, the beat intervals assumed for respective nodes). More specifically, the constant tempo decision unit 138 first calculates the variance for a group of beat intervals at nodes included in the optimum path input from the beat search unit 136. Then, when the computed variance is less than a specific threshold value given in advance, the constant tempo decision unit 138 decides that the tempo is constant; and when the computed variance is more than the specific threshold value, the constant tempo decision unit 138 decides that the tempo is not constant.

Figure 18:
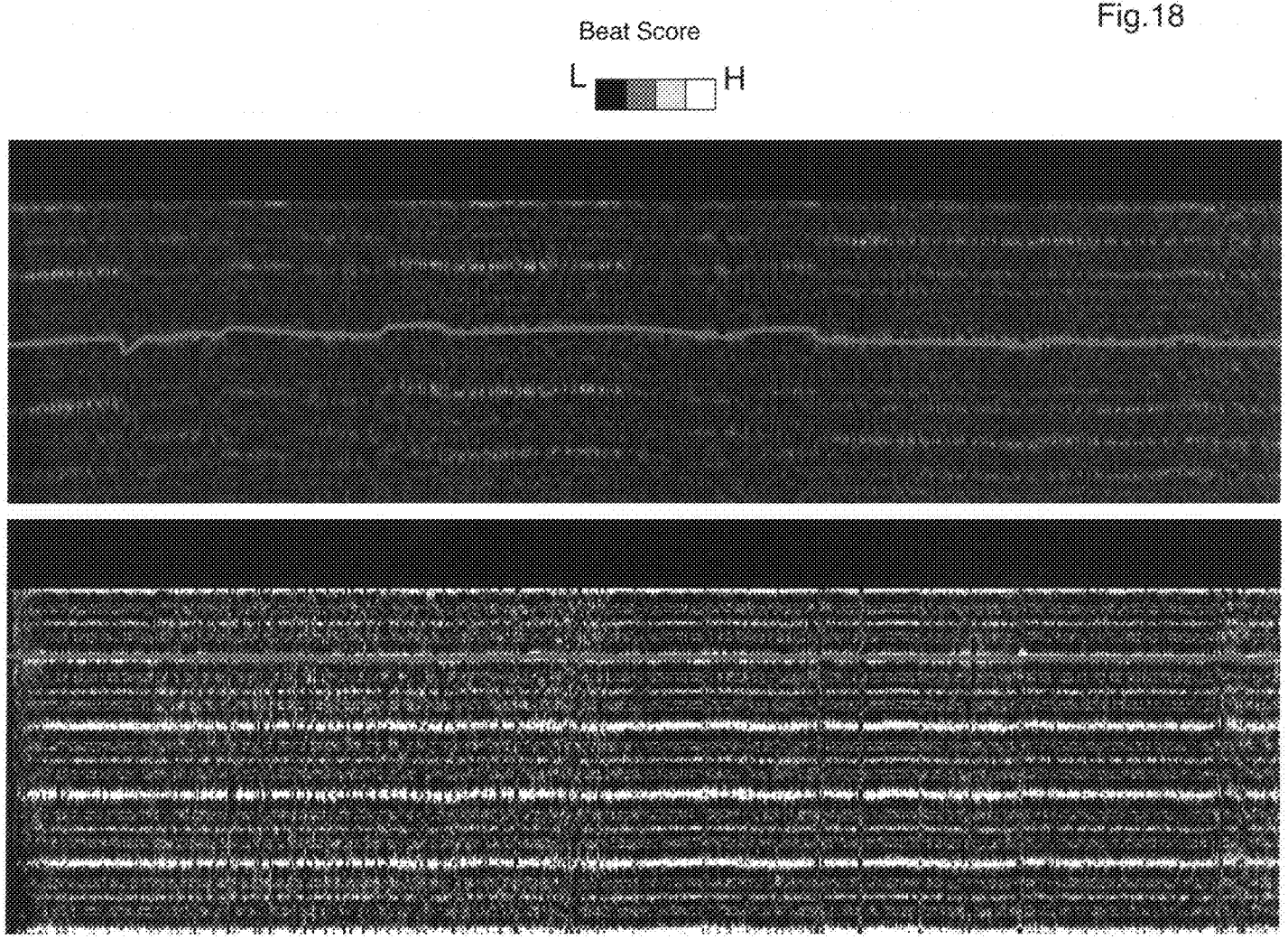
FIG. 18 is an explanatory diagram showing two examples of decision results of a constant tempo decision unit.

FIG. 18 is an explanatory diagram showing two examples of decision results of the constant tempo decision unit 138.

Referring to FIGS. 18 (18A), the beat interval for the onset positions in the optimum path outlined by the dotted-lines varies according to time. With such a path, the tempo may be decided as not constant as a result of a decision relating to a threshold value by the constant tempo decision unit 138. On the other hand, referring to FIGS. 18 (18B), the beat interval for the onset positions in the optimum path outlined by the dotted-lines is nearly constant through out the music piece. Such a path may be decided as constant as a result of the decision relating to a threshold value by the constant tempo decision unit 138. The result of the decision relating to a threshold value by the constant tempo decision unit 138 is output to the beat re-search unit 140 for constant tempo.

(2-3-5. Beat Re-Search Unit for Constant Tempo)

When the optimum path output from the beat search unit 136 is decided by the constant tempo decision unit 138 to indicate a constant tempo, the beat re-search unit 140 for constant tempo re-executes the path search, limiting the nodes which are the subjects of the search to those only around the most frequently appearing beat intervals.

Figure 19:
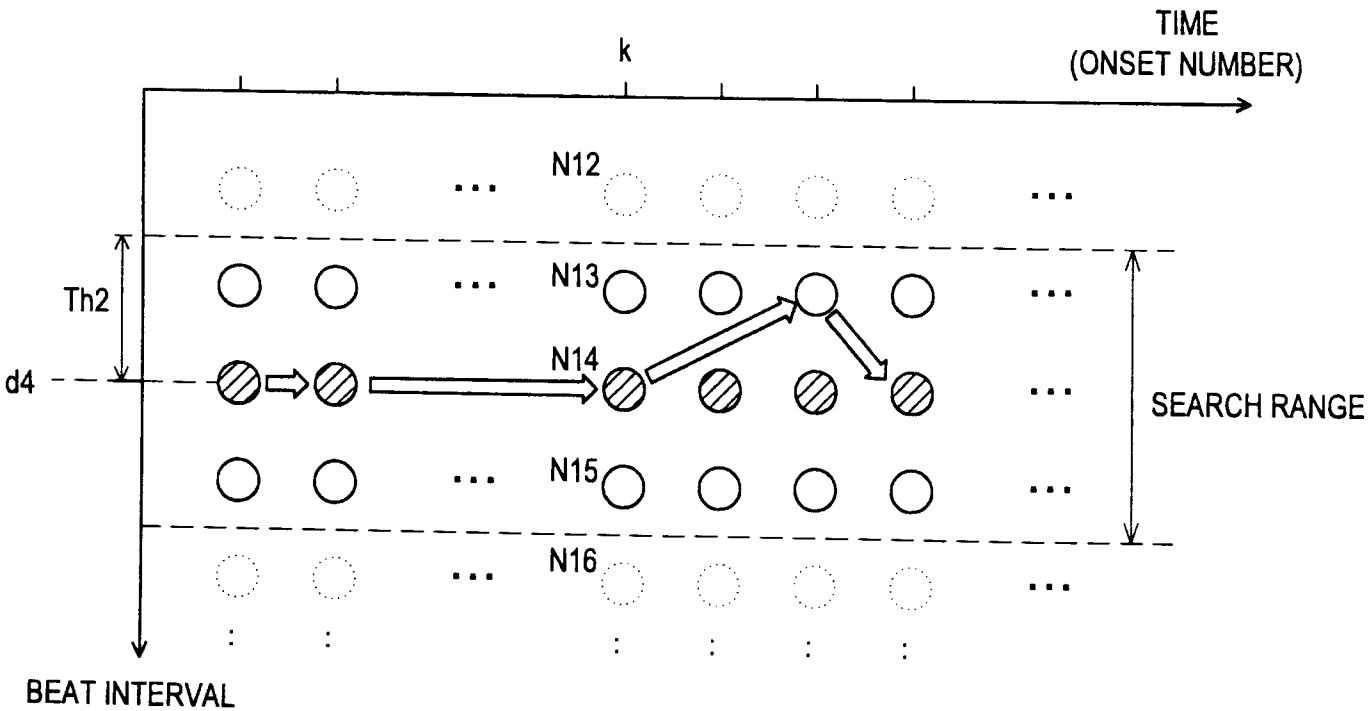
FIG. 19 is an explanatory diagram for describing a path re-search process by a beat re-search unit for constant tempo.

FIG. 19 is an explanatory diagram for describing a path re-search process by the beat re-search unit 140 for constant tempo.

FIG. 19 shows, as FIG. 13, a group of nodes along the time axis (onset number) with the beat interval as the observation sequence. Here, it is assumed that the mode of the beat intervals at the nodes included in the path determined to be the optimum path by the beat search unit 136 is d4, and that the path is decided by the constant tempo decision unit 138 to indicate a constant tempo. In this case, the beat re-search unit 140 for constant tempo searches again for a path with only the nodes for which the beat interval d satisfies $d4-Th2 \leqq d \leqq d4+Th2$ (Th2 is a specific threshold value given in advance) as the subjects of the search. In the example of FIG. 19, five nodes N12 to N16 are shown for the k-th onset, for example. Among these, the beat intervals at N13 to N15 are included within the search range ($d4-Th2 \leqq d \leqq d4+Th2$). In contrast, the beat intervals at N12 and N16 are not included in the above-described search range. Thus, with regard to the k-th onset, only the three nodes, N13 to N15, are made to be the subjects of the re-execution of the path search by the beat re-search unit 140 for constant tempo. Moreover, the flow of the re-search process for a path by the beat re-search unit 140 for constant tempo is similar to the path search process by the beat search unit 136 described using FIGS. 13 to 17, except for the range of the nodes which are to be the subjects of the search.

According to the path re-search process by the beat re-search unit 140 for constant tempo as described above, errors relating to the beat positions which might partially occur in a result of the path search can be reduced with respect to a music piece with a constant tempo. The optimum path redetermined by the beat re-search unit 140 for constant tempo is output to the beat determination unit 142.

98(2-3-6. Beat Determination Unit)

The beat determination unit 142 determines the beat positions included in the audio signal, based on the optimum path determined by the beat search unit 136 or the optimum path redetermined by the beat re-search unit 140 for constant tempo as well as on the beat interval at each node included in the path.

Figure 20:
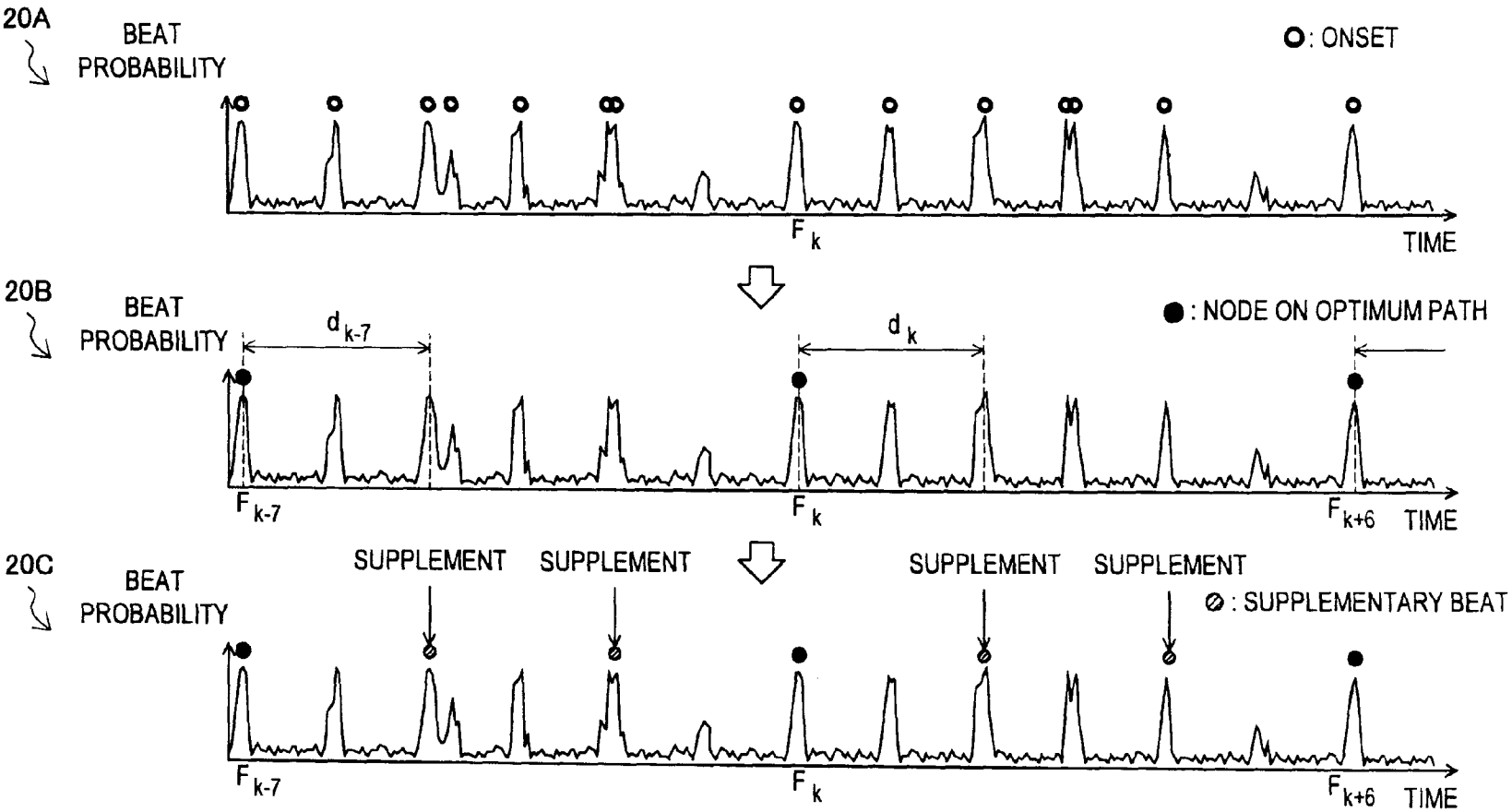
FIG. 20 is an explanatory diagram for describing a beat determination process by a beat determination unit.

FIG. 20 is an explanatory diagram for describing the beat determination process by the beat determination unit 142.

The example of the result of the onset detection by the onset detection unit 132 described using FIG. 9 is again shown in FIGS. 20 (20A). In this example, 14 onsets in the vicinity of the k-th onset that are detected by the onset detection unit 132 are shown.

In contrast, FIGS. 20 (20B) shows the onsets included in the optimum path determined by the beat search unit 136 or the beat re-search unit 140 for constant tempo. In the example of 20B, the k−7th onset, the k-th onset and the k+6th onset (frame numbers $F_{k-7}$, $F_k$, $F_{k+6}$), among the 14 onsets shown in 20A, are included in the optimum path. Furthermore, the beat interval at the k−7th onset (equivalent to the beat interval at the corresponding node) is $d_{k-7}$, and the beat interval at the k-th onset is $d_k$.

With respect to such onsets, first, the beat determination unit 142 takes the positions of the onsets included in the optimum path as the beat positions of the music piece. Then, the beat determination unit 142 furnishes supplementary beats between adjacent onsets included in the optimum path according to the beat interval at each onset.

Figure 21:
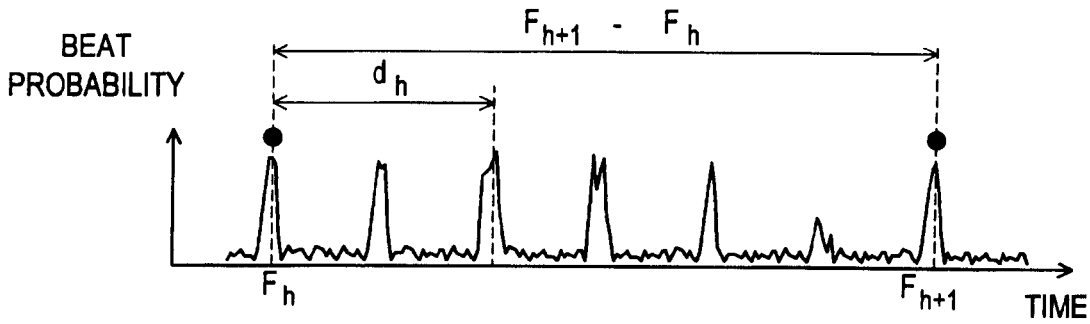
FIG. 21 is an explanatory diagram for describing a supplementary beat furnishing process by the beat determination unit.

The beat determination unit 142 first determines the number of supplementary beats to furnish the beats between onsets adjacent to each other on the optimum path. For example, as shown in FIG. 21, it is assumed that the positions of two adjacent onsets are $F_h$ and $F_{h+1}$, and the beat interval at the onset position $F_h$ is $d_h$. In this case, the number of supplementary beats $B_{fill}$ to be furnished between $F_h$ and $F_{h+1}$ by the beat determination unit 142 is given by the following Equation.

[Equation 2]

$$B_{fill} = \text{Round}\left(\frac{F_{h+1} - F_h}{d_h}\right) - 1 \tag{2}$$

Moreover, in Equation 2, Round(X) indicates that X is rounded off to the nearest whole number. That is, the number of supplementary beats to be furnished by the beat determination unit 142 will be a number obtained by rounding off, to the nearest whole number, the value obtained by dividing the interval between adjacent onsets by the beat interval, and then subtracting 1 from the obtained whole number in consideration of the fencepost problem.

Next, the beat determination unit 142 furnishes the supplementary beats, the number of which is determined in the above-described manner, between onsets adjacent to each other on the optimum path so that the beats are arranged at an equal interval. In the example of FIGS. 20 (20C), two supplementary beats are furnished between the k−7th onset and the k-th onset as well as between the k-th onset and the k+6th onset. It should be noted that the positions of supplementary beats provided by the beat determination unit 142 does not necessarily correspond with the positions of onsets detected by the onset detection unit 132. Accordingly, the beat determination unit 142 can appropriately determine the position of a beat without being affected by a sound produced locally off the beat position. Furthermore, the beat position can be appropriately grasped even in case there is a rest at the beat position and no sound is produced.

A list of the beat positions determined by the beat determination unit 142 (including the onsets on the optimum path and supplementary beats furnished by the beat determination unit 142) is output to the tempo revision unit 144.

(2-3-7. Tempo Revision Unit)

The tempo indicated by the beat positions determined by the beat determination unit 142 is possibly a constant multiple of the original tempo of the music piece, such as 2 times, 1/2 times, 3/2 times, 2/3 times or the like. The tempo revision unit 144 takes this possibility into consideration and reproduces the original tempo of the music piece by revising the erroneously grasped tempo which is a constant multiple.

Figure 22:
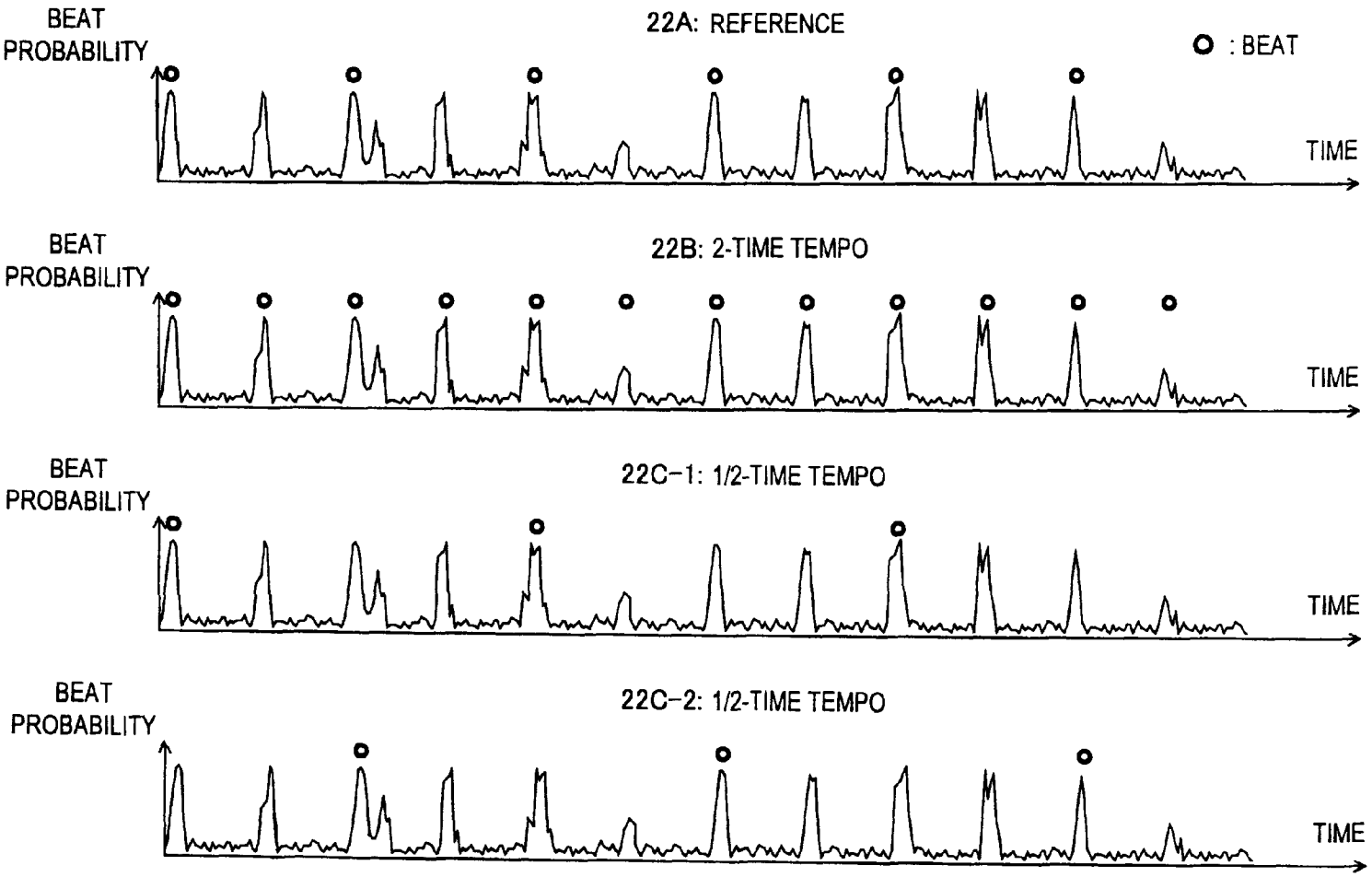
FIG. 22 is an explanatory diagram showing examples of tempos which are in constant multiple relationships.

FIG. 22 is an explanatory diagram showing an example of a pattern of the beat positions for each of three types of tempos which are in constant multiple relationships.

Referring to FIG. 22, 6 beats are detected (22A) in the time range shown in the figure. In contrast, in 22B, 12 beats are detected in the same time range. That is, the beat positions of 22B indicate a 2-time tempo with the beat positions of 22A as the reference.

On the other hand, in 22C-1, 3 beats are included in the same time range. That is, the beat positions of 22C-1 indicate a 1/2-time tempo with the beat positions of 22A as the reference. Also, in 22C-2, as with 22C-1, 3 beats are included in the same time range, and thus a 1/2-time tempo is indicated with the beat positions of 22A as the reference. However, 22C-1 and 22C-2 differ from each other by the beat positions which will be left to remain at the time of changing the tempo from the reference tempo.

The revision of tempo by the tempo revision unit 144 is performed by the following procedures (1) to (3), for example.

(1) Determination of Estimated Tempo estimated based on Waveform (2) Determination of Optimum Basic Multiplier among a Plurality of Multipliers (3) Repetition of (2) until Basic Multiplier is 1

(1) Determination of Estimated Tempo Estimated Based on Waveform

First, the tempo revision unit 144 determines an estimated tempo which is estimated to be adequate from the sound features appearing in the waveform of the audio signal. For example, an estimated tempo discrimination formula obtained as a result of machine learning employing the learning algorithm disclosed in JP-A-2008-123011 can be used for the determination of the estimated tempo.

Figure 23:
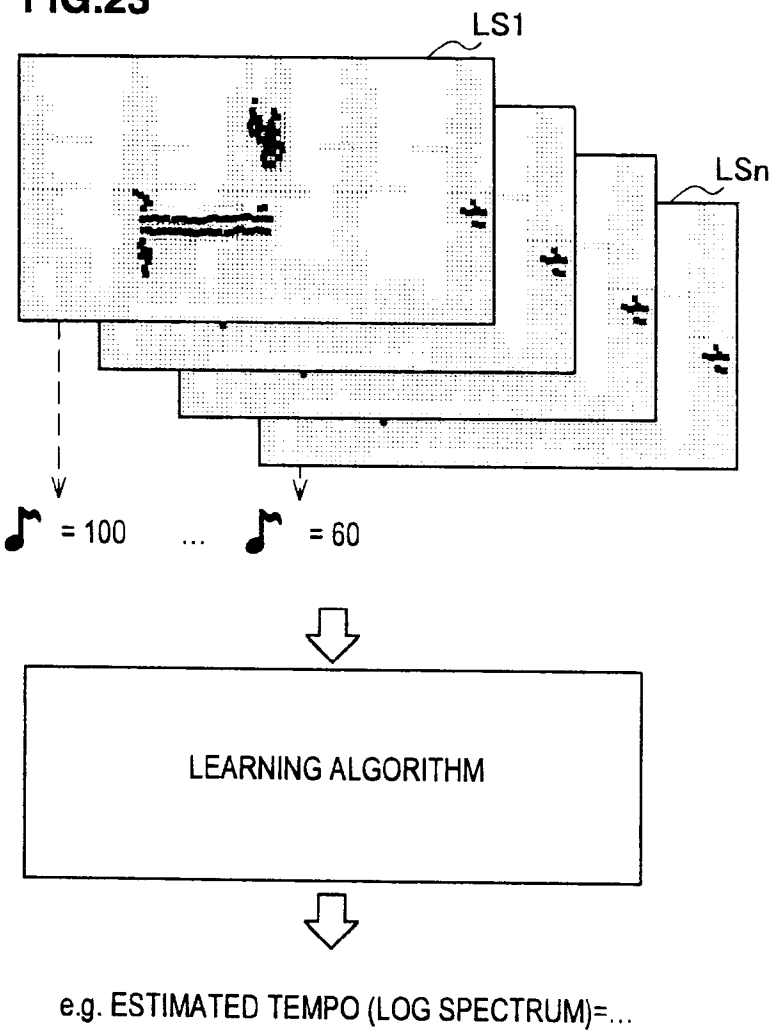
FIG. 23 is an explanatory diagram for describing a learning process for an estimated tempo discrimination formula.

The estimated tempo discrimination formula used by the tempo revision unit 144 employs the learning algorithm disclosed in JP-A-2008-123011 and is obtained by a learning process as shown in FIG. 23.

First, a plurality of log spectra which have been converted from the audio signals of music pieces are supplied as input data to the learning algorithm. For example, in FIG. 23, log spectra LS1 to LSn are supplied to the learning algorithm. Furthermore, tempos decided to be correct by a human being listening to the music pieces are input as teacher data to the learning algorithm. For example, in FIG. 23, a correct tempo (LS1:100, . . . , LSn:60) of each log spectrum is supplied to the learning algorithm. Based on a plurality of sets of such input data and teacher data, the estimated tempo discrimination formula for determining an estimated tempo from a log spectrum is obtained in advance by the above-described learning algorithm.

The tempo revision unit 144 determines the estimated tempo by applying the estimated tempo discrimination formula obtained in advance as described above to an audio signal input to the information processing apparatus 100.

(2) Determination of Optimum Basic Multiplier Among a Plurality of Multiplier

Next, the tempo revision unit 144 determines a basic multiplier, among a plurality of basic multipliers, according to which a revised tempo is closest to the original tempo of a music piece. Here, the basic multiplier is a multiplier which is a basic unit of a constant ratio used for the revision of tempo. For example, in the present embodiment, the basic multiplier is described to be any of seven types of multipliers, i.e. 1/3, 1/2, 2/3, 1, 3/2, 2 and 3. However, the basic multiplier is not limited to be such examples, and may be any of five types of multipliers, i.e. 1/3, 1/2, 1, 2 and 3, for example.

To determine the optimum basic multiplier, the tempo revision unit 144 first calculates, for each of the above-described basic multipliers, an average beat probability after revising the beat positions according to the multiplier (in case of the basic multiplier being 1, an average beat probability is calculated for a case where the beat positions are not revised).

Figure 24:
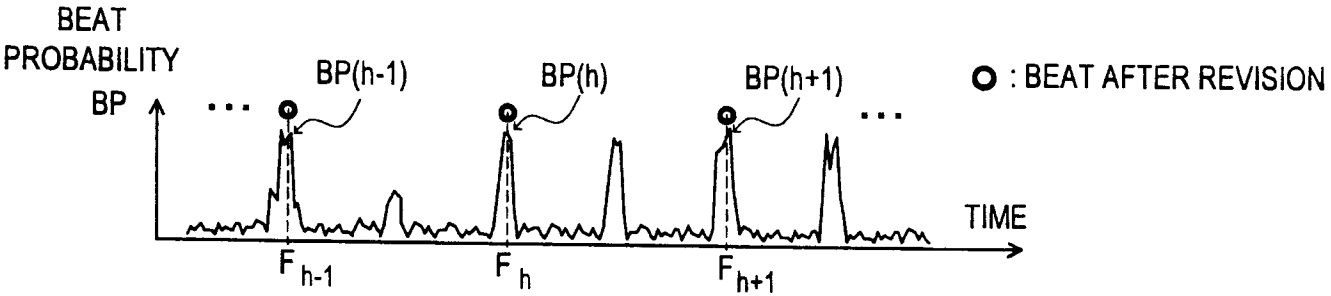
FIG. 24 is an explanatory diagram for describing an average beat probability for each multiplier.

FIG. 24 is an explanatory diagram for describing the average beat probability calculated by the tempo revision unit 144 for each multiplier.

Referring to FIG. 24, as the lower part of FIG. 5, the beat probability computed by the beat probability computation unit 120 is shown with a polygonal line on the time axis. Also, frame numbers $F_{h-1}$, $F_h$ and $F_{h+1}$ of three beats revised according to any of the multipliers are shown on the horizontal axis. Here, when the beat probability at the frame number $F_h$ is BP(h), an average beat probability $BP_{AVG}(r)$ of a group F(r) of the beat positions revised according to a multiplier r is given by the following equation.

[Equation 3]

$$BP_{AVG}(r) = \frac{\sum_{F(h)\in F(r)} BP(h)}{m(r)} \tag{3}$$

Here, in the above-described equation, m(r) is the number of pieces of frame numbers included in the group F(r).

Moreover, as described using FIGS. 22(C-1) and (C-2), there are two types of candidates for the beat positions in case the basic multiplier r is 1/2. In this case, the tempo revision unit 144 calculates the average beat probability $BP_{AVG}(r)$ for each of the two types of candidates for the beat positions, and adopts the beat positions with higher average beat probability $BP_{AVG}(r)$ as the beat positions revised according to the multiplier r=1/2. Similarly, in case the multiplier r is 1/3, there are three types of candidates for the beat positions. In this case, the tempo revision unit 144 calculates the average beat probability $BP_{AVG}(r)$ for each of the three types of candidates for the beat positions, and adopts the beat positions with the highest average beat probability $BP_{AVG}(r)$ as the beat positions revised according to the multiplier r=1/3.

Next, after calculating the average beat probability for each basic multiplier, the tempo revision unit 144 computes, based on the estimated tempo and the average beat probability, the likelihood of the revised tempo for each basic multiplier (hereinafter referred to as "tempo likelihood"). Here, the tempo likelihood can be the product of a tempo probability shown by a Gaussian distribution centering around the estimated tempo and the average beat probability.

Figure 25:
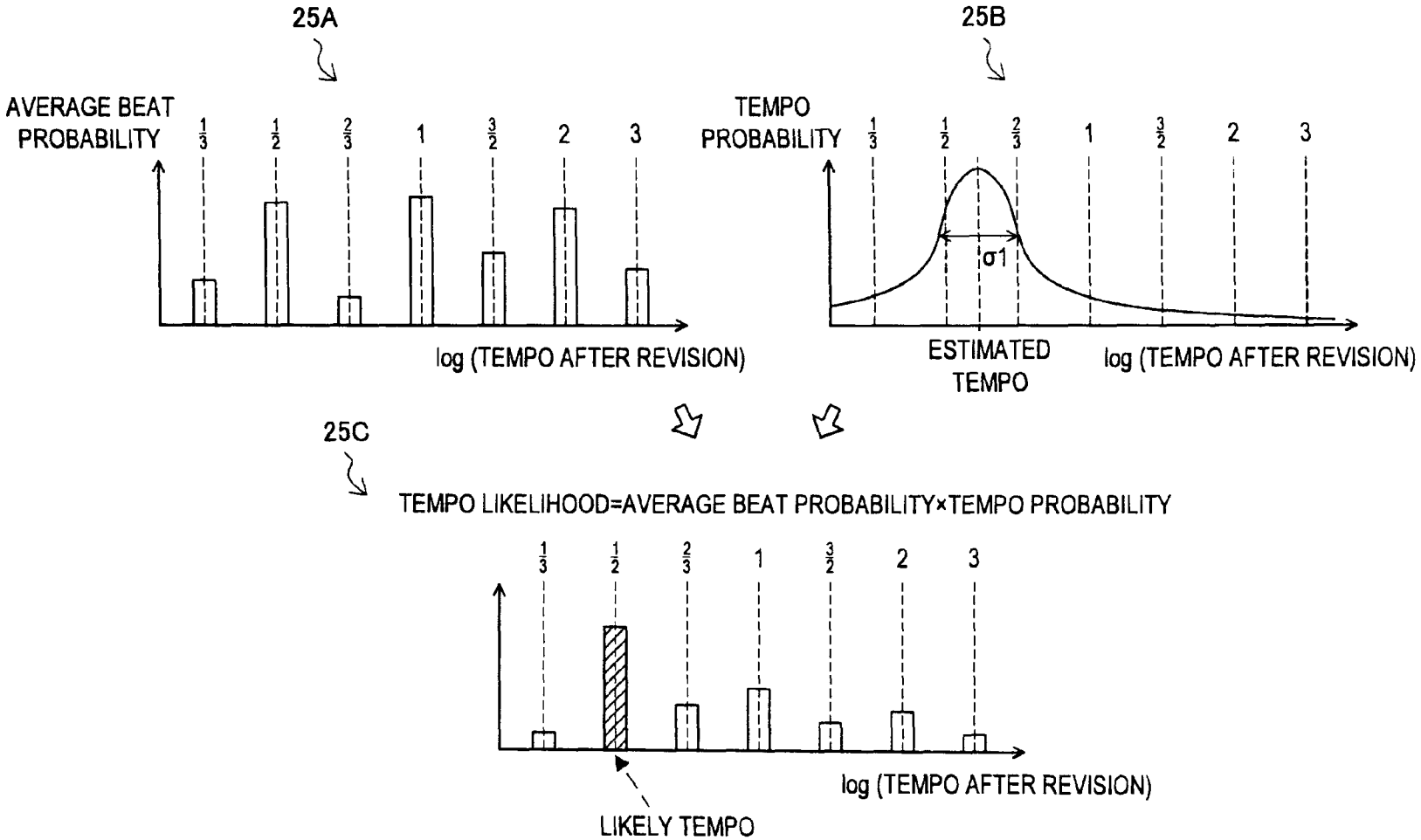
FIG. 25 is an explanatory diagram for describing a tempo likelihood computed by a tempo revision unit.

FIG. 25 is an explanatory diagram for describing the tempo likelihood computed by the tempo revision unit 144.

FIGS. 25 (25A) shows the average beat probabilities computed by the tempo revision unit 144 for the respective multipliers. Also, FIGS. 25 (25B) shows the tempo probability in the form of a Gaussian distribution that is determined by a specific variance σ1 given in advance and centering around the estimated tempo estimated by the tempo revision unit 144 based on the waveform of the audio signal. Moreover, the horizontal axes of 25A and 25B represent the logarithm of tempo after the beat positions have been revised according to each multiplier. The tempo revision unit 144 computes the tempo likelihood shown in FIGS. 25 (25C) for each of the basic multipliers by multiplying by each other the average beat probability and the tempo probability. That is, in the example of FIG. 25, although the average beat probabilities are almost the same for when the basic multiplier is 1 and when it is 1/2, the tempo revised to 1/2 times is closer to the estimated tempo (the tempo probability is high) and thus the computed tempo likelihood is higher for the tempo revised to 1/2 times. The tempo revision unit 144 computes the tempo likelihood in this manner, and determines the basic multiplier producing the highest tempo likelihood as the basic multiplier according to which the revised tempo is the closest to the original tempo of the music piece.

In this manner, by taking the tempo probability which can be obtained from the estimated tempo into account in the determination of a likely tempo, an appropriate tempo can be accurately determined among the candidates, which are tempos in constant multiple relationships and which are hard to discriminate from each other based on the local waveforms of the sound.

(3) Repetition of (2) Until Basic Multiplier is 1

Then, the tempo revision unit 144 repeats the calculation of the average beat probability and the computation of the tempo likelihood for each basic multiplier until the basic multiplier producing the highest tempo likelihood is 1. As a result, even if the tempo before the revision by the tempo revision unit 144 is 1/4 times, 1/6 times, 4 times, 6 times or the like of the original tempo of the music piece, the tempo can be revised by an appropriate multiplier for revision obtained by a combination of the basic multipliers (for example, 1/2 times×1/2 times=1/4 times).

Figure 26:
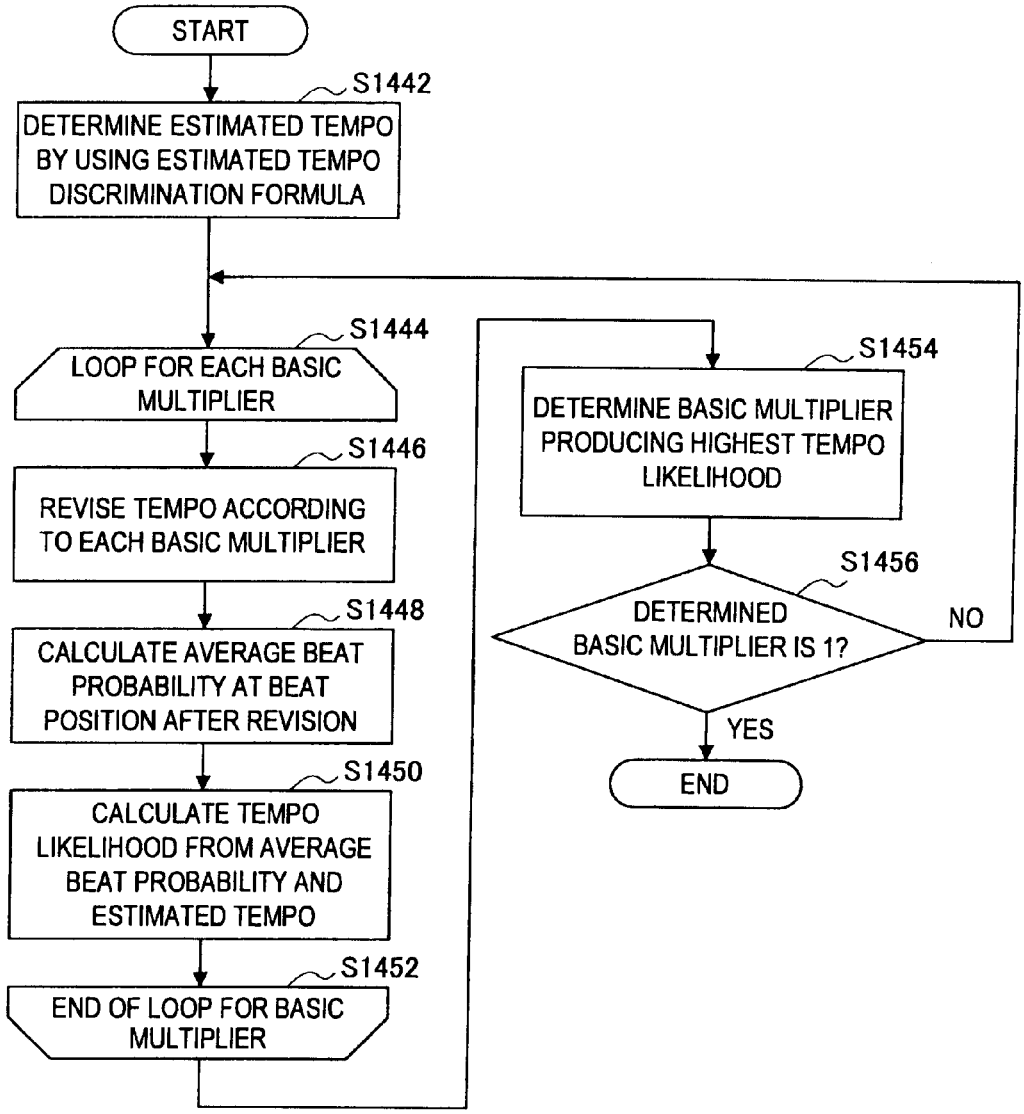
FIG. 26 is a flow chart showing an example of a tempo revision process flow.

FIG. 26 is a flow chart showing an example of revision process flow of the tempo revision unit 144.

Referring to FIG. 26, the tempo revision unit 144 first determines an estimated tempo from the audio signal by using an estimated tempo discrimination formula obtained in advance by learning (S1442). Next, the tempo revision unit 144 sequentially executes a loop for a plurality of basic multipliers (such as 1/3, 1/2, or the like) (S1444). Within the loop, the tempo revision unit 144 changes the beat positions according to each basic multiplier as described by using FIG. 22, and revises the tempo (S1446). Next, the tempo revision unit 144 calculates the average beat probability of the revised beat positions, as described by using FIG. 24 (S1448). Next, the tempo revision unit 144 calculates the tempo likelihood for each basic multiplier as described by using FIG. 25, based on the average beat probability calculated at S1448 and the estimated tempo determined at S1442 (S1450). Then, when the loop is over for all the basic multipliers (S1452), the tempo revision unit 144 determines the basic multiplier producing the highest tempo likelihood (S1454). Furthermore, the tempo revision unit 144 decides whether the basic multiplier producing the highest tempo likelihood is 1 (S1456). If the basic multiplier producing the highest tempo likelihood is 1, the revision process by the tempo revision unit 144 is ended. On the other hand, when the basic multiplier producing the highest tempo likelihood is not 1, the process returns to S1444. Thereby, a revision of tempo according to any of the basic multipliers is again conducted based on the tempo (beat positions) revised according to the basic multiplier producing the highest tempo likelihood.

After the processing by the onset detection unit 132 through the tempo revision unit 144 described above, the beat analysis process by the beat analysis unit 130 is ended. The beat positions detected as a result of the analysis by the beat analysis unit 130 are output to the structure analysis unit 150 and the chord probability computation unit 160 described later.

(2-4. Structure Analysis Unit)

The structure analysis unit 150 calculates the similarity probability of sound between beat sections included in the audio signal, based on the log spectrum of the audio signal input from the log spectrum conversion unit 110 and the beat positions input from the beat analysis unit 130.

Figure 27:
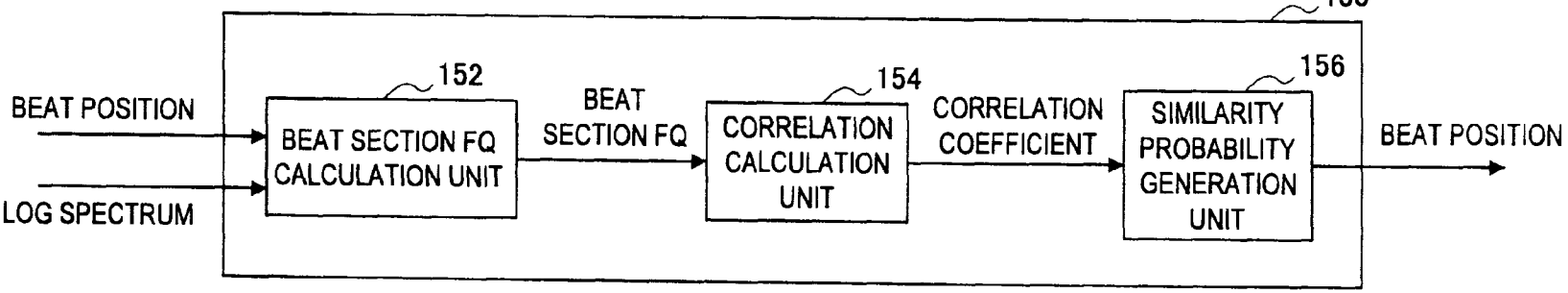
FIG. 27 is a block diagram showing a detailed configuration of a structure analysis unit.

FIG. 27 is a block diagram showing a detailed configuration of the structure analysis unit 150. Referring to FIG. 27, the structure analysis unit 150 includes a beat section feature quantity calculation unit 152, a correlation calculation unit 154, and a similarity probability generation unit 156.

(2-4-1. Beat Section Feature Quantity Calculation Unit)

The beat section feature quantity calculation unit 152 calculates, with respect to each beat detected by the beat analysis unit 130, a beat section feature quantity representing the feature of a partial log spectrum of a beat section from the beat to the next beat.

Figure 28:
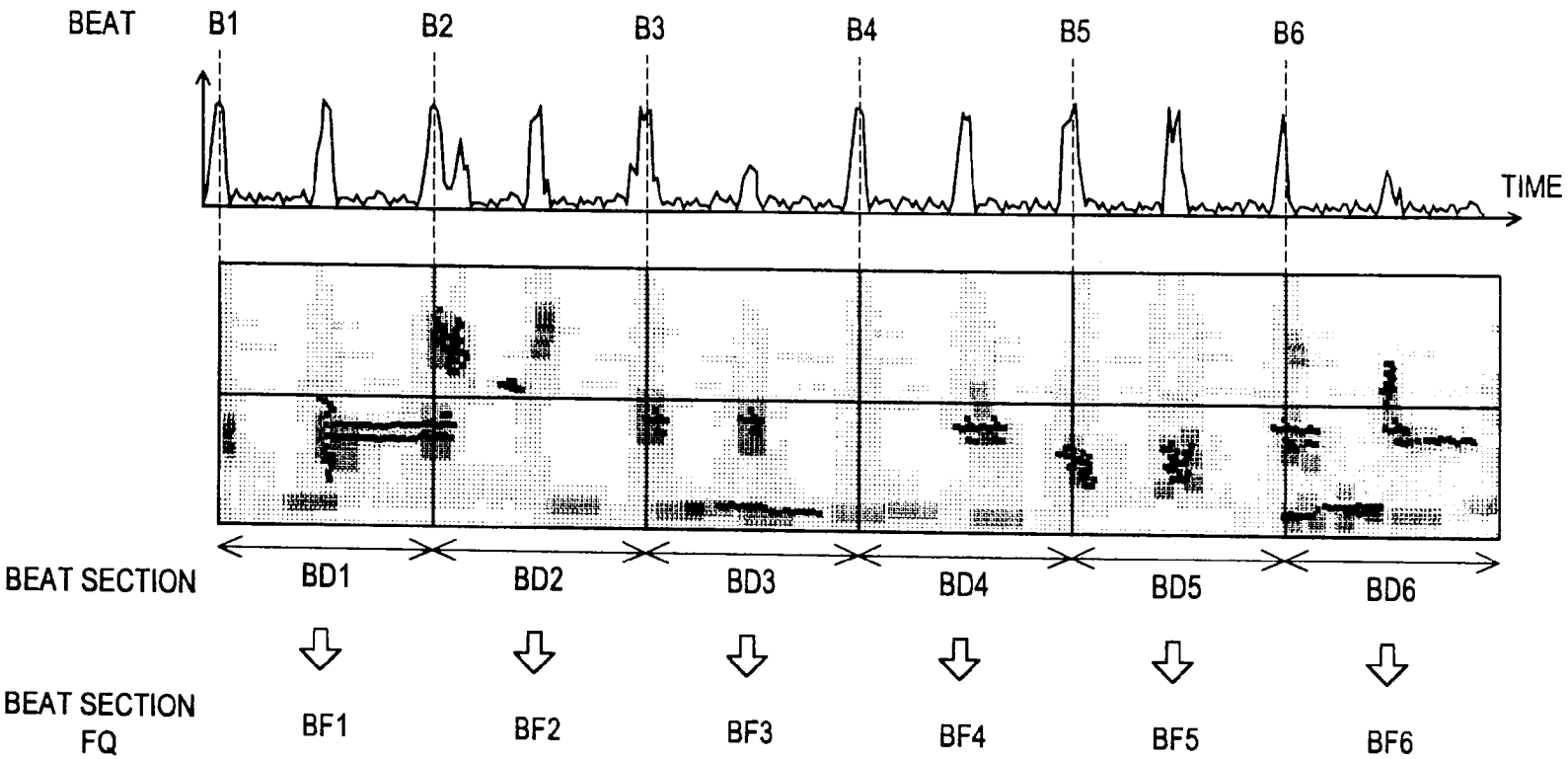
FIG. 28 is an explanatory diagram showing a relationship between a beat, a beat section, and a beat section feature quantity.

FIG. 28 is an explanatory diagram showing a relationship between a beat, a beat section, and a beat section feature quantity.

Six beats B1 to B6 detected by the beat analysis unit 130 are shown in the upper part of FIG. 28. The beat section is a section obtained by dividing the audio signal at the beat positions, and indicates a section from a beat to the next beat. That is, in the example of FIG. 28, a beat section BD1 is a section from the beat B1 to the beat B2; a beat section BD2 is a section from the beat B2 to the beat B3; and a beat section BD3 is a section from the beat B3 to the beat B4. Furthermore, the beat section feature quantity calculation unit 152 calculates each of beat section feature quantities BF1 to BF6 from a partial log spectrum corresponding to each of the beat sections BD1 to BD6.

Figure 29:
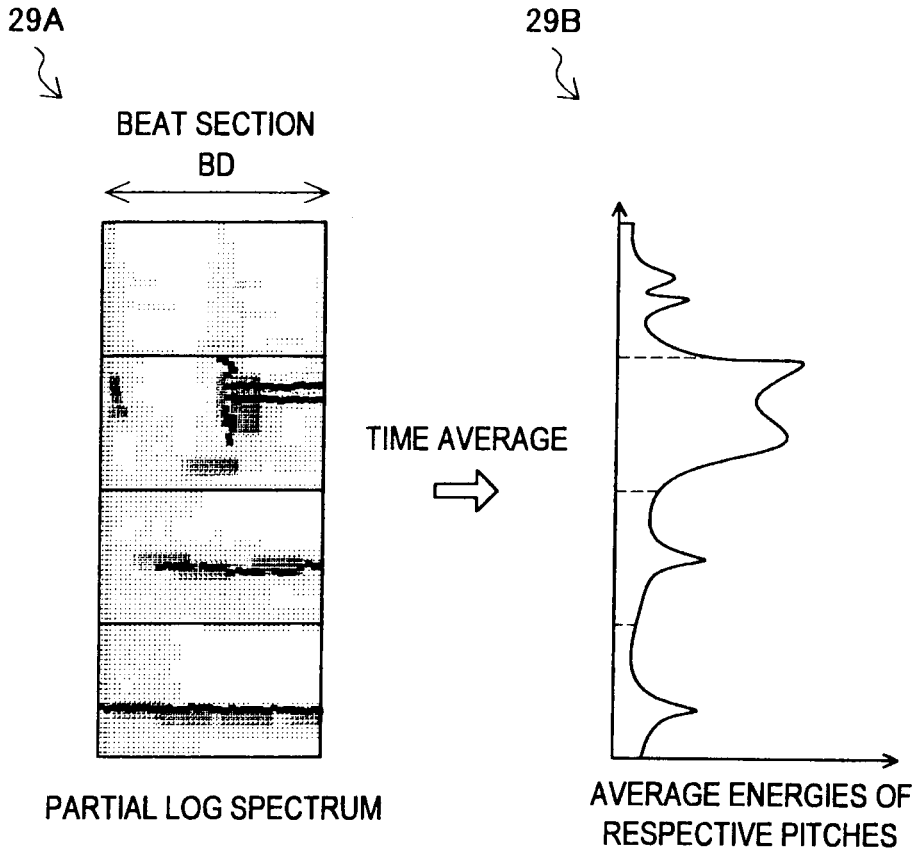
FIG. 29 is a first explanatory diagram for describing a calculation process for a beat section feature quantity.
Figure 30:
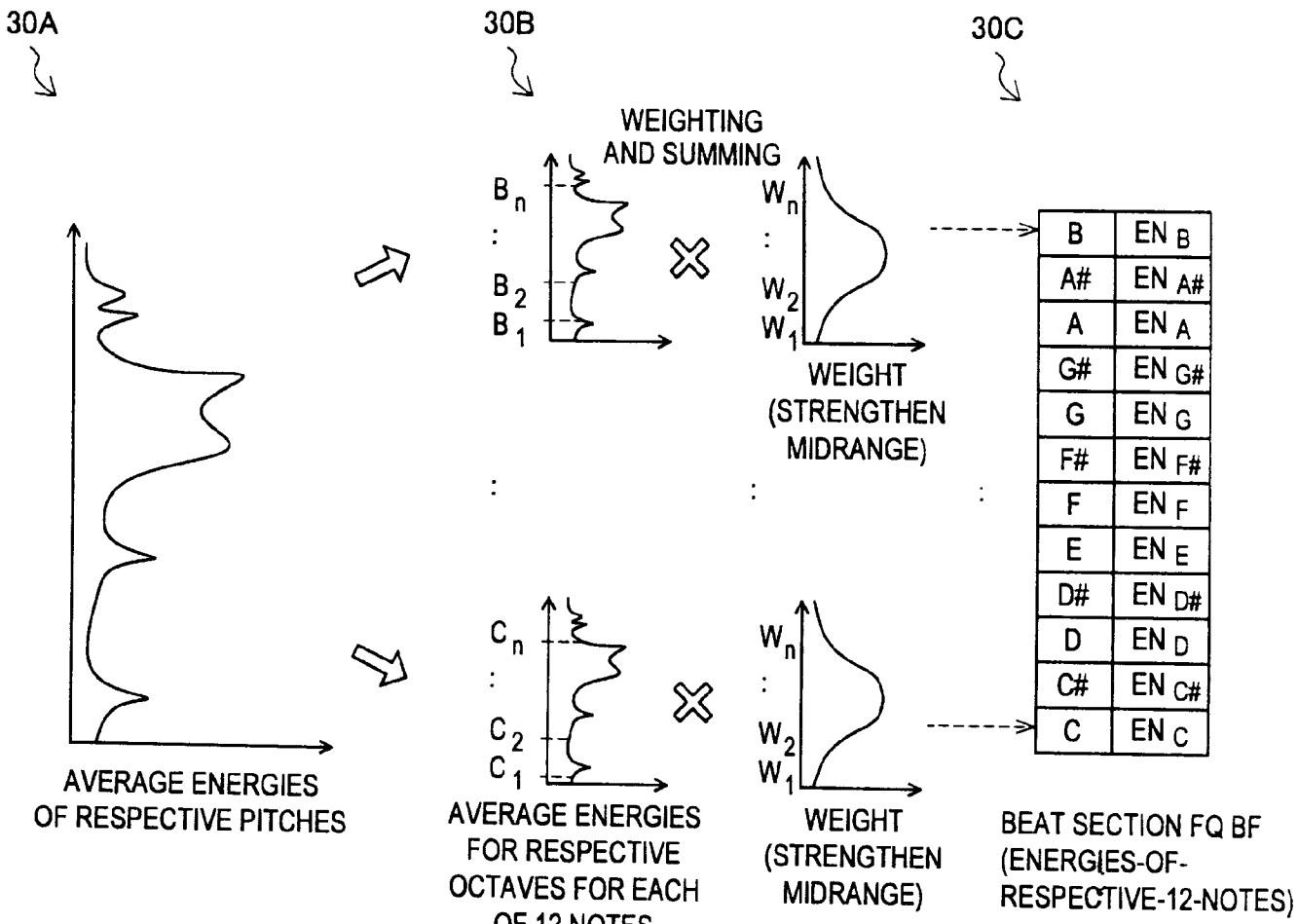
FIG. 30 is a second explanatory diagram for describing the calculation process for the beat section feature quantity.

FIGS. 29 and 30 are explanatory diagrams for describing a calculation process for the beat section feature quantity by the beat section feature quantity calculation unit 152.

In FIGS. 29 (29A), a partial log spectrum of a beat section BD corresponding to a beat is cut out by the beat section feature quantity calculation unit 152. The beat section feature quantity calculation unit 152 first computes average energies of respective pitches by time-averaging the energies for respective pitches (number of octaves×12 notes) of the partial log spectrum. FIGS. 29 (29B) shows the levels of the average energies of respective pitches computed by the beat section feature quantity calculation unit 152.

Next, referring to FIGS. 30 (30A), the same levels of the average energies of respective pitches as shown in FIGS. 29 (29B) are shown. The beat section feature quantity calculation unit 152 then weights and sums, for 12 notes, the values of the average energies of notes bearing the same name in different octaves over several octaves, and computes the energies of respective 12 notes. For example, in the example shown in FIGS. 30 (30B, 30C), the average energies of notes C ($C_1, C_2, \ldots, C_n$) over n octaves are weighted by using specific weights ($W_1, W_2, \ldots, W_n$) and summed together, and an energy value $En_C$ for the notes C is computed. Furthermore, in the same manner, the average energies of notes B ($B_1, B_2, \ldots, B_n$) over n octaves are weighted by using the specific weights ($W_1, W_2, \ldots, W_n$) and summed together, and an energy value $En_B$ for the notes B is computed. It is likewise for the ten notes (C# to A#) between the note C and the note B. As a result, a 12-dimensional vector having the energy values $EN_C, EN_{C\#}, \ldots, EN_B$ of respective 12 notes as the elements is generated. The beat section feature quantity calculation unit 152 calculates such energies-of-respective-12-notes (a 12-dimensional vector) for each beat as a beat section feature quantity BF, and outputs the same to the correlation calculation unit 154.

The values of weights $W_1, W_2, \ldots, W_n$ for respective octaves used for weighting and summing are preferably larger in the midrange where melody or chord of a common music piece is distinct. This enables the analysis of a music piece structure, reflecting more clearly the feature of the melody or chord.

(2-4-2. Correlation Calculation Unit)

The correlation calculation unit 154 calculates, for all the pairs of the beat sections included in the audio signal, the correlation coefficients between the beat sections by using the beat section feature quantity, i.e. the energies-of-respective-12-notes for each beat section, input from the beat section feature quantity calculation unit 152.

Figure 31:
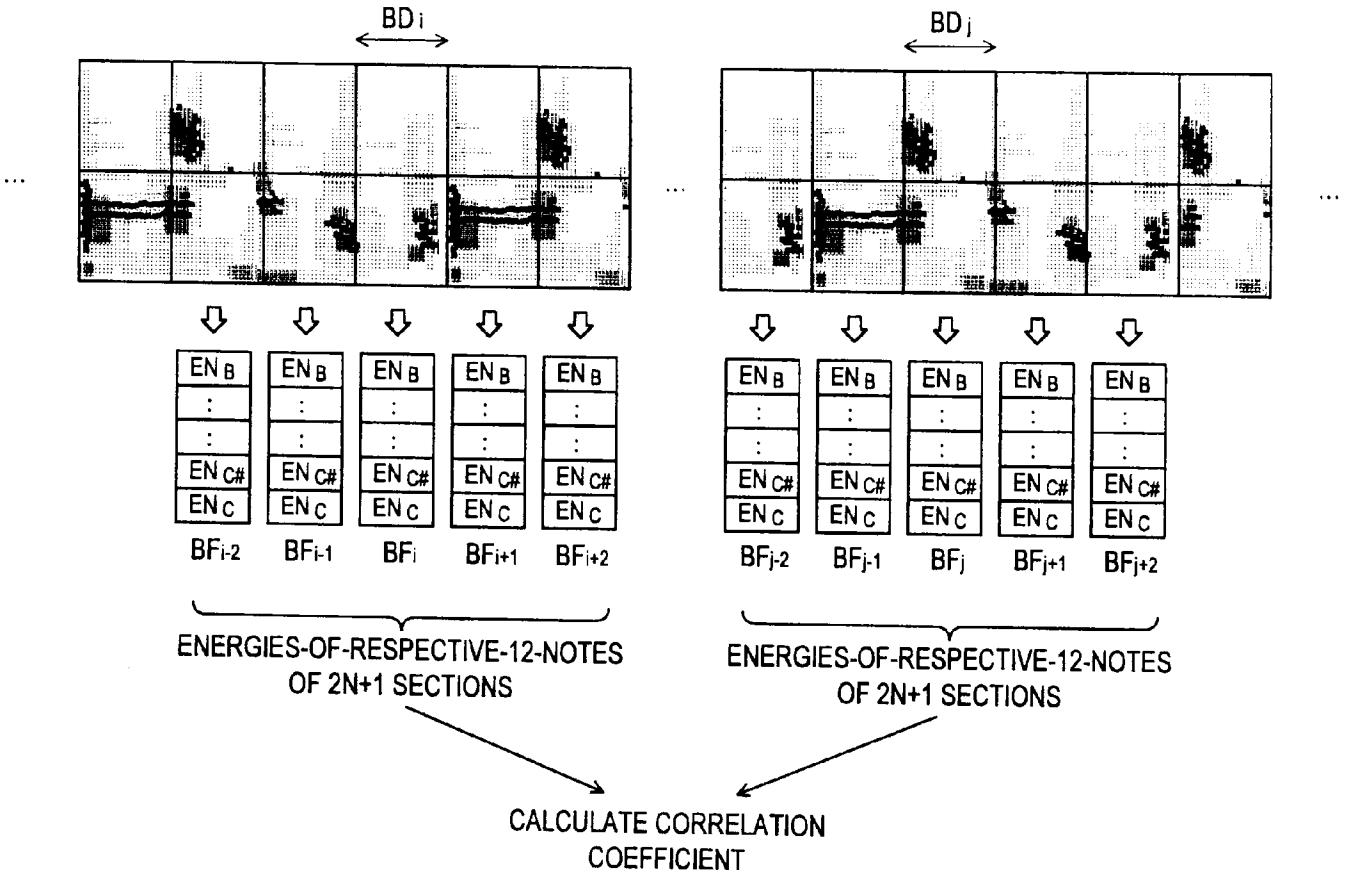
FIG. 31 is an explanatory diagram for describing a correlation coefficient calculation process.

FIG. 31 is an explanatory diagram for describing a correlation coefficient calculation process by the correlation calculation unit 154.

In FIG. 31, a first focused beat section $BD_i$ and a second focused beat section $BD_j$ are shown as an example of a pair of the beat sections, the beat sections being obtained by dividing the log spectrum, for which the correlation coefficient is to be calculated. To calculate the correlation coefficient between the two focused beat sections, the correlation calculation unit 154 first obtains the energies-of-respective-12-notes of the first focused beat section $BD_i$ and the preceding and following N sections (also referred to as "2N+1 sections") (in the example of FIG. 31, N=2, total 5 sections). Similarly, the correlation calculation unit 154 obtains the energies-of-respective-12-notes of the second focused beat section $BD_j$ and the preceding and following N sections. Then, the correlation calculation unit 154 calculates the correlation coefficient between the obtained energies-of-respective-12-notes of the first focused beat section $BD_i$ and the preceding and following N sections and the obtained energies-of-respective-12-notes of the second focused beat section $BD_j$ and the preceding and following N sections. The correlation calculation unit 154 calculates the correlation coefficient as described for all the pairs of a first focused beat section $BD_i$ and a second focused beat section $BD_j$, and outputs the calculation result to the similarity probability generation unit 156.

(2-4-3. Similarity Probability Generation Unit)

The similarity probability generation unit 156 converts the correlation coefficients between the beat sections input from the correlation calculation unit 154 to similarity probabilities indicating the degree of similarity between the sound contents of the beat sections by using a conversion curve generated in advance.

Figure 32:
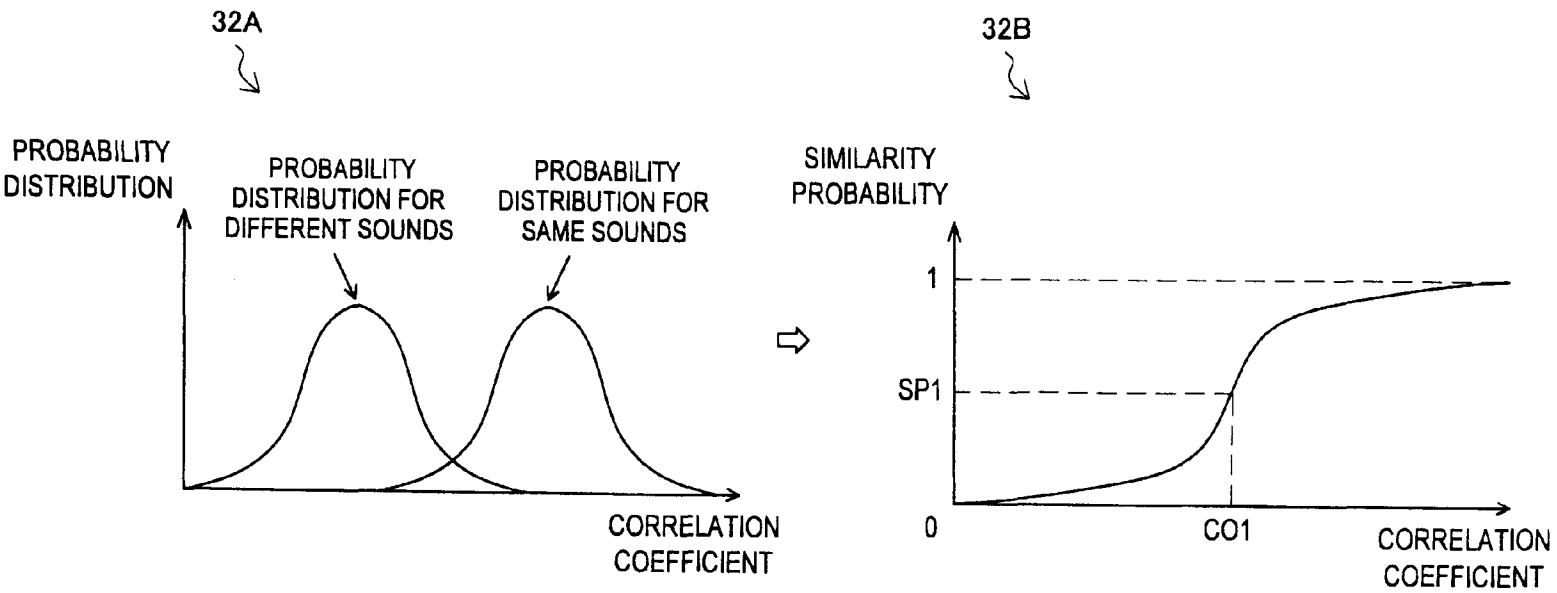
FIG. 32 is an explanatory diagram for describing an example of a conversion curve from a correlation coefficient to a similarity probability.

FIG. 32 is an explanatory diagram for describing an example of a conversion curve used at the time of converting the correlation coefficient to the similarity probability.

FIGS. 32 (32A) shows two probability distributions obtained in advance, namely a probability distribution of correlation coefficient between beat sections having the same sound contents and a probability distribution of correlation coefficient between beat sections having different sound contents. As can be seen from FIGS. 32 (32A), the probability that the sound contents are the same with each other is lower as the correlation coefficient is lower, and the probability that the sound contents are the same with each other is higher as the correlation coefficient is higher. Thus, a conversion curve as shown in FIGS. 32 (32B) for deriving the similarity probability between the beat sections from the correlation coefficient can be generated in advance. The similarity probability generation unit 156 converts a correlation coefficient CO1 input from the correlation calculation unit 154, for example, to a similarity probability SP1 by using the conversion curve generated in advance in this manner.

Figure 33:
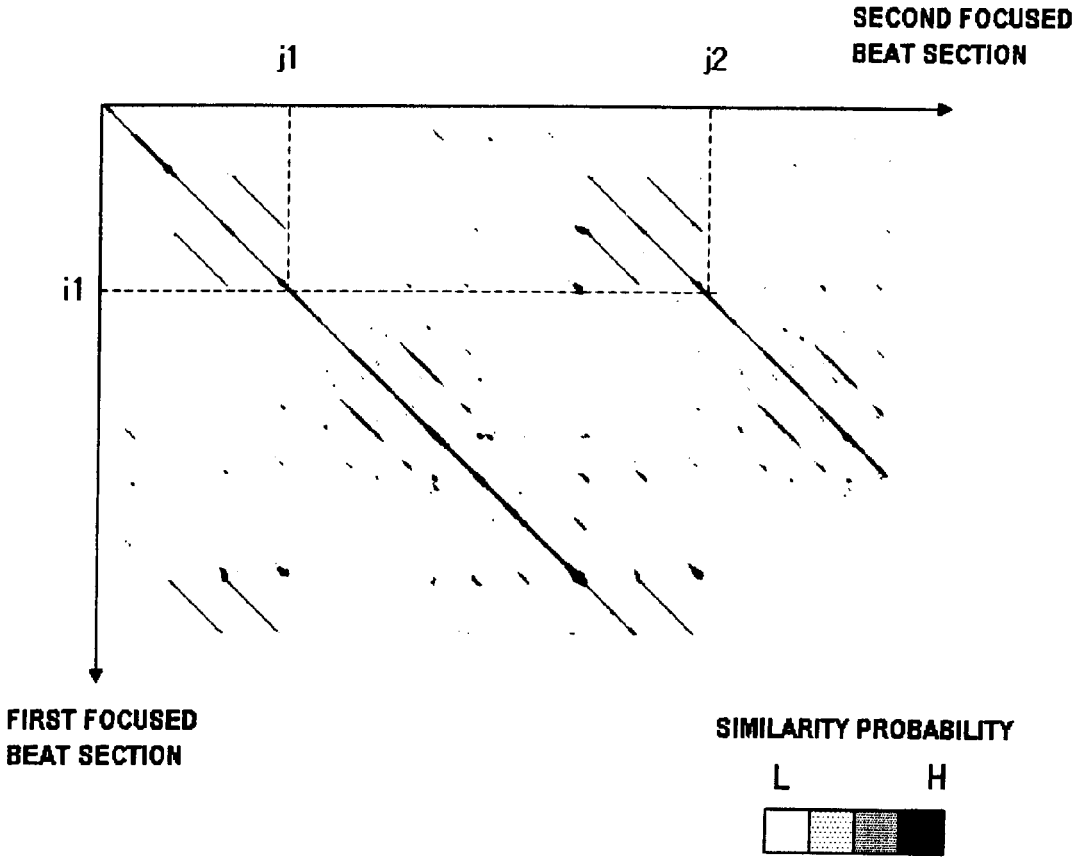
FIG. 33 is an explanatory diagram visualizing an example of the similarity probability between the beat sections.

FIG. 33 is an explanatory diagram visualizing, as an example, the similarity probability between the beat sections computed by the structure analysis unit 150.

The vertical axis of FIG. 33 corresponds to a position in the first focused beat section, and the horizontal axis corresponds to a position in the second focused beat section. Furthermore, the intensity of colours plotted on the two-dimensional plane indicates the degree of similarity probabilities between the first focused beat section and the second focused beat section at the coordinate. For example, the similarity probability between a first focused beat section i1 and a second focused beat section j1, which is substantially the same beat section as the first focused beat section i1, naturally shows a high value, and shows that the beat sections have the same sound contents. When the part of the music piece being played reaches a second focused beat section j2, the similarity probability between the first focused beat section i1 and the second focused beat section j2 again shows a high value. That is, it can be seen that it is highly possible that the sound contents which are approximately the same as that of the first focused beat section i1 are being played in the second focused beat section j2. The similarity probabilities between the beat sections obtained by the structure analysis unit 150 in this manner are output to the bar detection unit 180 and the chord progression detection unit 190 described later.

Moreover, in the present embodiment, since the time averages of the energies in a beat section are used for the calculation of the beat section feature quantity, information relating a temporal change in the log spectrum in the beat section is not taken into consideration for the analysis of a music piece structure by the structure analysis unit 150. That is, even if the same melody is played in two beat sections, being temporally shifted from each other (due to the arrangement by a player, for example), the played contents can be decided to be the same as long as the shift occurs only within a beat section.

(2-5. Chord Probability Computation Unit)

The chord probability computation unit 160 computes, for each beat detected by the beat analysis unit 130, a chord probability indicating the probability of each chord being played in a beat section corresponding to each beat.

Moreover, the values of the chord probability computed by the chord probability computation unit 160 are temporary values used for a key detection process by the key detection unit 180 described later. The chord probability is recalculated by a chord probability calculation unit 196 of the chord progression detection unit 190 described later, with key probability for each beat section taken into consideration.

Figure 34:
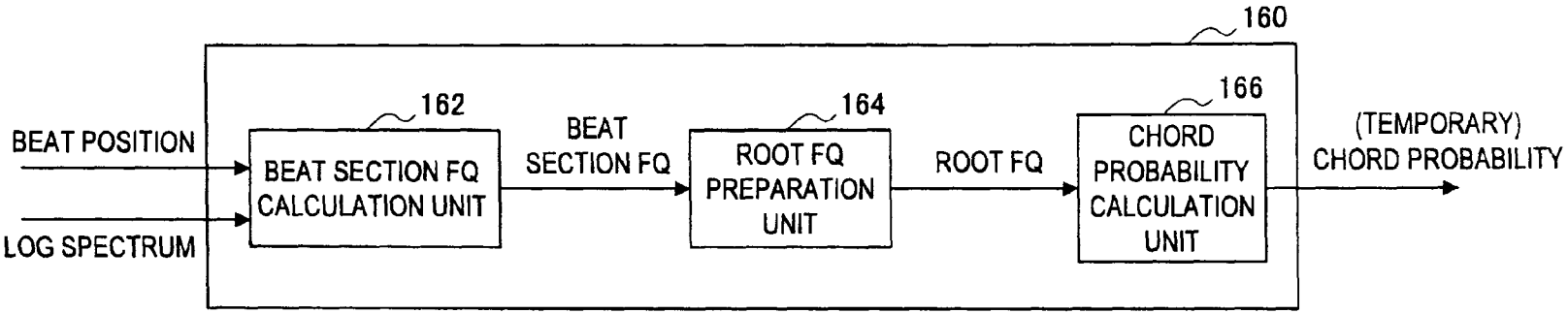
FIG. 34 is a block diagram showing a detailed configuration of a chord probability computation unit.

FIG. 34 is a block diagram showing a detailed configuration of the chord probability computation unit 160. Referring to FIG. 34, the chord probability computation unit 160 includes a beat section feature quantity calculation unit 162, a root feature quantity preparation unit 164, and a chord probability calculation unit 166.

(2-5-1. Beat Section Feature Quantity Calculation Unit)

As with the beat section feature quantity calculation unit 152 of the structure analysis unit 150, the beat section feature quantity calculation unit 162 calculates, for each beat detected by the beat analysis unit 130, the energies-of-respective-12-notes as the beat section feature quantity representing the feature of the audio signal in the beat section corresponding to each beat. The calculation process for the energies-of-respective-12-notes by the beat section feature quantity calculation unit 162 is the same as the process by the beat section feature quantity calculation unit 152 described by using FIGS. 28 to 30. However, the beat section feature quantity calculation unit 162 may use values different from the weights $W_1, W_2, \ldots, W_n$ shown in FIG. 30 as the values of weights used for weighting and summing together the average energies for respective octaves for each of 12 notes. The beat section feature quantity calculation unit 162 calculates the energies-of-respective-12-notes as the beat section feature quantity, and outputs the same to the root feature quantity preparation unit 164.

(2-5-2. Root Feature Quantity Preparation Unit)

The root feature quantity preparation unit 164 generates a root feature quantity used for the calculation of the chord probability for each beat section, from the energies-of-respective-12-notes input from the beat section feature quantity calculation unit 162.

Figure 35:
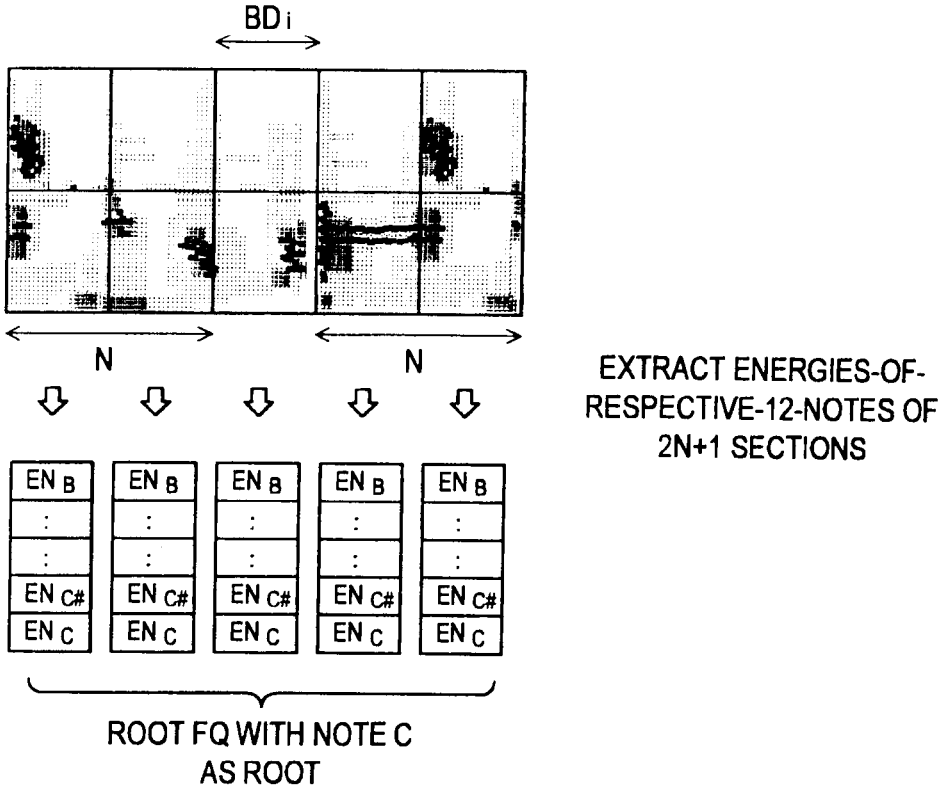
FIG. 35 is a first explanatory diagram for describing a root feature quantity generation process.
Figure 36:
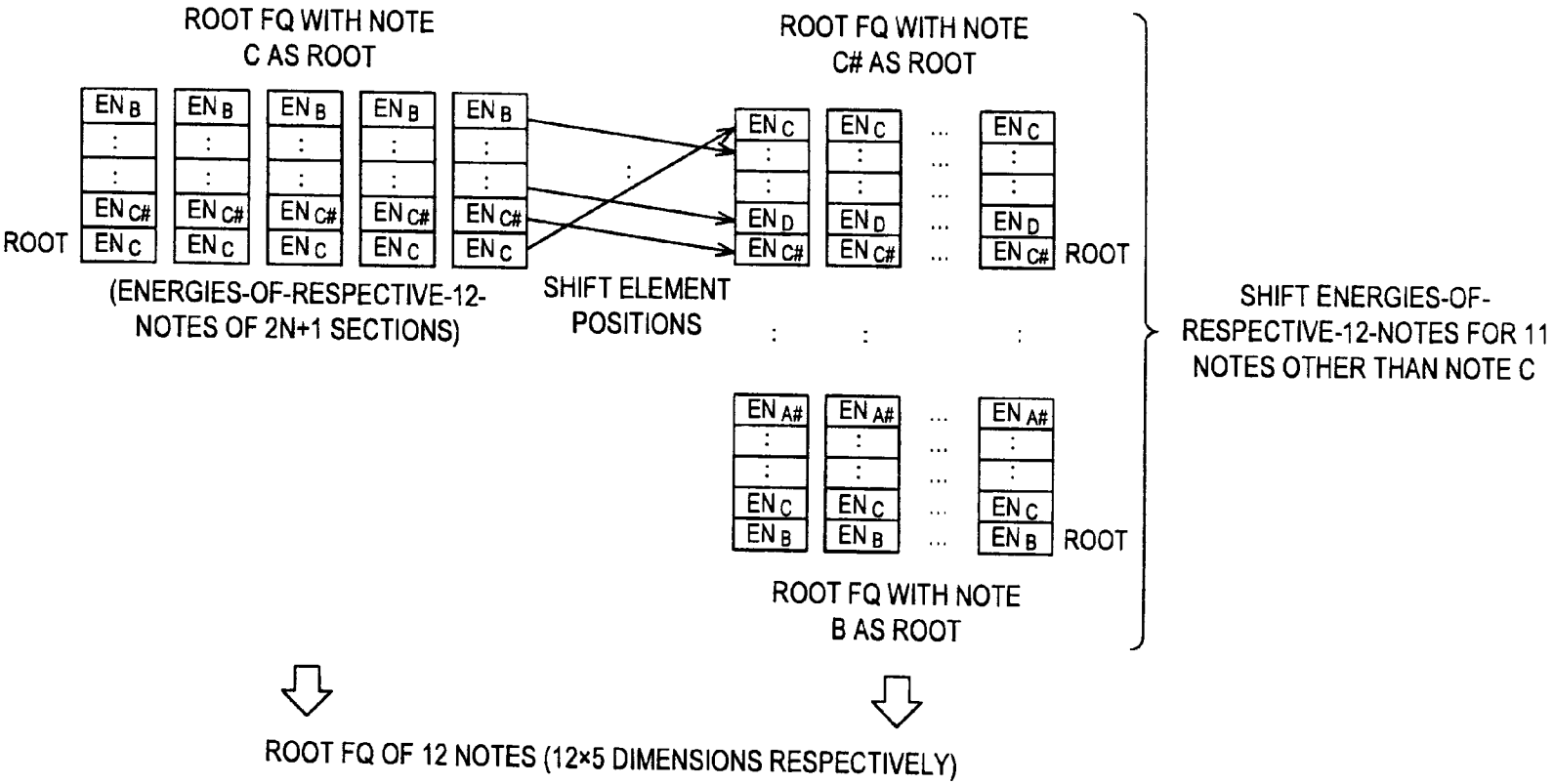
FIG. 36 is a second explanatory diagram for describing the root feature quantity generation process.

FIGS. 35 and 36 are explanatory diagrams for describing a root feature quantity generation process by the root feature quantity preparation unit 164.

The root feature quantity preparation unit 164 first extracts, for a focused beat section $BD_i$, the energies-of-respective-12-notes of the focused beat section $BD_i$ and the preceding and following N sections (refer to FIG. 35). The energies-of-respective-12-notes of the focused beat section $BD_i$ and the preceding and following N sections can be considered as a feature quantity with the note C as the root (fundamental note) of the chord. In the example of FIG. 35, since N is 2, a root feature quantity for five sections (12×5 dimensions) having the note C as the root is extracted. Moreover, the value of N here may be a value same as or different from the value of N in FIG. 31.

Next, the root feature quantity preparation unit 164 generates 11 separate root feature quantities, each for five sections and each having any of note C# to note B as the root, by shifting by a specific number the element positions of the 12 notes of the root feature quantity for five sections having the note C as the root (refer to FIG. 36). Moreover, the number of shifts by which the element position are shifted is 1 for a case where the note C# is the root, 2 for a case where the note D is the root, . . . , and 11 for a case where the note B is the root. As a result, the root feature quantities (12×5-dimensional, respectively), each having one of the 12 notes from the note C to the note B as the root, are generated for the respective 12 notes by the root feature quantity preparation unit 164.

The root feature quantity preparation unit 164 performs the root feature quantity generation process as described above for all the beat sections, and prepares a root feature quantity used for the computation of the chord probability for each section. Moreover, in the examples of FIGS. 35 and 36, a feature quantity prepared for one beat section is a 12×5×12-dimensional vector. The root feature quantities generated by the root feature quantity preparation unit 164 are output to the chord probability calculation unit 166.

(2-5-3. Chord Probability Calculation Unit)

The chord probability calculation unit 166 computes, for each beat section, a chord probability indicating the probability of each chord being played, by using the root feature quantities input from the root feature quantity preparation unit 164. "Each chord" here means each of the chords distinguished based on the root (C, C#, D, . . . ), the number of constituent notes (a triad, a 7th chord, a 9th chord), the tonality (major/minor), or the like, for example. A chord probability formula learnt in advance by a logistic regression analysis can be used for the computation of the chord probability, for example.

Figure 37:
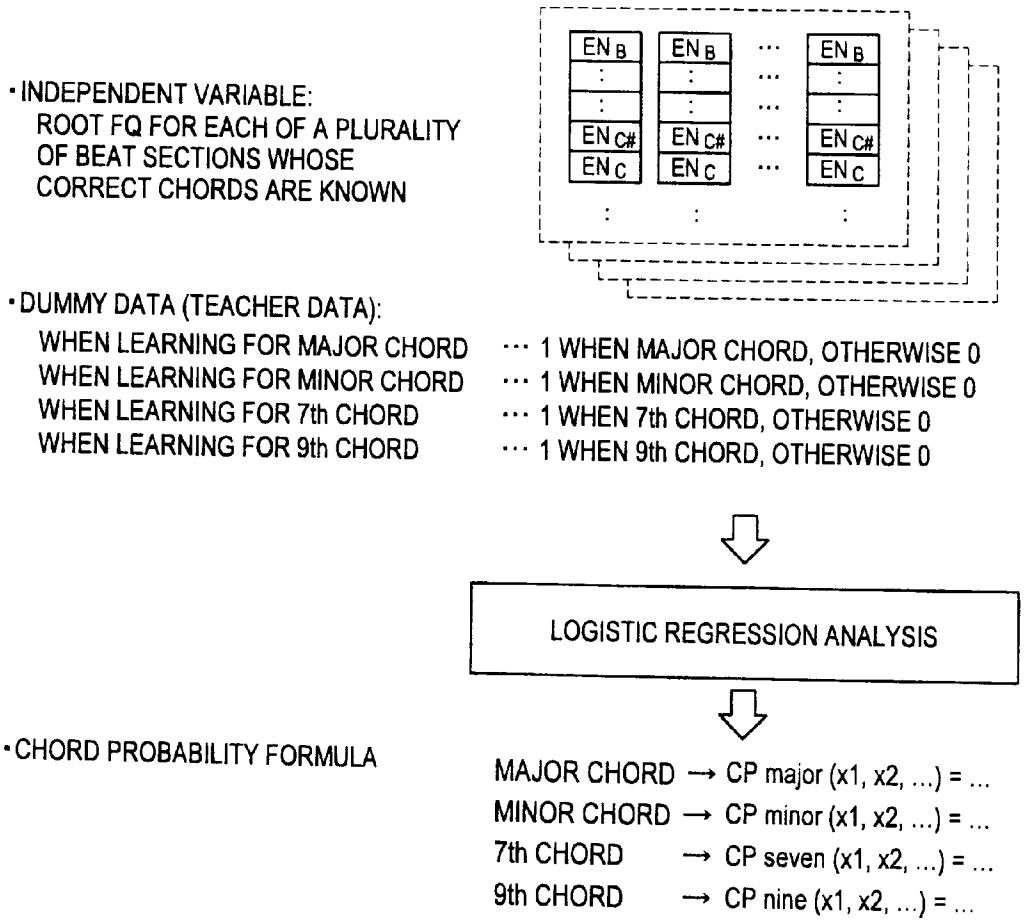
FIG. 37 is an explanatory diagram for describing a learning process for a chord probability formula.

FIG. 37 is an explanatory diagram for describing a learning process for the chord probability formula used for the calculation of the chord probability by the chord probability calculation unit 166.

The learning of the chord probability formula is performed for each type of chord. That is, a learning process described below is performed for each of a chord probability formula for a major chord, a chord probability formula for a minor chord, a chord probability formula for a 7th chord and a chord probability formula for a 9th chord, for example.

First, a plurality of root feature quantities (for example, 12×5×12-dimensional vectors described by using FIG. 36), each for a beat section whose correct chord is known, are provided as independent variables for the logistic regression analysis.

Furthermore, dummy data (teacher data) for predicting the generation probability by the logistic regression analysis is provided for each of the root feature quantity for each beat section. For example, when learning the chord probability formula for a major chord, the value of the dummy data will be a true value (1) if a known chord is a major chord, and a false value (0) for any other case. Also, when learning the chord probability formula for a minor chord, the value of the dummy data will be a true value (1) if a known chord is a minor chord, and a false value (0) for any other case. The same can be said for the 7th chord and the 9th chord.

By performing the logistic regression analysis for a sufficient number of the root feature quantities, each for a beat section, by using the independent variables and the dummy data as described above, chord probability formulae for computing respective types of chord probabilities from the root feature quantity for each beat section are obtained in advance.

Then, the chord probability calculation unit 166 applies the chord probability formulae obtained in advance to the root feature quantities input from the root feature quantity preparation unit 164, and sequentially computes the chord probabilities for the respective types of chords for respective beat sections.

Figure 38:
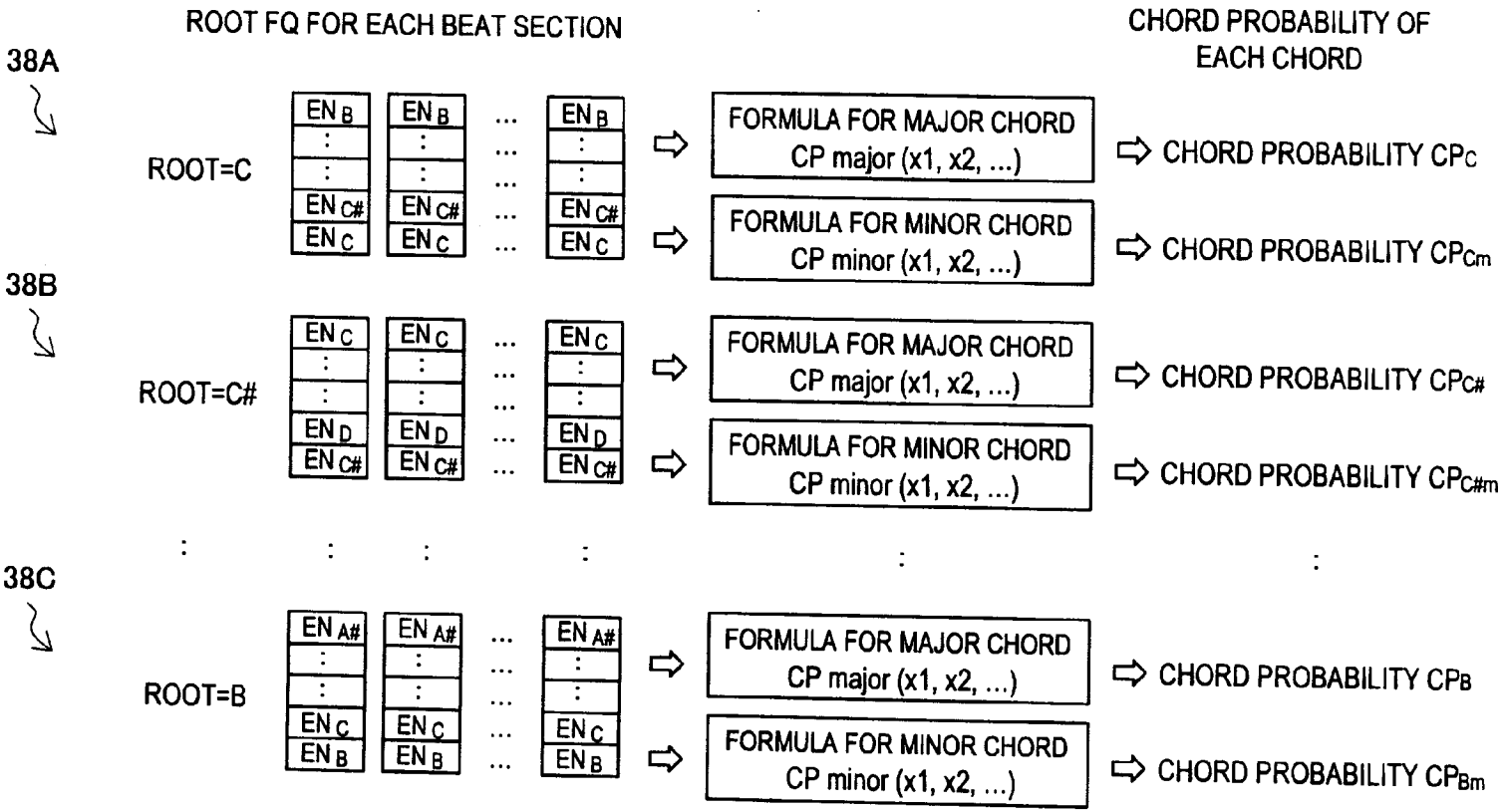
FIG. 38 is an explanatory diagram for describing a calculation process for the chord probability.

FIG. 38 is an explanatory diagram for describing the chord probability calculation process by the chord probability calculation unit 166.

Referring to FIGS. 38 (38A), a root feature quantity with the note C as the root, among the root feature quantity for each beat section, is shown. The chord probability calculation unit 166 applies the chord probability formula for a major chord obtained in advance by learning to the root feature quantity with the note C as the root, for example, and calculates a chord probability $CP_C$ of the chord being "C" for the beat section. Furthermore, the chord probability calculation unit 166 applies the chord probability formula for a minor chord to the root feature quantity with the note C as the root, and calculates a chord probability $CP_{Cm}$ of the chord being "Cm" for the beat section.

In a similar manner, the chord probability calculation unit 166 can apply the chord probability formula for a major chord and the chord probability formula for a minor chord to the root feature quantity with the note C# as the root, and can calculate a chord probability $CP_{C\#}$ for the chord "C#" and a chord probability $CP_{C\#m}$ for the chord "C#m" (38B). The same can be said for the calculation of a chord probability $CP_B$ for the chord "B" and a chord probability $CP_{Bm}$ for the chord "Bm" (38C).

Figure 39:
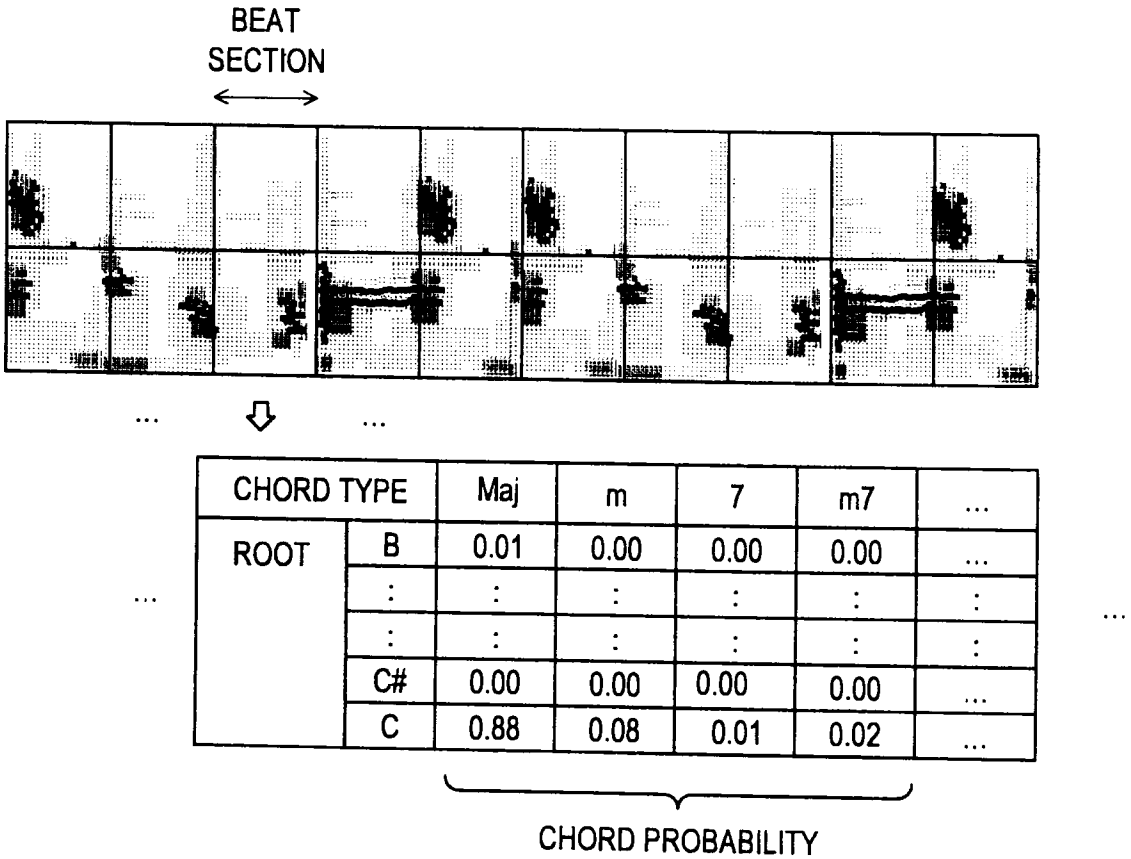
FIG. 39 is an explanatory diagram showing an example of the chord probability computed by a chord probability calculation unit.

FIG. 39 is an explanatory diagram showing an example of the chord probability computed by the chord probability calculation unit 166.

Referring to FIG. 39, the chord probability is calculated, for a certain beat section, for a variety of chords, such as "Maj (major)," "m (minor)," 7 (7th)," and "m7 minor 7th)," for each of the 12 notes from the note C to the note B. According to the example of FIG. 39, the chord probability $CP_C$ is 0.88, $CP_{Cm}$ is 0.08, $CP_{C7}$ is 0.01, $CP_{Cm7}$ is 0.02, and $CP_B$ is 0.01. Other chord probability values all indicate 0.

Moreover, after calculating the chord probability for a plurality of types of chords, the chord probability calculation unit 166 normalizes the probability values in such a way that the total of the computed probability values becomes 1 per beat section. The calculation and normalization processes by the chord probability calculation unit 166 as described above are repeated for all the beat sections included in the audio signal.

After the processing performed by the beat section feature quantity calculation unit 162 through the chord probability calculation unit 166 as described above, the chord probability computation process by the chord probability computation unit 160 is ended. The chord probability computed by the chord probability computation unit 160 is output to the key detection unit 170 described next.

(2-6. Key Detection Unit)

The key detection unit 170 detects the key (tonality/basic scale) for each beat section by using the chord probability computed by the chord probability computation unit 160 for each beat section. Also, the key detection unit 170 computes the key probability for each beat section in the process of key detection.

Figure 40:
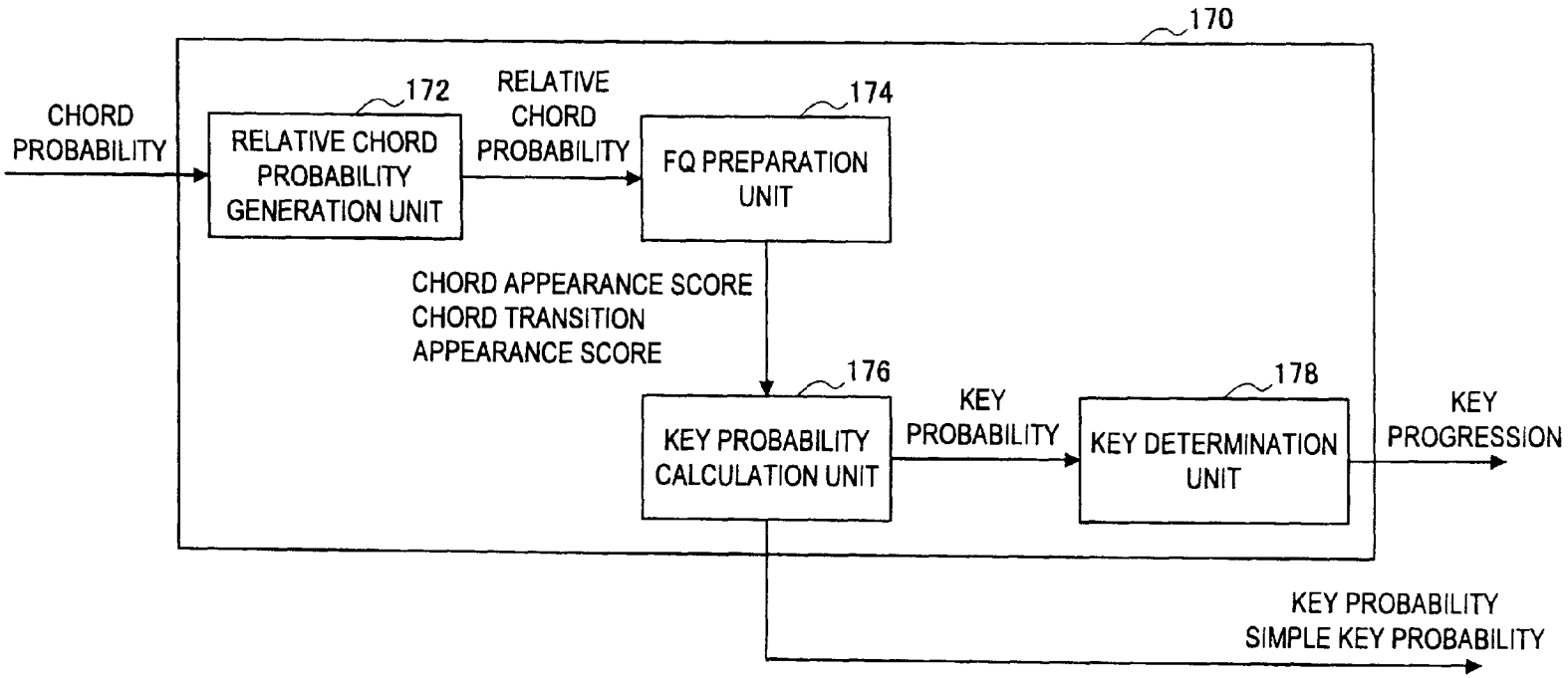
FIG. 40 is a block diagram showing a detailed configuration of a key detection unit.

FIG. 40 is a block diagram showing a detailed configuration of the key detection unit 170. Referring to FIG. 40, the key detection unit 170 includes a relative chord probability generation unit 172, a feature quantity preparation unit 174, a key probability calculation unit 176, and a key detection unit 178.

(2-6-1. Relative Chord Probability Generation Unit)

The relative chord probability generation unit 172 generates a relative chord probability used for the computation of the key probability for each beat section, from the chord probability for each beat section that is input from the chord probability computation unit 160.

Figure 41:
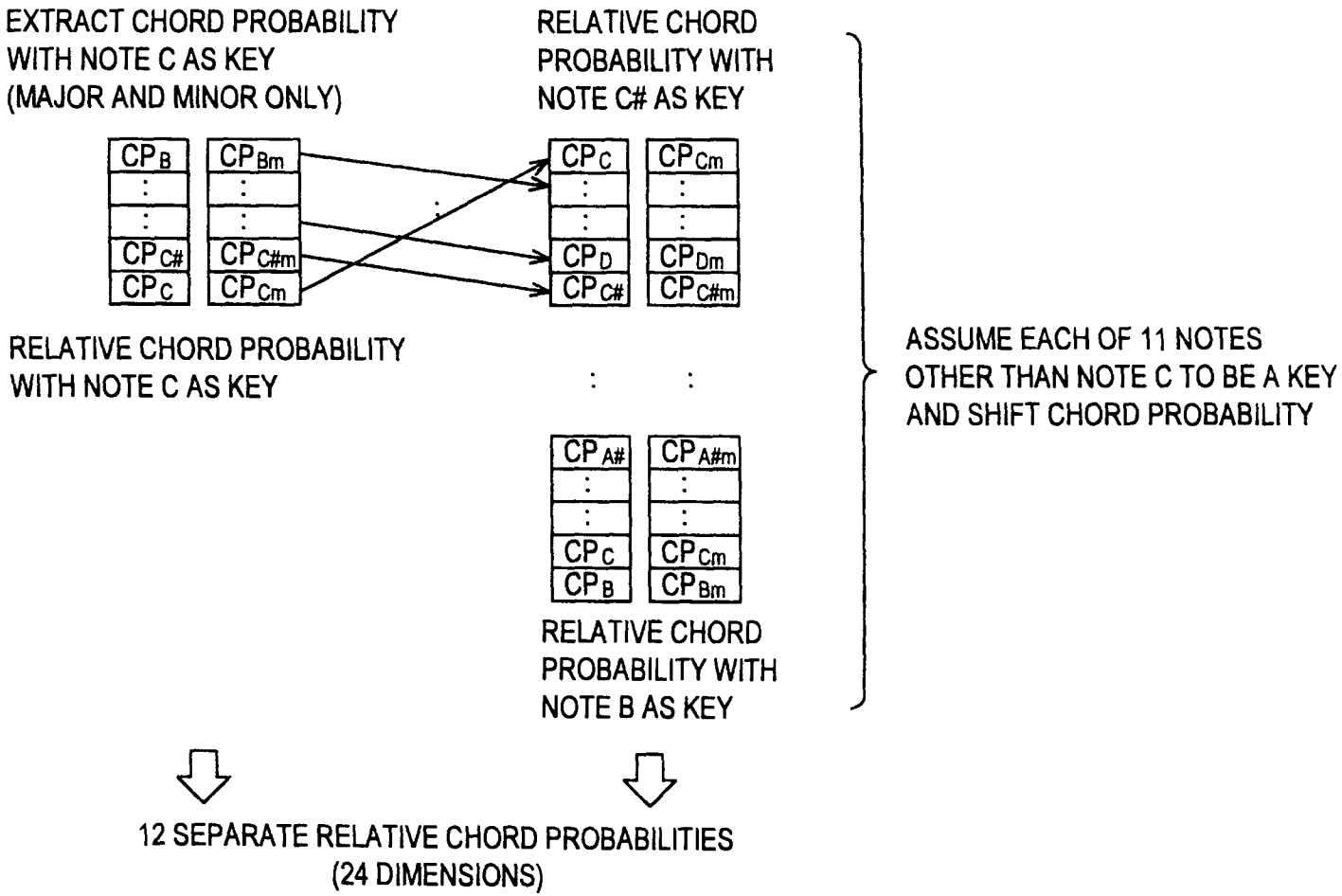
FIG. 41 is an explanatory diagram for describing a relative chord probability generation process.

FIG. 41 is an explanatory diagram for describing a relative chord probability generation process by the relative chord probability generation unit 172.

The relative chord probability generation unit 172 first extracts the chord probability values for the major chord and the minor chord from the chord probability for a certain focused beat section. The chord probability values extracted here form a vector of total 24 dimensions, i.e. 12 notes for the major chord and 12 notes for the minor chord. Hereunder, the 24-dimensional vector is treated as the relative chord probability with the note C assumed to be the key.

Next, the relative chord probability generation unit 172 generates 11 separate relative chord probabilities by shifting, by a specific number, the element positions of the 12 notes of the extracted chord probability values for the major chord and the minor chord. Moreover, the number of shifts by which the element positions are shifted is the same as the number of shifts at the time of generation of the root feature quantities as described using FIG. 36. As a result, 12 separate relative chord probabilities, each assuming one of the 12 notes from the note C to the note B as the key, are generated by the relative chord probability generation unit 172.

The relative chord probability generation unit 172 performs the relative chord probability generation process as described for all the beat sections, and outputs the generated relative chord probabilities to the feature quantity preparation unit 174.

(2-6-2. Feature Quantity Preparation Unit)

The feature quantity preparation unit 174 generates, as a feature quantity used for the computation of the key probability for each beat section, a chord appearance score and a chord transition appearance score for each beat section from the relative chord probability input from the relative chord probability generation unit 172.

Figure 42:
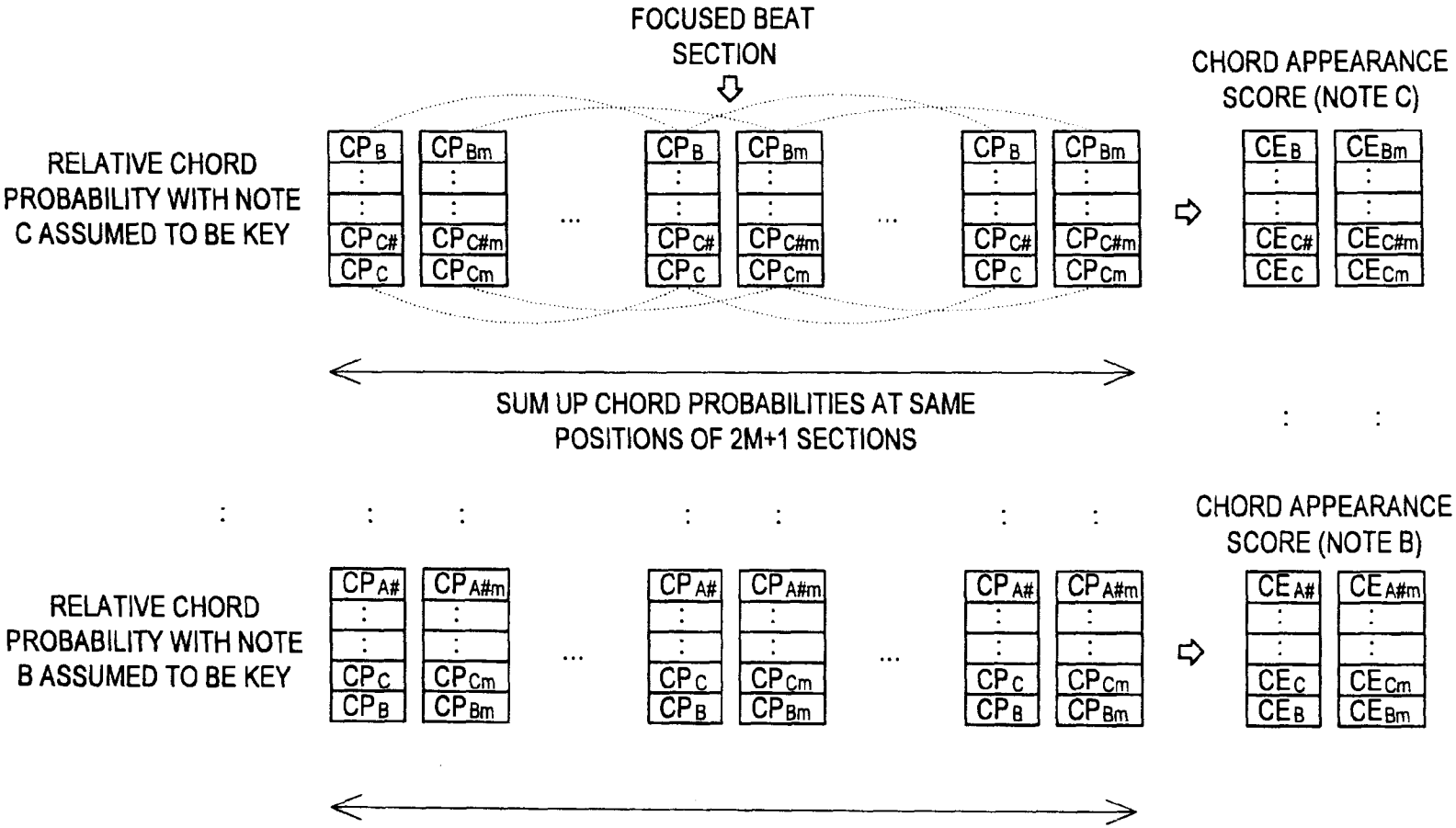
FIG. 42 is an explanatory diagram for describing a chord appearance score for each beat section.

FIG. 42 is an explanatory diagram for describing the chord appearance score for each beat section, generated by the feature quantity preparation unit 174.

Referring to FIG. 42, the feature quantity preparation unit 174 first provides relative chord probabilities CP, with the note C assumed to be the key, for the focused beat section and the preceding and following M beat sections. Then, the feature quantity preparation unit 174 sums up, across the focused beat section and the preceding and following M sections, the probability values of the elements at the same position, the probability values being included in the relative chord probabilities with the note C assumed to be the key. As a result, a chord appearance score ($CE_C$, $CE_{C\#}$, . . . , $CE_{Bm}$) (24-dimensional vector) is obtained, which is in accordance with the appearance probability of each chord, the appearance probability being for the focused beat section and a plurality of beat sections around the focused beat section and assuming the note C to be the key. The feature quantity preparation unit 174 performs the calculation of the chord appearance score as described above for cases each assuming one of the 12 notes from the note C to the note B to be the key. Thereby, 12 separate chord appearance scores are obtained for one focused beat section.

Figure 43:
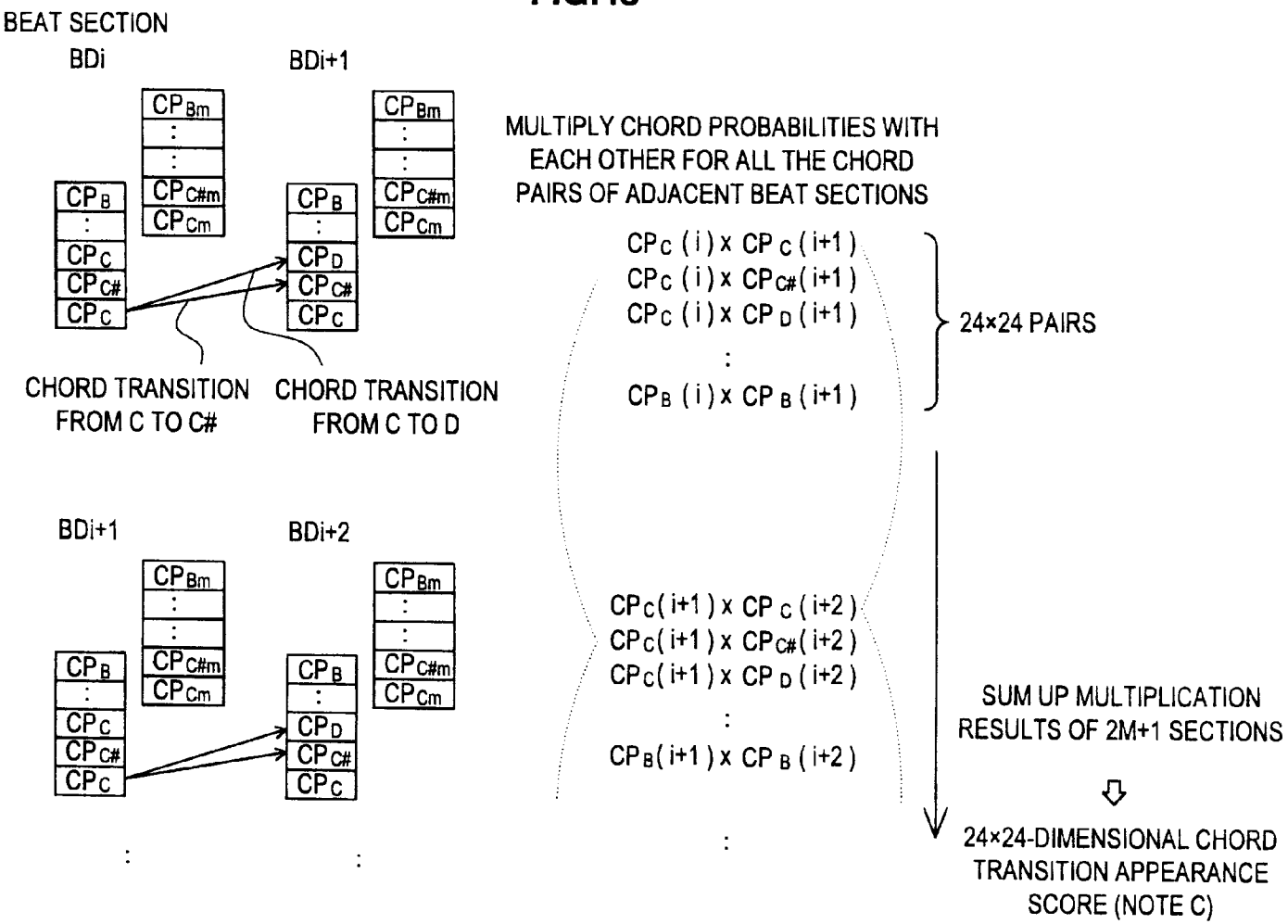
FIG. 43 is an explanatory diagram for describing a chord transition appearance score for each beat section.

Next, FIG. 43 is an explanatory diagram for describing the chord transition appearance score for each beat section generated by the feature quantity preparation unit 174.

Referring to FIG. 43, the feature quantity preparation unit 174 first multiplies with each other the relative chord probabilities before and after the chord transition, the relative chord probabilities assuming the note C to be the key, with respect to all the pairs of chords between a beat section $BD_i$ and an adjacent beat section $BD_{i+1}$ (i.e. all the chord transitions). Here, "all the pairs of the chords" means the 24×24 pairs, i.e. "C"→"C," "C"→"C#," "C"→"D," . . . , "B"→"B." Next, the feature quantity preparation unit 174 sums up the multiplication results of the relative chord probabilities before and after the chord transition for over the focused beat section and the preceding and following M sections. As a result, a 24×24-dimensional chord transition appearance score (a 24×24-dimensional vector) is obtained, which is in accordance with the appearance probability of each chord transition, the appearance probability being for the focused beat section and a plurality of beat sections around the focused beat section and assuming the note C to be the key. For example, a chord transition appearance score $CT_{C\to C\#}(i)$ regarding the chord transition from "C" to "C#" for a focused beat section $BD_i$ is given by the following equation.

[Equation 4]

$$CT_{C\to C\#}(i)=CP_C(i-M)\cdot CP_{C\#}(i-M+1)+\ldots+CP_C(i+M)\cdot CP_{C\#}(i+M+1) \quad (4)$$

The feature quantity preparation unit 174 performs the above-described 24×24 separate calculations for the chord transition appearance score CT for each case assuming one of the 12 notes from the note C to the note B to be the key. Thereby, 12 separate chord transition appearance scores are obtained for one focused beat section.

Moreover, unlike the chord which may change for each bar, for example, the key of a music piece usually remains unchanged for a longer period. Thus, the value of M defining the range of relative chord probabilities to be used for the computation of the chord appearance score or the chord transition appearance score is suitably a value which may include a number of bars such as several tens of beats, for example.

The feature quantity preparation unit 174 outputs, as the feature quantity for calculating the key probability, the 24-dimensional chord appearance score CE and the 24×24-dimensional chord transition appearance score that are calculated for each beat section to the key probability calculation unit 176.

(2-6-3. Key Probability Calculation Unit)

The key probability calculation unit 176 computes, for each beat section, the key probability indicating the probability of each key being played, by using the chord appearance score and the chord transition appearance score input from the feature quantity preparation unit 174. "Each key" here means a key distinguished based on, for example, the 12 notes (C, C#, D, . . . ) or the tonality (major/minor). For example, a key probability formula learnt in advance by the logistic regression analysis can be used for the calculation of the key probability.

Figure 44:
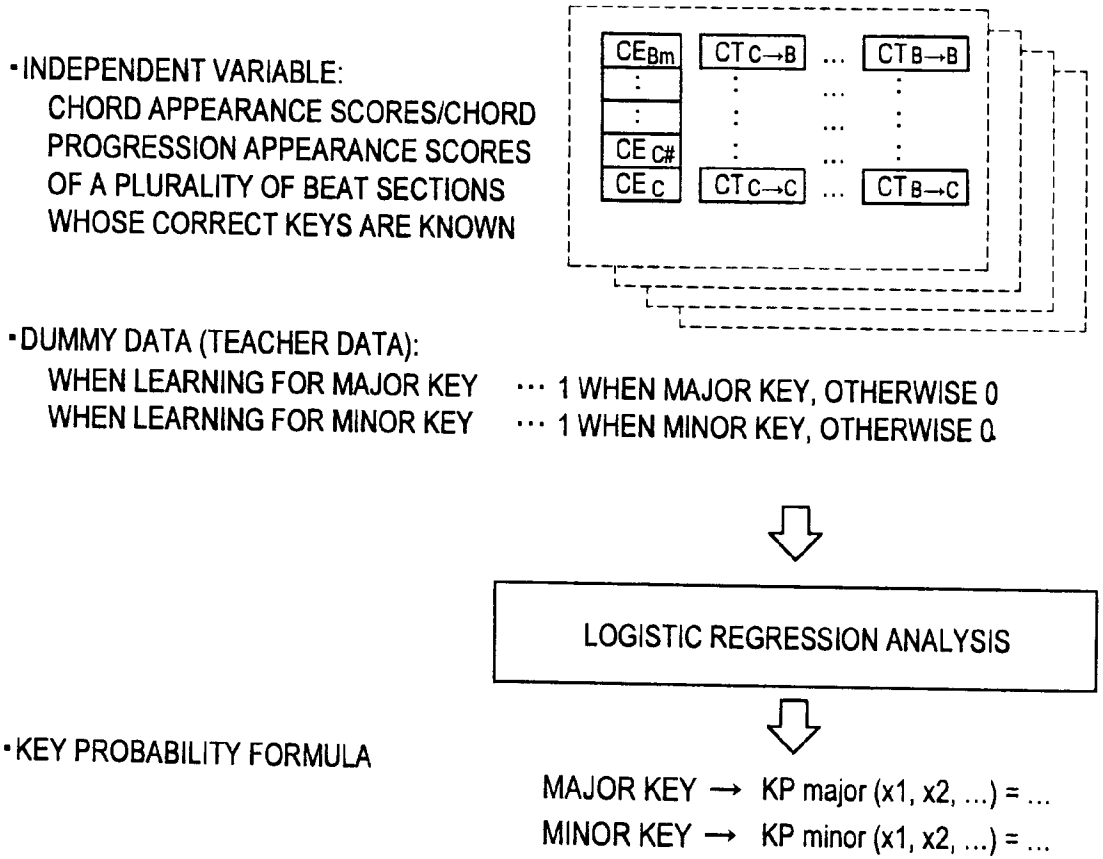
FIG. 44 is an explanatory diagram for describing a learning process for a key probability formula.

FIG. 44 is an explanatory diagram for describing a learning process for the key probability formula used for the calculation of the key probability by the key probability calculation unit 176.

The learning of the key probability formula is performed independently for the major key and the minor key. That is, two formulae, i.e. a major key probability formula and a minor key probability formula, are obtained by the learning.

First, a plurality of chord appearance scores and chord progression appearance scores for respective beat sections whose correct keys are known are provided as the independent variables in the logistic regression analysis.

Next, dummy data (teacher data) for predicting the generation probability by the logistic regression analysis is provided for each of the provided pairs of the chord appearance score and the chord progression appearance score. For example, when learning the major key probability formula, the value of the dummy data will be a true value (1) if a known key is a major key, and a false value (0) for any other case. Also, when learning the minor key probability formula, the value of the dummy data will be a true value (1) if a known key is a minor key, and a false value (0) for any other case.

By performing the logistic regression analysis by using a sufficient number of pairs of the independent variable and the dummy data, the key probability formula for computing the probability of the major key or the minor key from a pair of the chord appearance score and the chord progression appearance score for each beat section is obtained in advance.

Then, the key probability calculation unit 176 applies each of the key probability formulae to a pair of the chord appearance score and the chord progression appearance score input from the feature quantity preparation unit 174, and sequentially computes the key probabilities for respective keys for each beat section.

Figure 45:
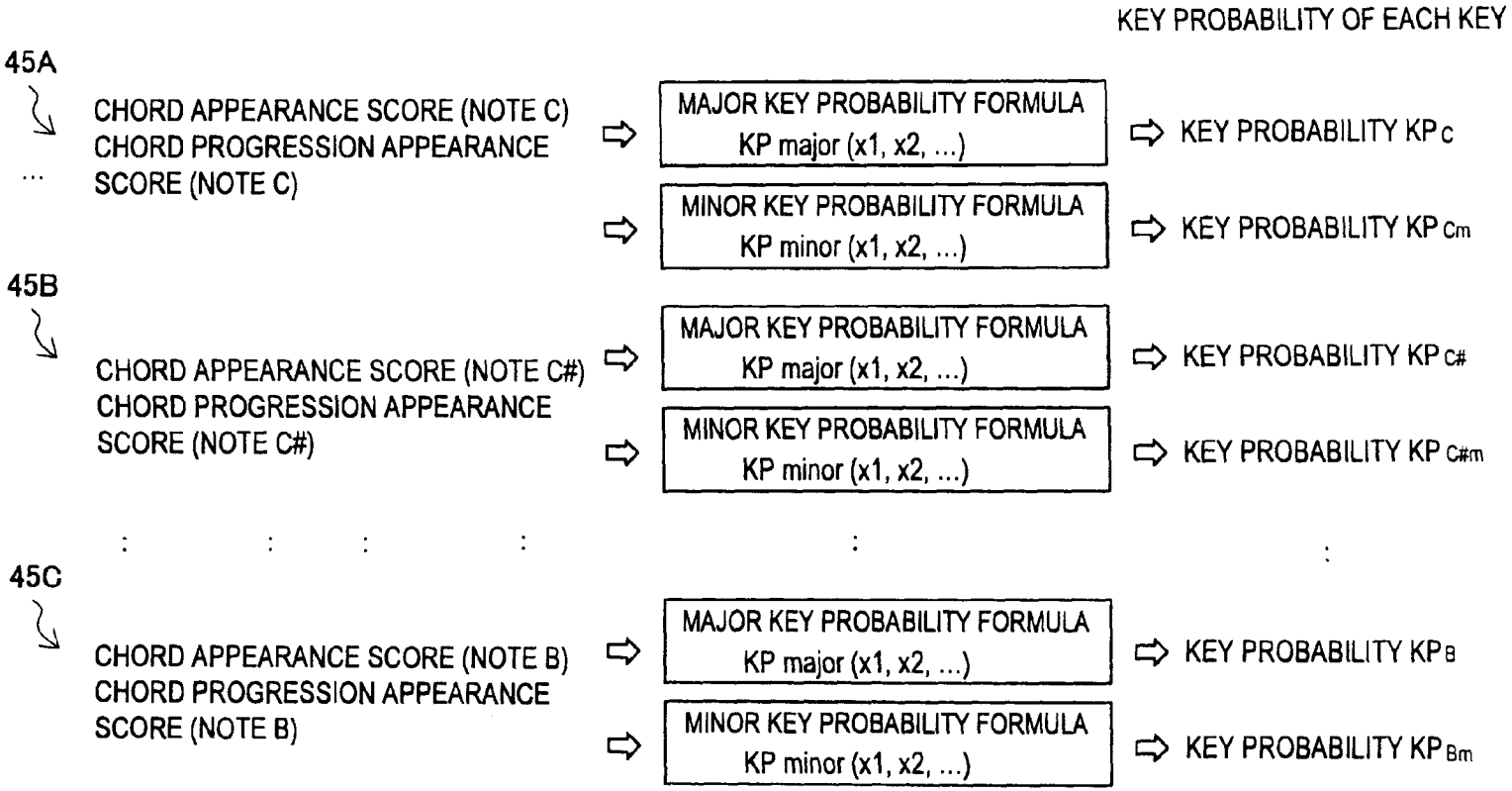
FIG. 45 is an explanatory diagram for describing a calculation process for the key probability.

FIG. 45 is an explanatory diagram for describing a calculation process for the key probability by the key probability calculation unit 176.

Referring to FIGS. 45 (45A), the key probability calculation unit 176 applies the major key probability formula obtained in advance by learning to a pair of the chord appearance score and the chord progression appearance score with the note C assumed to be the key, for example, and calculates a key probability $KP_C$ of the key being "C" for the corresponding beat section. Also, the key probability calculation unit 176 applies the minor key probability formula to the pair of the chord appearance score and the chord progression appearance score with the note C assumed to be the key, and calculates a key probability $KP_{Cm}$ of the key being "Cm" for the corresponding beat section.

Similarly, the key probability calculation unit 176 can apply the major key probability formula and the minor key probability formula to a pair of the chord appearance score and the chord progression appearance score with the note C# assumed to be the key, and can calculate key probabilities $KP_{C\#}$ and $KP_{C\#m}$ (45B). The same can be said for the calculation of key probabilities $KP_B$ and $KP_{Bm}$ (45C).

Figure 46:
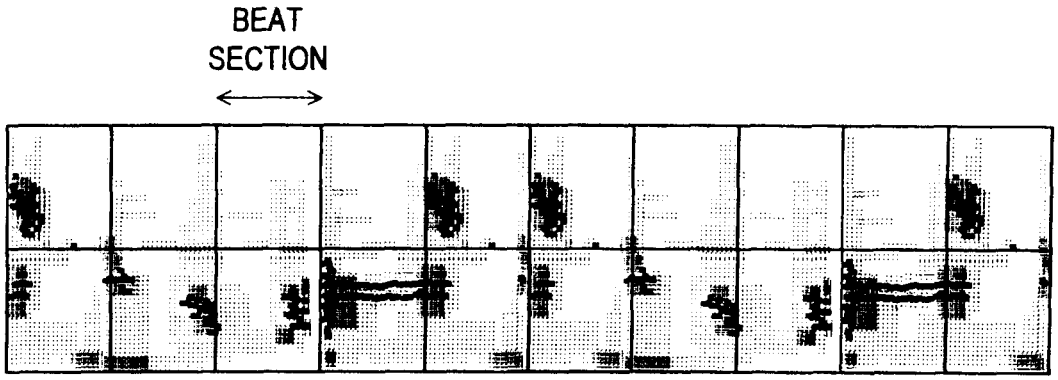
FIG. 46 is an explanatory diagram showing an example of the key probability computed by a key probability calculation unit.

FIG. 46 is an explanatory diagram showing an example of the key probability computed by the key probability calculation unit 176.

Referring to FIG. 46, two types of key probabilities, each for "Maj (major)" and "m (minor)," are calculated for a certain beat section for each of the 12 notes from the note C to the note B. According to the example of FIG. 46, the key probability $KP_C$ is 0.90, and the key probability $KP_{Cm}$ is 0.03. Furthermore, other key probability values all indicate 0.

Moreover, after calculating the key probability for all the types of keys, the key probability calculation unit 176 normalizes the probability values in such a way that the total of the computed probability values becomes 1 per beat section. The calculation and normalization process by the key probability calculation unit 176 as described above are repeated for all the beat sections included in the audio signal. The key probability calculation unit 176 computes the key probability for each key for each beat section in this manner, and outputs the key probability to the key determination unit 178.

Furthermore, the key probability calculation unit 176 calculates a simple key probability, which does not distinguish between major and minor, from the key probabilities values calculated for the two types of keys, i.e. major and minor, for each of 12 notes from the note C to the note B.

Figure 47:
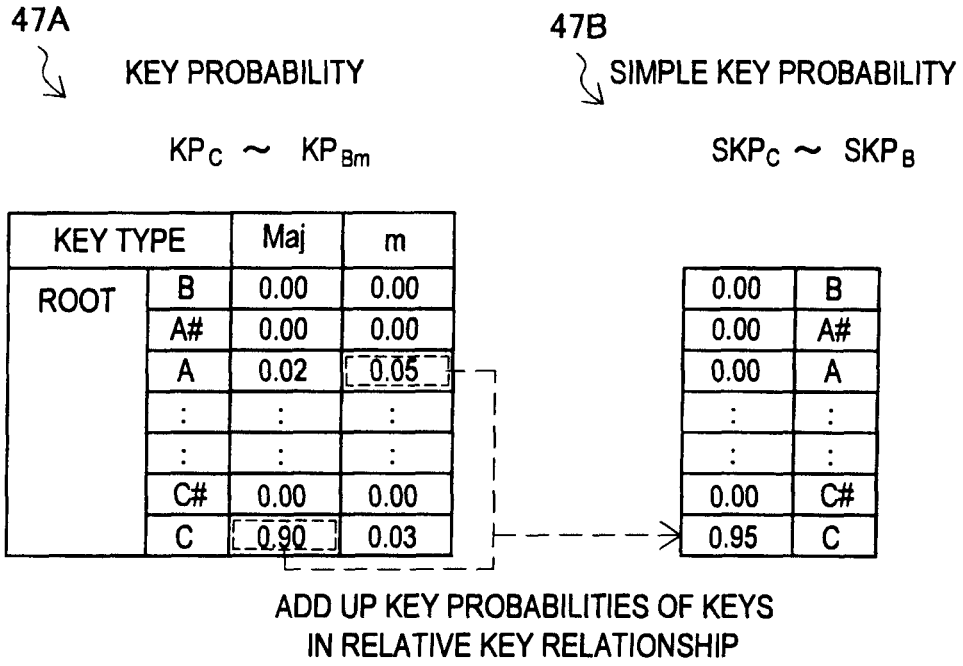
FIG. 47 is an explanatory diagram for describing a calculation process for a simple key probability.

FIG. 47 is an explanatory diagram for describing a calculation process for the simple key probability by the key probability calculation unit 176.

Referring to FIGS. 47 (47A), key probabilities $KP_C$, $KP_{Cm}$, $KP_A$, and $KP_{Am}$ are calculated by the key probability calculation unit 176 to be 0.90, 0.03, 0.02, and 0.05, respectively, for a certain beat section. Other key probability values all indicate 0. At this time, the key probability calculation unit 176 calculates the simple key probability, which does not distinguish between major and minor, by adding up the key probability values of keys in relative key relationship for each of the 12 notes from the note C to the note B. For example, a simple key probability $SKP_C$ is the total of the key probabilities $KP_C$ and $KP_{Am}$, i.e. $SKP_C$=0.90+0.05=0.95. This is because C major (key "C") and A minor (key "Am") are in relative key relationship. The calculation is similarly performed for the simple key probability values for the note C# to the note B.

The 12 separate simple key probabilities $SKP_C$ to $SKP_B$ computed by the key probability calculation unit 176 are output to the chord progression detection unit 190.

(Key Determination Unit)

The key determination unit 178 determines a likely key progression by a path search based on the key probability of each key computed by the key probability calculation unit 176 for each beat section. The Viterbi algorithm described above can be used as the method of path search by the key determination unit 178, for example.

Figure 48:
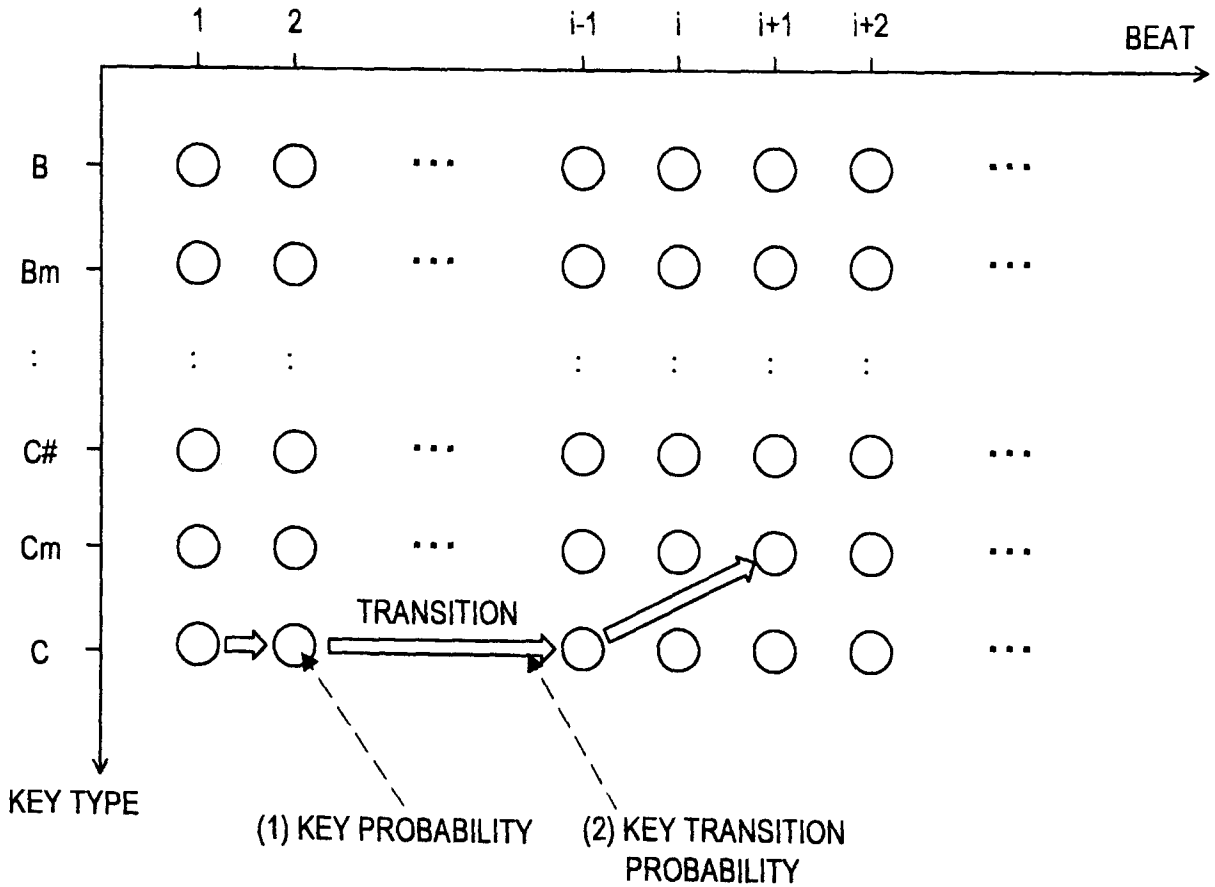
FIG. 48 is an explanatory diagram for describing a path search by a key determination unit.

FIG. 48 is an explanatory diagram for describing the path search by the key determination unit 178.

In case of applying the Viterbi algorithm to the path search by the key determination unit 178, beats are arranged sequentially on the time axis (horizontal axis in FIG. 48). Furthermore, the types of keys for which the key probability has been computed are used for the observation sequence (vertical axis in FIG. 48). That is, the key determination unit 178 takes, as the subject node of the path search, each of all the pairs of the beat for which the key probability has been computed by the key probability calculation unit 176 and a type of key.

With regard to the node as described, the key determination unit 178 sequentially selects, along the time axis, any of the nodes, and evaluates a path formed from a series of selected nodes by using two evaluation values, (1) key probability and (2) key transition probability. Moreover, skipping of beat is not allowed at the time of selection of a node by the key determination unit 178.

The (1) key probability is the key probability described above that is computed by the key probability calculation unit 176. The key probability is given to each of the node shown in FIG. 48. On the other hand, (2) key transition probability is an evaluation value given to a transition between nodes. The key transition probability is defined in advance for each pattern of modulation, based on the occurrence probability of modulation in a music piece whose correct keys are known.

FIG. 49 is an explanatory diagram showing an example of the key transition probability.

Twelve separate values in accordance with the modulation amounts for a transition are defined as the key transition probability for each of the four patterns of key transitions: from major to major, from major to minor, from minor to major, and from minor to minor. FIG. 49 shows an example of the 12 separate probability values in accordance with the modulation amounts for a key transition from major to major. For example, when the key transition probability in relation to a modulation amount Δk is Pr(Δk), Pr(0) is 0.9987. This indicates that the probability of the key changing in a music piece is very low. On the other hand, Pr(1) is 0.0002. This indicates that the probability of the key being raised by one pitch (or being lowered by 11 pitches) is 0.02%. Similarly, Pr(2), Pr(3), Pr(4), Pr(5), Pr(7), Pr(8), Pr(9) and Pr(10) are respectively 0.0001. Also, Pr(6) and Pr(11) are respectively 0.0000. The 12 separate probability values in accordance with the modulation amounts are respectively defined also for each of the transition patterns: from major to minor, from minor to major, and from minor to minor.

The key determination unit 178 sequentially multiplies with each other (1) key probability of each node included in a path and (2) key transition probability given to a transition between nodes, with respect to each path representing the key progression described by using FIG. 48. Then, the key determination unit 178 determines the path for which the multiplication result as the path evaluation value is the largest as the optimum path representing a likely key progression.

Figure 50:
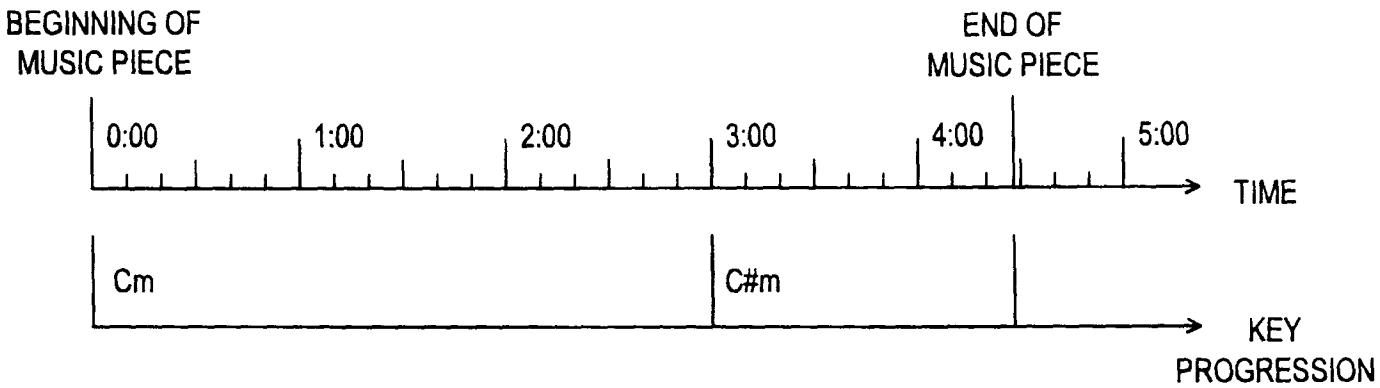
FIG. 50 is an explanatory diagram showing an example of a key progression determined by the key determination unit.

FIG. 50 is an explanatory diagram showing an example of the key progression determined by the key determination unit 178 as the optimum path.

In FIG. 50, a key progression of a music piece determined by the key determination unit 178 is shown under the time scale from the beginning of the music piece to the end. First, the key of the music piece is "Cm" for three minutes from the beginning of the music piece. After that, the key of the music piece changes to "C#m" and the key remains the same until the end of the music piece.

After the processing by the relative chord probability generation unit 172 through the key determination unit 178 described above, the key detection process by the key detection unit 170 is ended. The key progression and the key probability detected by the key detection unit 170 are output to the bar detection unit 180 and the chord progression detection unit 190 described next.

(2-7. Bar Detection Unit)

The bar detection unit 180 determines a bar progression indicating to which ordinal in which meter each beat in a series of beats corresponds, based on the beat probability, the similarity probability between beat sections, the chord probability for each beat section, the key progression and the key probability for each beat section.

Figure 51:
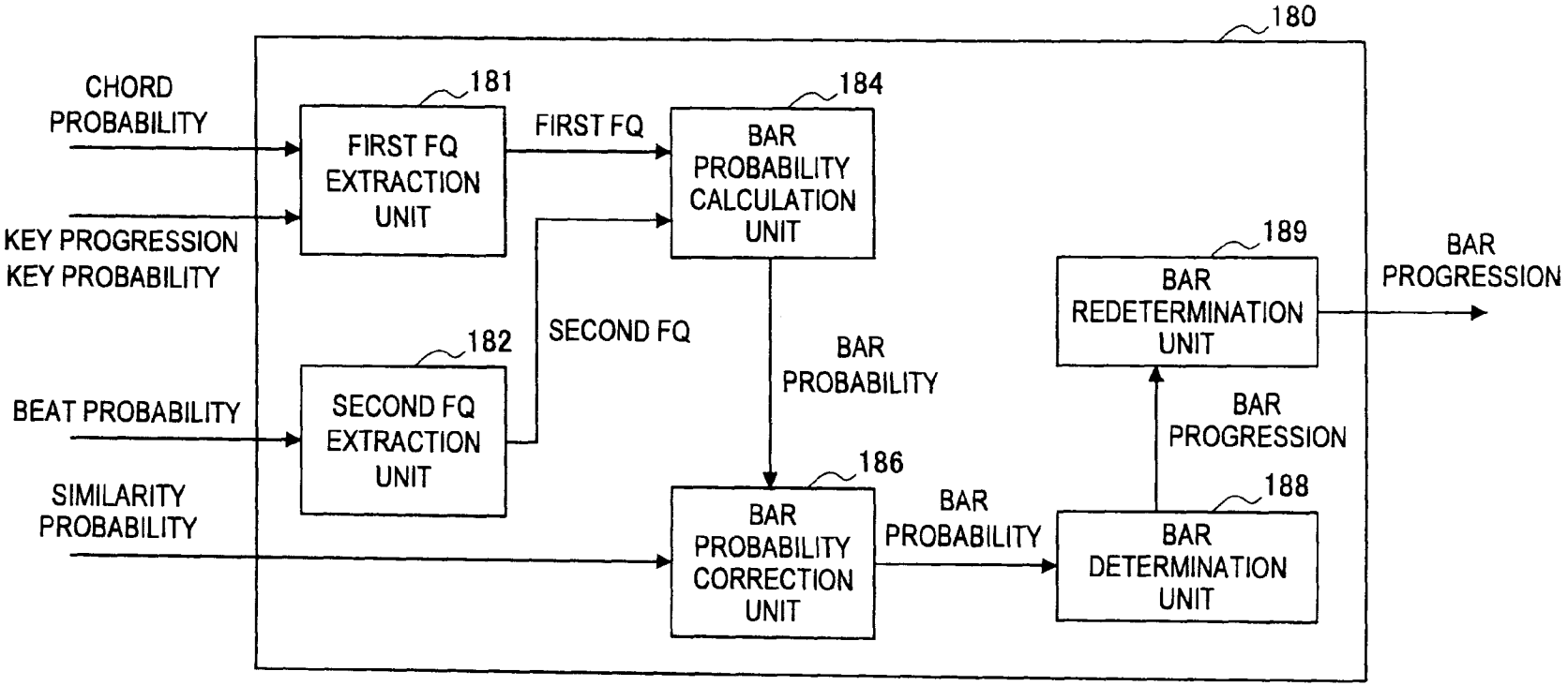
FIG. 51 is a block diagram showing a detailed configuration of a bar detection unit.

FIG. 51 is a block diagram showing a detailed configuration of the bar detection unit 180. Referring to FIG. 51, the bar detection unit 180 includes a first feature quantity extraction unit 181, a second feature quantity extraction unit 182, a bar probability calculation unit 184, a bar probability correction unit 186, a bar determination unit 188, and a bar redetermination unit 189.

(2-7-1. First Feature Quantity Extraction Unit)

The first feature quantity extraction unit 181 extracts, for each beat section, a first feature quantity in accordance with the chord probabilities and the key probabilities for the beat section and the preceding and following L sections as the feature quantity used for the calculation of a bar probability described later.

Figure 52:
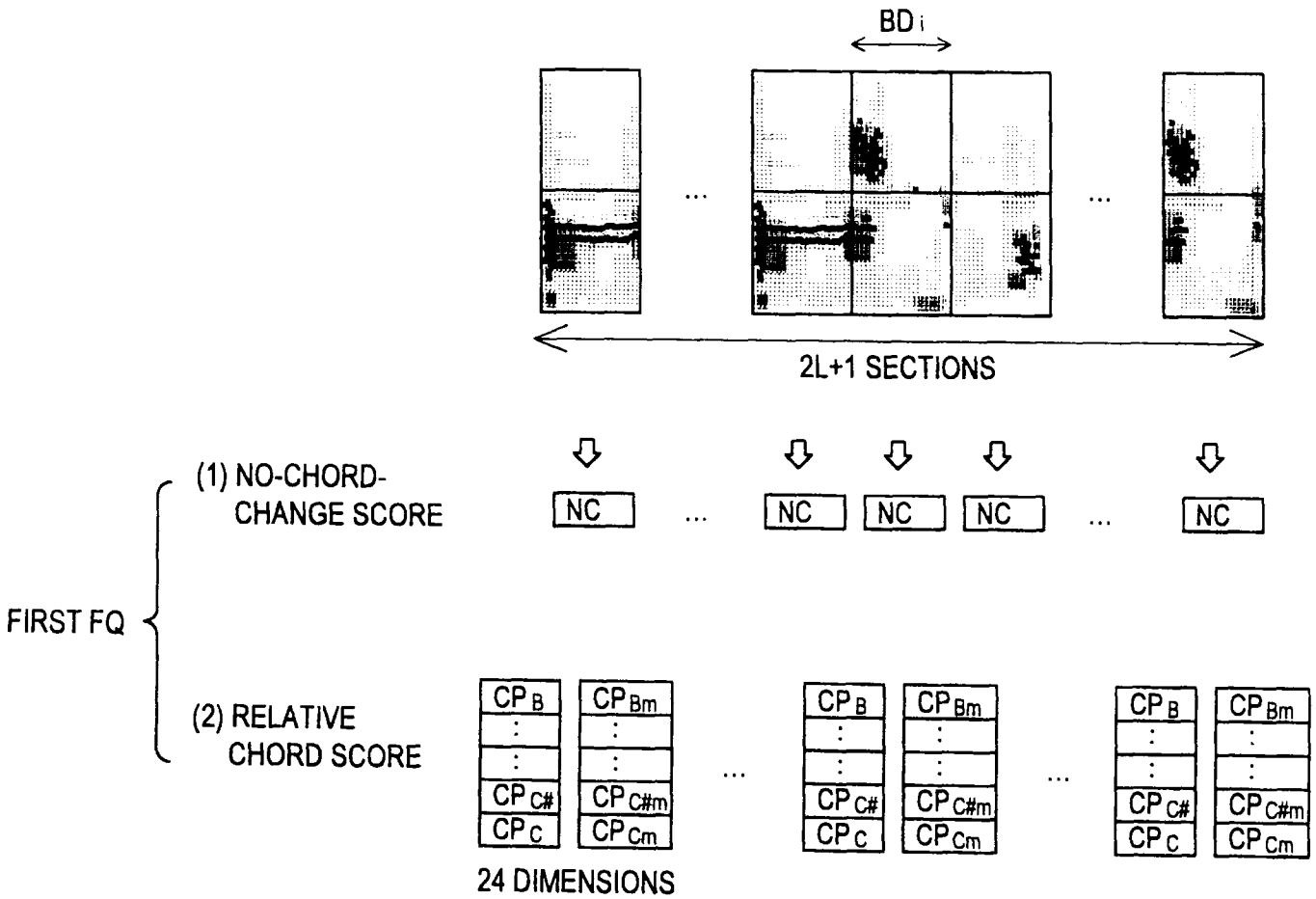
FIG. 52 is an explanatory diagram for describing a feature quantity extraction process by a first feature quantity extraction unit.

FIG. 52 is an explanatory diagram for describing a feature quantity extraction process by the first feature quantity extraction unit 181.

Referring to FIG. 52, the first feature quantity includes (1) no-chord-change score and (2) relative chord score derived from the chord probabilities and the key probabilities for a focused beat section $BD_i$ and the preceding and following L beat sections. Among these, the no-chord-change score is a feature quantity having dimensions equivalent to the number of sections including the focused beat section $BD_i$ and the preceding and following L sections. On the other hand, the relative chord score is a feature quantity having 24 dimensions for each of the focused beat section and the preceding and following L sections. For example, when L is 8, the no-chord-change score is 17-dimensional and the relative chord score is 408-dimensional (17×24 dimensions), and thus the first feature quantity has 425 dimensions in total. Hereunder, the no-chord-change score and the relative chord score will be described.

(1) No-Chord-Change Score

The no-chord-change score is a feature quantity representing the degree of a chord of a music piece not changing over a specific range of sections. The no-chord-change score is obtained by dividing a chord stability score described next by a chord instability score.

Figure 53:
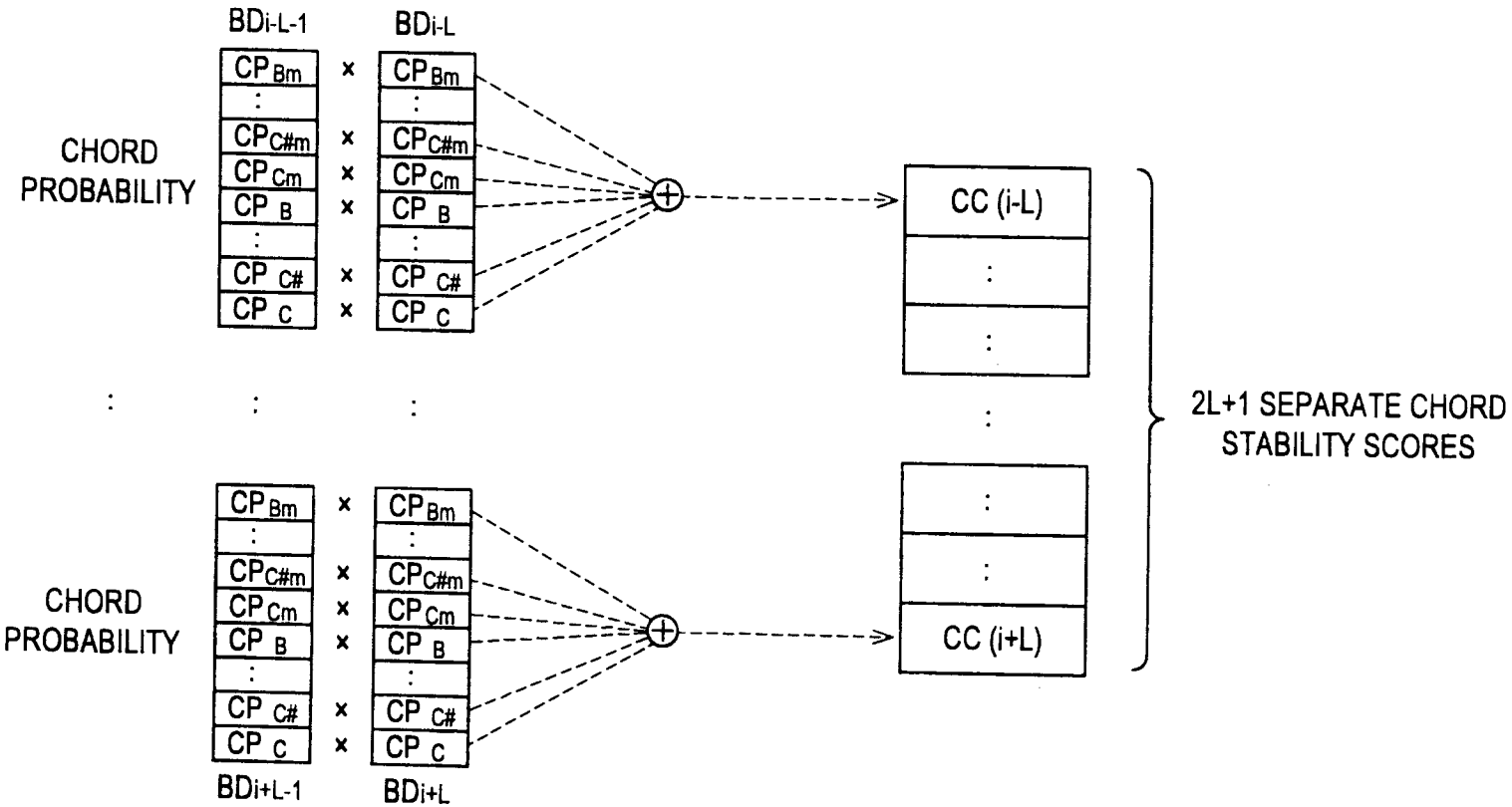
FIG. 53 is an explanatory diagram for describing a chord stability score.

FIG. 53 is an explanatory diagram for describing the chord stability score used for the calculation of the no-chord-change score.

Referring to FIG. 53, the chord stability score for a beat section $BD_i$ includes elements CC(i−L) to CC(i+L), each of which is determined for a corresponding section among the beat section $BD_i$ and the preceding and following L sections. Each of the elements is calculated as the total value of the products of the chord probabilities of the chords bearing the same names between a target beat section and the immediately preceding beat section. For example, by adding up the products of the chord probabilities of the chords bearing the same names among the chord probabilities for a beat section $BD_{1-L-1}$ and a beat section $BD_{i-L}$, a chord stability score CC(i−L) is computed. In a similar manner, by adding up the products of the chord probabilities of the chords bearing the same names among the chord probabilities for a beat section $BD_{i+L-1}$ and a beat section $BD_{i+L}$, a chord stability score CC(i+L) is computed. The first feature quantity extraction unit 181 performs the calculation as described for over the focused beat section $BD_i$ and the preceding and following L sections, and computes 2L+1 separate chord stability scores.

Figure 54:
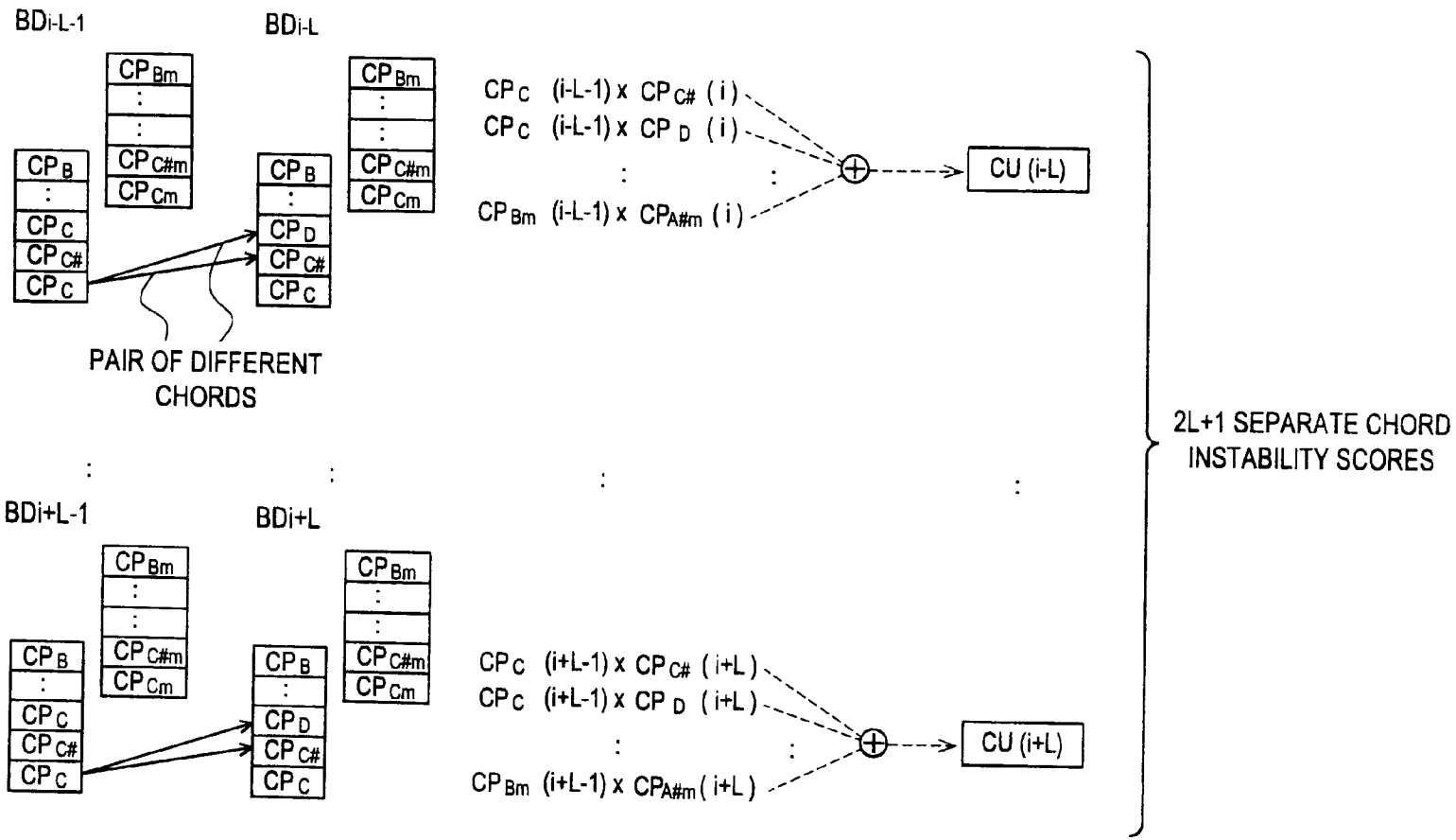
FIG. 54 is an explanatory diagram for describing a chord instability score.

FIG. 54 is an explanatory diagram for describing the chord instability score used for the calculation of the no-chord-change score.

Referring to FIG. 54, the chord instability score for the beat section $BD_i$ includes elements CU(i−L) to CU(i+L), each of which is determined for a corresponding section among the beat section $BD_i$ and the preceding and following L sections. Each of the elements is calculated as the total value of the products of the chord probabilities of all the pairs of chords bearing different names between a target beat section and the immediately preceding beat section. For example, by adding up the products of the chord probabilities of chords bearing different names among the chord probabilities for the beat section $BD_{i-L-1}$ and the beat section $BD_{i-L}$, a chord instability score CU(i−L) is computed. In a similar manner, by adding up the products of the chord probabilities of chords bearing different names among the chord probabilities for the beat section $BD_{i+L-1}$ and the beat section $BD_{i+L}$, a chord instability score CU(i+L) is computed. The first feature quantity extraction unit 181 performs the calculation as described for over the focused beat section $BD_i$ and the preceding and following L sections, and computes 2L+1 separate beat instability scores.

Furthermore, the first feature quantity extraction unit 181 computes, for the focused beat section $BD_i$, the no-chord-change scores by dividing the chord stability score by the chord instability score for each set of 2L+1 elements. For example, if the chord stability scores CC are ($CC_{i-L}$, . . . , $CC_{i+L}$) and the chord instability scores CU are ($CU_{i-L}$, . . . , $CU_{i+L}$) for the focused beat section $BD_i$, the no-chord-change scores CR are ($CC_{i-L}/CU_{i-L}$, . . . , $CC_{i+1}/CU_{i+L}$).

The no-chord-change score as described indicates a higher value as the change of chords within a given range around the focused beat section is less. The first feature quantity extraction unit 181 computes the no-chord-change score for all the beat sections included in the audio signal.

(2) Relative Chord Score

The relative chord score is a feature quantity representing the appearance probabilities of chords across sections in a given range and the pattern thereof. The relative chord score is generated by shifting the element positions of the chord probability in accordance with the key progression input from the key detection unit 170.

Figure 55:
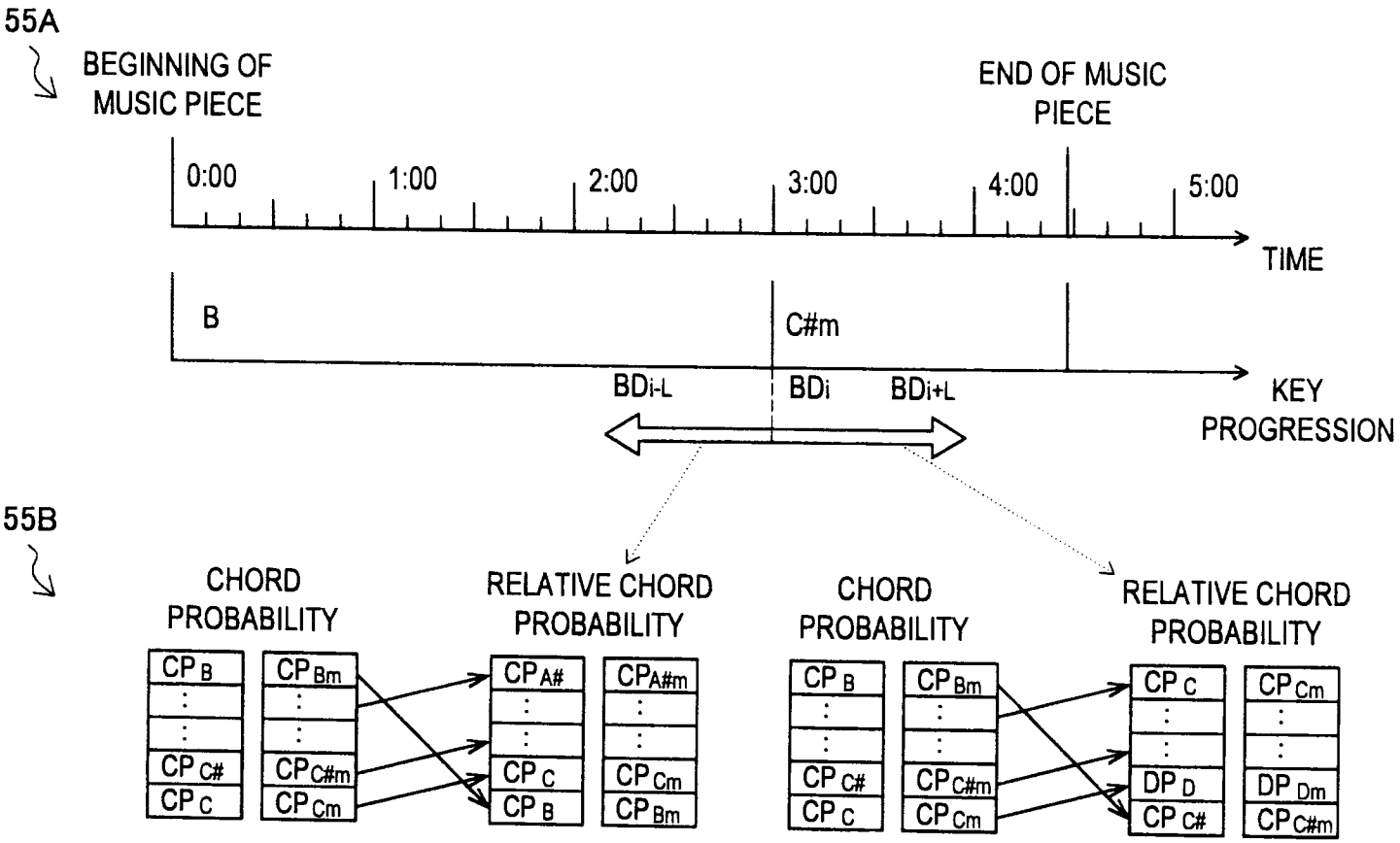
FIG. 55 is an explanatory diagram for describing a generation process for a relative chord score.

FIG. 55 is an explanatory diagram for describing a generation process for the relative chord score.

As with FIG. 50, FIG. 55 (55A) shows an example of the key progression determined by the key detection unit 170. According to the key progression, the key of the music piece changes from "B" to "C#m" after three minutes from the beginning of the music piece. Furthermore, the position of a focused beat section $BD_i$ is also shown, which includes within the preceding and following L sections a time point of change of the key.

At this time, the first feature quantity extraction unit 181 generates, for a beat section whose key is "B," a relative chord probability where the positions of the elements of a 24-dimensional chord probability, including major and minor, of the beat section are shifted so that the chord probability $CP_B$ comes at the beginning. Also, the first feature quantity extraction unit 181 generates, for a beat section whose key is "C#m," a relative chord probability where the positions of the elements of a 24-dimensional chord probability, including major and minor, of the beat section are shifted so that the chord probability $CP_{C\#m}$ comes at the beginning. The first feature quantity extraction unit 181 generates such a relative chord probability for each of the focused beat section and the preceding and following L sections, and outputs a collection of the generated relative chord probabilities ((2L+1)×24-dimensional feature quantity vector) as the relative chord score.

The first feature quantity formed from (1) no-chord-change score and (2) relative chord score described above is output from the first feature quantity extraction unit 181 to the bar probability calculation unit 184.

(2-7-2. Second Feature Quantity Extraction Unit)

The second feature quantity extraction unit 182 extracts, for each beat section, a second feature quantity in accordance with the feature of change in the beat probability over the beat section and the preceding and following L sections as the feature quantity used for the calculation of a bar probability described later.

Figure 56:
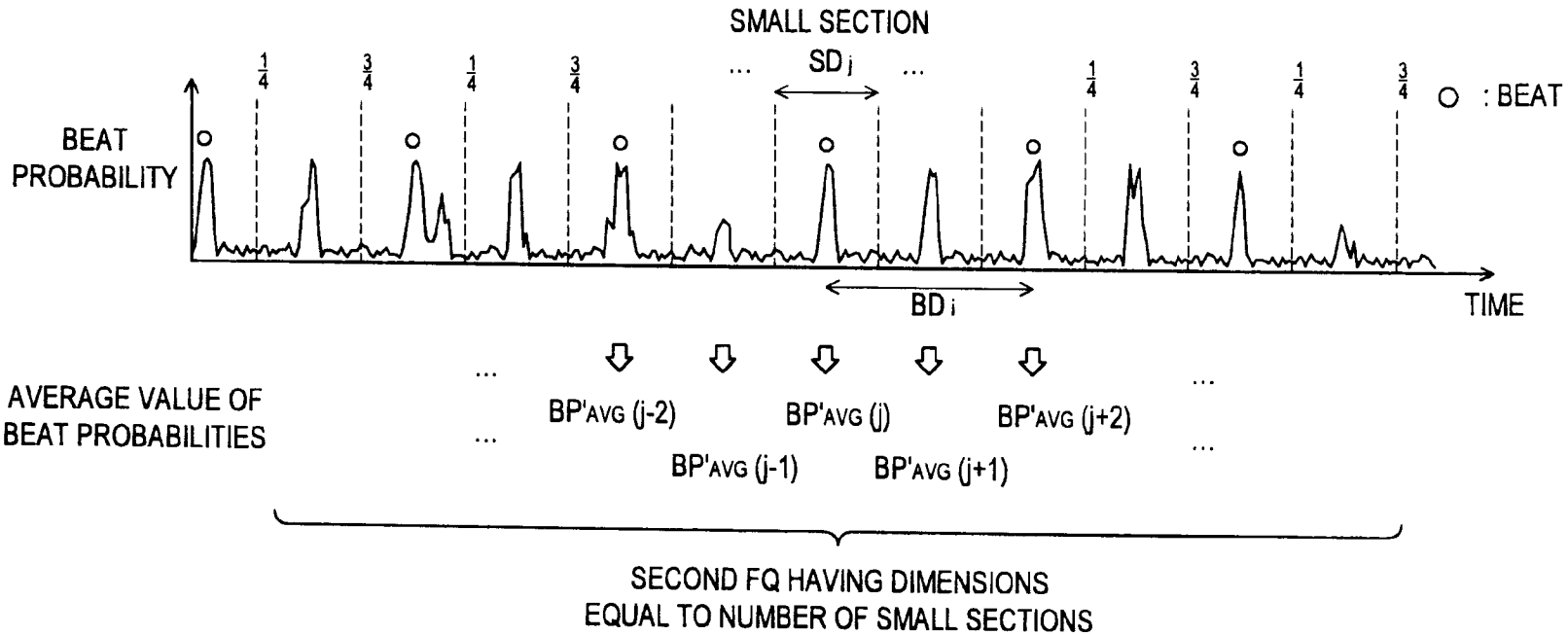
FIG. 56 is an explanatory diagram for describing a feature quantity extraction process by a second feature quantity extraction unit.

FIG. 56 is an explanatory diagram for describing a feature quantity extraction process by the second feature quantity extraction unit 182.

Referring to FIG. 56, the beat probability input from the beat probability computation unit 120 is shown along the time axis. Furthermore, 6 beats detected by analyzing the beat probability as well as a focused beat section $BD_i$ are also shown as an example. The second feature quantity extraction unit 182 computes, with respect to the beat probability, the average value of the beat probability for each of a small section $SD_j$ having a specific duration and included in a beat section over the focused beat section $BD_i$ and the preceding and following L sections.

For example, to detect mainly a meter whose note value (M of N/M meter) is 4, it is preferable that the small sections are divided from each other by lines dividing a beat interval at positions 1/4 and 3/4 of the beat interval. In this case, L×4+1 pieces of the average values of the beat probability will be computed for one focused beat section $BD_i$. Accordingly, the second feature quantity extracted by the second feature quantity extraction unit 182 will have L×4+1 dimensions for each focused beat section. Also, the duration of the small section is 1/2 that of the beat interval.

Moreover, to appropriately detect a bar in the music piece, it is desired to analyze the feature of the audio signal over at least several bars. It is therefore preferable that the value of L defining the range of the beat probability used for the extraction of the second feature quantity is 8 beats, for example. When L is 8, the second feature quantity extracted by the second feature quantity extraction unit 182 is 33-dimensional for each focused beat section.

The second feature quantity described above is output from the second feature quantity extraction unit 182 to the bar probability calculation unit 184.

(2-7-3. Bar Probability Calculation Unit)

The bar probability calculation unit 184 computes the bar probability for each beat by using the first feature quantity and the second feature quantity described above. In this specification, the bar probability means a collection of probabilities of respective beats being the Y-th beat in an X meter. Furthermore, in the present embodiment, each ordinal in each meter is made to be the subject of the discrimination, where each meter is any of a 1/4 meter, a 2/4 meter, a 3/4 meter and a 4/4 meter. That is, in this embodiment, there are 10 separate sets of X and Y, namely, (1, 1), (2, 1), (2, 2), (3, 1), (3, 2), (3, 3), (4, 1), (4, 2), (4, 3), and (4, 4), and 10 types of bar probabilities are computed. Moreover, the probability values computed by the bar probability calculation unit 184 are corrected by the bar probability correction unit 186 described later taking into account the structure of the music piece. That is, the probabilities computed by the bar probability calculation unit 184 are intermediary data yet to be corrected. A bar probability formula learnt in advance by a logistic regression analysis can be used for the computation of the bar probability by the bar probability calculation unit 184, for example.

FIG. 57 is an explanatory diagram for describing a learning process for the bar probability formula used for the calculation of the bar probability by the bar probability calculation unit 184.

Moreover, the learning of the bar probability formula is performed for each type of the bar probabilities described above. That is, when presuming that the ordinal of each beat in a 1/4 meter, a 2/4 meter, a 3/4 meter and a 4/4 meter is to be discriminated, 10 separate bar probability formulae are to be obtained by the learning.

First, a plurality of pairs of the first feature quantity and the second feature quantity which are extracted by analyzing the audio signal and whose correct meters (X) and correct ordinals of beats (Y) are known are provided as independent variables for the logistic regression analysis.

Next, dummy data (teacher data) for predicting the generation probability for each of the provided pairs of the first feature quantity and the second feature quantity by the logistic regression analysis is provided. For example, when learning a formula for discriminating a first beat in a 1/4 meter to compute the probability of a beat being the first beat in a 1/4 meter, the value of the dummy data will be a true value (1) if the known meter and ordinal are (1, 1), and a false value (0) for any other case. Also, when learning a formula for discriminating a first beat in 2/4 meter to compute the probability of a beat being the first beat in a 2/4 meter, for example, the value of the dummy data will be a true value (1) if the known meter and ordinal are (2, 1), and a false value (0) for any other case. The same can be said for other meters and ordinals.

By performing the logistic regression analysis by using a sufficient number of pairs of the independent variable and the dummy data as described above, 10 types of bar probability formulae for computing the bar probability from a pair of the first feature quantity and the second feature quantity are obtained in advance.

Then, the bar probability calculation unit 184 applies the bar probability formula to a pair of the first feature quantity and the second feature quantity respectively input from the first feature quantity extraction unit 181 and the second feature quantity extraction unit 182, and sequentially computes the bar probabilities for respective beat sections.

Figure 58:
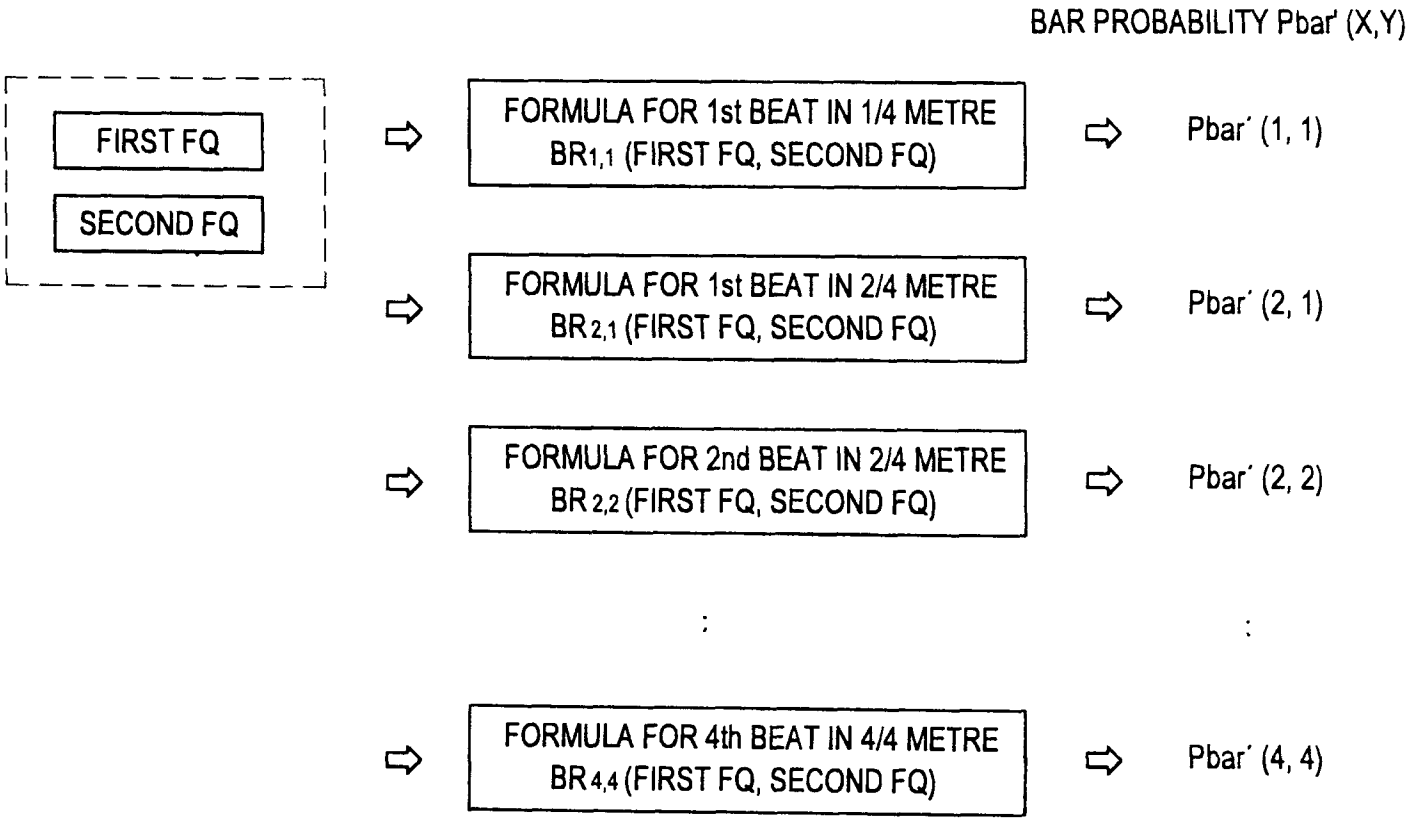
FIG. 58 is an explanatory diagram for describing a calculation process for a bar probability.

FIG. 58 is an explanatory diagram for describing a calculation process for the bar probability by the bar probability calculation unit 184.

Referring to FIG. 58, the bar probability calculation unit 184 applies the formula for discriminating a first beat in a 1/4 meter obtained in advance to a pair of the first feature quantity and the second feature quantity extracted for a focused beat section, for example, and calculates a bar probability $P_{bar}'(1, 1)$ of a beat being the first beat in a 1/4 meter. Also, the bar probability calculation unit 184 applies the formula for discriminating a first beat in a 2/4 meter obtained in advance to the pair of the first feature quantity and the second feature quantity extracted for the focused beat section, and calculates a bar probability $P_{bar}'$ (2, 1) of a beat being the first beat in a 2/4 meter. The same can be said for other meters and ordinals.

The bar probability calculation unit 184 repeats the calculation of the bar probability for all the beats, and computes the bar probability for each beat. The bar probability computed for each beat by the bar probability calculation unit 184 is output to the bar probability correction unit 186 described next.

(2-7-4. Bar Probability Correction Unit)

The bar probability correction unit 186 corrects the bar probabilities input from the bar probability calculation unit 184, based on the similarity probabilities between beat sections input from the structure analysis unit 150.

For example, let us assume that the bar probability of an i-th focused beat being a Y-th beat in an X meter, where the bar probability is yet to be corrected, is $P_{bar}'$ (i, x, y), and the similarity probability between an i-th beat section and a j-th beat section is SP(i, j). Then, a bar probability after correction $P_{bar}$ y) is given by the following equation, for example.

[Equation 5]

$$P_{bar}(i, x, y) = \sum_j P'_{bar}(j, x, y) \cdot \left( \frac{SP(i, j)}{\sum_k SP(i, k)} \right) \quad (5)$$

That is, the bar probability after correction $P_{bar}$ (i, x, y) is a value obtained by weighting and summing the bar probabilities before correction by using normalized similarity probabilities as weights where the similarity probabilities are those between a beat section corresponding to a focused beat and other beat sections. By such a correction of probability values, the bar probabilities of beats of similar sound contents will have closer values compared to the bar probabilities before correction. The bar probabilities for respective beats corrected by the bar probability correction unit 186 are output to the bar determination unit 188 described next.

(2-7-5. Bar Determination Unit)

The bar determination unit 188 determines a likely bar progression by a path search, based on the bar probabilities input from the bar probability correction unit 186, the bar probabilities indicating the probabilities of respective beats being a Y-th beat in an X meter. The Viterbi algorithm described above can be used as the method of path search by the bar determination unit 188, for example.

Figure 59:
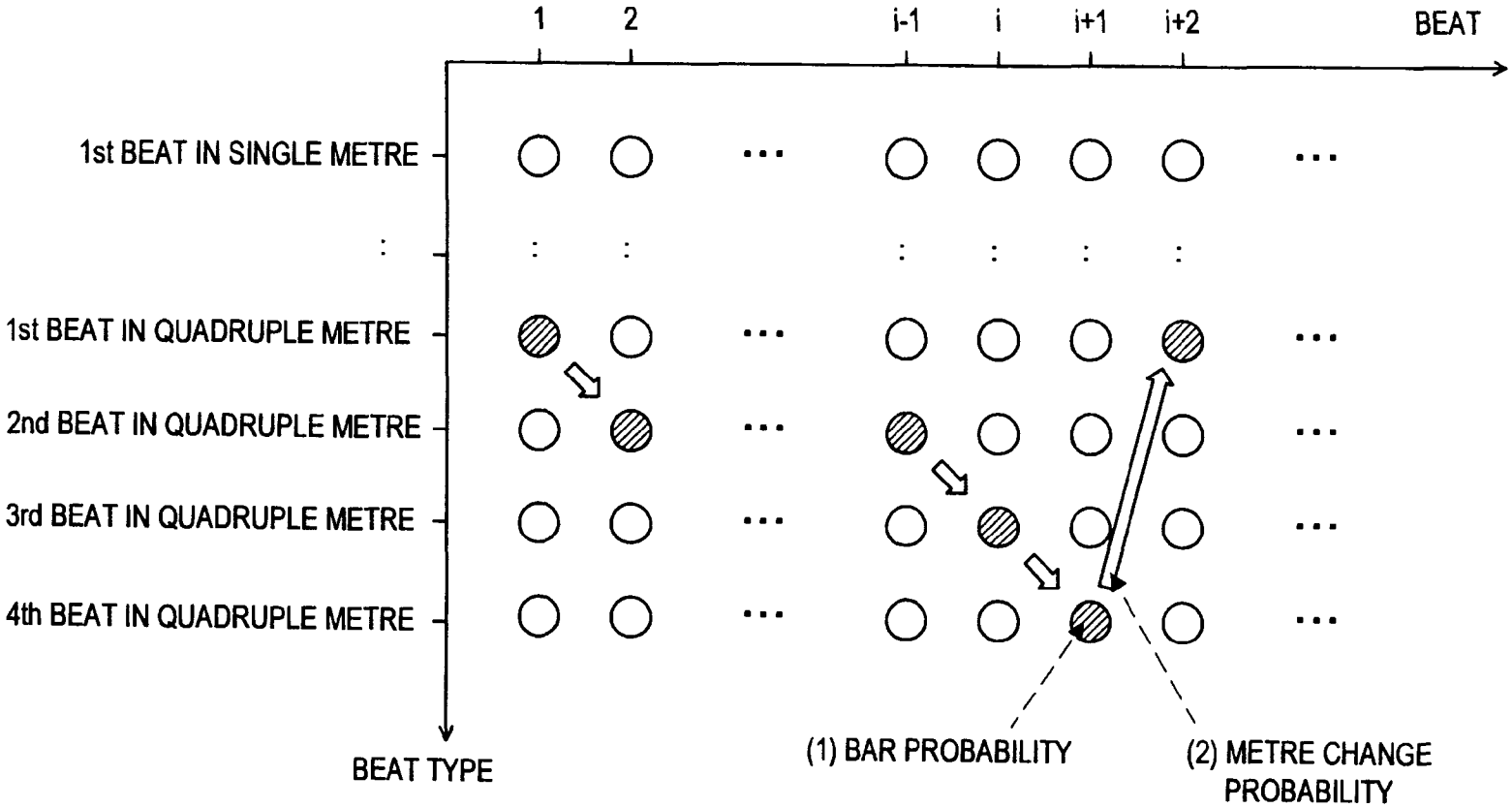
FIG. 59 is an explanatory diagram for describing a path search by a bar determination unit.

FIG. 59 is an explanatory diagram for describing the path search by the bar determination unit 188.

In case of applying the Viterbi algorithm to the path search by the bar determination unit 188, beats are arranged sequentially on the time axis (horizontal axis in FIG. 59). Furthermore, the types of beats (Y-th beat in X meter) for which the bar probabilities have been computed are used for the observation sequence (vertical axis in FIG. 59). That is, the bar determination unit 188 takes, as the subject node of the path search, each of all the pairs of a beat input from the bar probability correction unit 186 and a type of beat.

With regard to the node as described, the bar determination unit 188 sequentially selects, along the time axis, any of the nodes. Then, the bar determination unit 188 evaluates a path formed from a series of selected nodes by using two evaluation values, (1) bar probability and (2) meter change probability.

Moreover, at the time of the selection of nodes by the bar determination unit 188, it is preferable that restrictions described below are imposed, for example. Firstly, skipping of beat is prohibited. Secondly, transition from a meter to another meter in the middle of a bar, such as transition from any of the first to third beats in a quadruple meter or the first or second beat in a triple meter, or transition from a meter to the middle of a bar of another meter is prohibited. Thirdly, transition whereby the ordinals are out of order, such as from the first beat to the third or fourth beat, or from the second beat to the second or fourth beat, is prohibited.

Now, (1) bar probability, among the evaluation values used for the evaluation of a path by the bar determination unit 188, is the bar probability described above that is computed by correcting the bar probability by the bar probability correction unit 186. The bar probability is given to each of the nodes shown in FIG. 59. On the other hand, (2) meter change probability is an evaluation value given to the transition between nodes. The meter change probability is predefined for each set of a type of beat before change and a type of beat after change by collecting, from a large number of common music pieces, the occurrence probabilities for changes of meters during the progression of bars.

FIG. 60 is an explanatory diagram showing an example of the meter change probability.

Referring to FIGS. 60, 16 separate meter change probabilities derived based on four types of meters before change and four types of meters after change are shown. In this example, the meter change probability for a change from a quadruple meter to a single meter is 0.05, the meter change probability from the quadruple meter to a duple meter is 0.03, the meter change probability from the quadruple meter to a triple meter is 0.02, and the meter change probability from the quadruple meter to the quadruple meter (i.e. no change) is 0.90. This indicates that the possibility of the meter changing in the middle of a music piece is generally not high.

Moreover, regarding the single meter or the duple meter, in case the detected position of a bar is shifted from its correct position due to a detection error of the bar, the meter change probability may serve to automatically restore the position of the bar. Thus, the value of the meter change probability between the single meter or the duple meter and another meter is preferably set to be higher than the meter change probability between the triple meter or the quadruple meter and another meter.

The bar determination unit 188 sequentially multiplies with each other (1) bar probability of each node included in a path and (2) meter change probability described above given to the transition between nodes, with respect to each path representing the bar progression described by using FIG. 59. Then, the bar determination unit 188 determines the path for which the multiplication result as the path evaluation value is the largest as the optimum path representing a likely bar progression.

Figure 61:
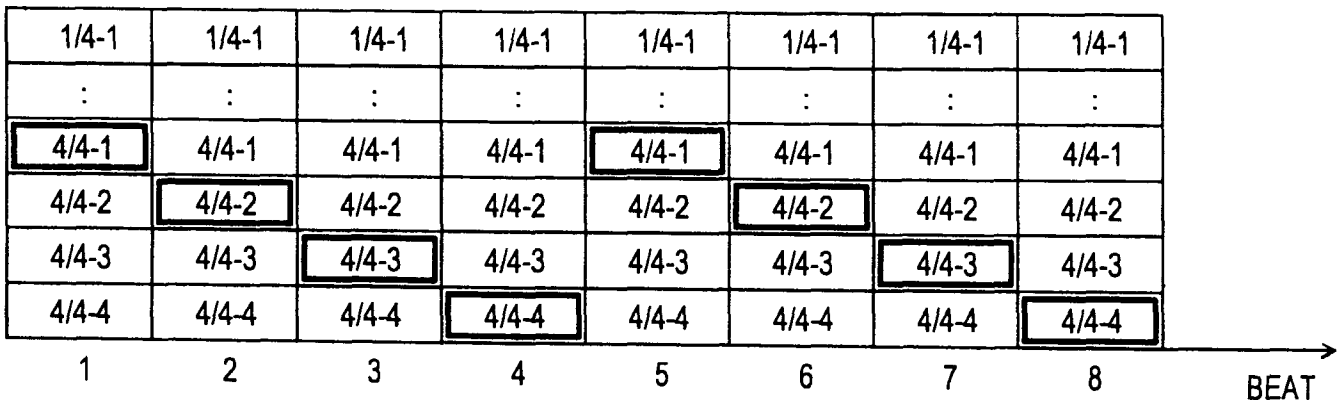
FIG. 61 is an explanatory diagram showing an example of a bar progression determined by the bar determination unit.

FIG. 61 is an explanatory diagram showing an example of the bar progression determined as the optimum path by the bar determination unit 188.

In FIG. 61, the bar progression determined to be the optimum path by the bar determination unit 188 is shown for the first to eighth beat (see thick-line box). According to this example, the type of each beat is, sequentially from the first beat, first beat in quadruple meter, second beat in quadruple meter, third beat in quadruple meter, fourth beat in quadruple meter, first beat in quadruple meter, second beat in quadruple meter, third beat in quadruple meter, and fourth beat in quadruple meter. The optimum path, representing the bar progression, which is determined by the bar determination unit 188 is output to the bar redetermination unit 189 described next.

(2-7-6. Bar Redetermination Unit)

In a common music piece, it is rare that a triple meter and a quadruple meter are present in a mixed manner for the types of beats. Thus, the bar redetermination unit 189 first decides whether a triple meter and a quadruple meter are present in a mixed manner for the types of beats appearing in the bar progression input from the bar determination unit 188. Then, in case a triple meter and a quadruple meter are present in a mixed manner for the type of beats, the bar redetermination unit 189 excludes the less frequently appearing meter from the subject of search and searches again for the optimum path representing the bar progression. According to the path research process by the bar redetermination unit 189 as described, recognition errors of bars (types of beats) which might partially occur in a result of the path search can be reduced.

After the processing by the first feature quantity extraction unit 181 through the bar redetermination unit 189, the bar detection process by the bar detection unit 180 is ended. The bar progression (types of a series of beats) detected by the bar detection unit 180 is output to the chord progression detection unit 190 described next.

(2-8. Chord Progression Detection Unit)

The chord progression detection unit 190 determines a likely chord progression of a series of chords for each beat section based on the simple key probability for each beat, the similarity probability between beat sections and the bar progression.

Figure 62:
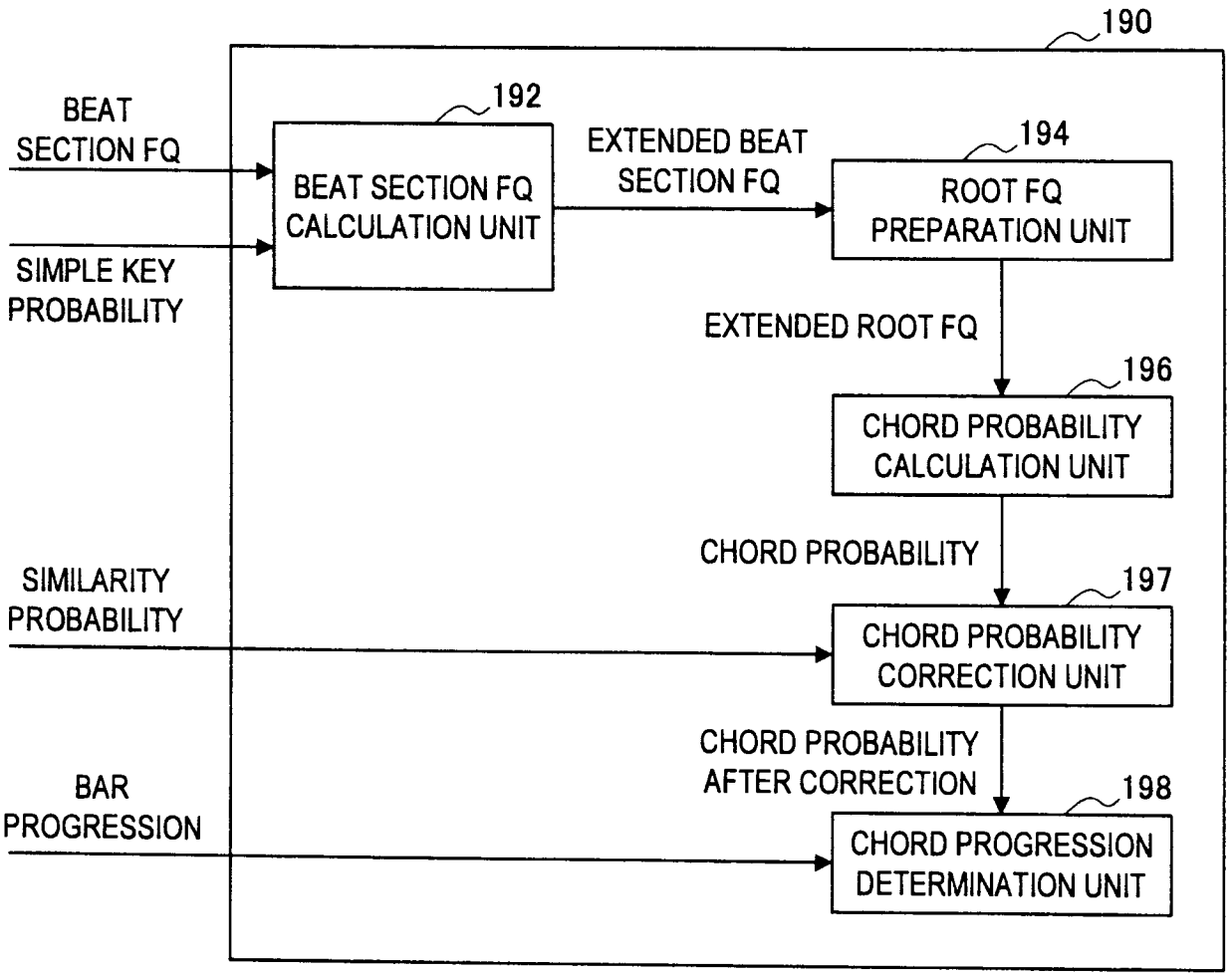
FIG. 62 is a block diagram showing a detailed configuration of a chord progression detection unit.

FIG. 62 is a block diagram showing a detailed configuration of the chord progression detection unit 190. Referring to FIG. 62, the chord progression detection unit 190 includes a beat section feature quantity calculation unit 192, a root feature quantity preparation unit 194, a chord probability calculation unit 196, a chord probability correction unit 197, and a chord progression determination unit 198.

(2-8-1. Beat Section Feature Quantity Calculation Unit)

As with the beat section feature quantity calculation unit 162 of the chord probability computation unit 160, the beat section feature quantity calculation unit 192 first calculates energies-of-respective-12-notes (see FIGS. 28 to 30 for the calculation process for the energies-of-respective-12-notes). Alternatively, the beat section feature quantity calculation unit 192 may obtain and use the energies-of-respective-12-notes computed by the beat section feature quantity calculation unit 162.

Next, the beat section feature quantity calculation unit 192 generates an extended beat section feature quantity including the energies-of-respective-12-notes of a focused beat section and the preceding and following N sections as well as the simple key probability input from the key detection unit 170.

Figure 63:
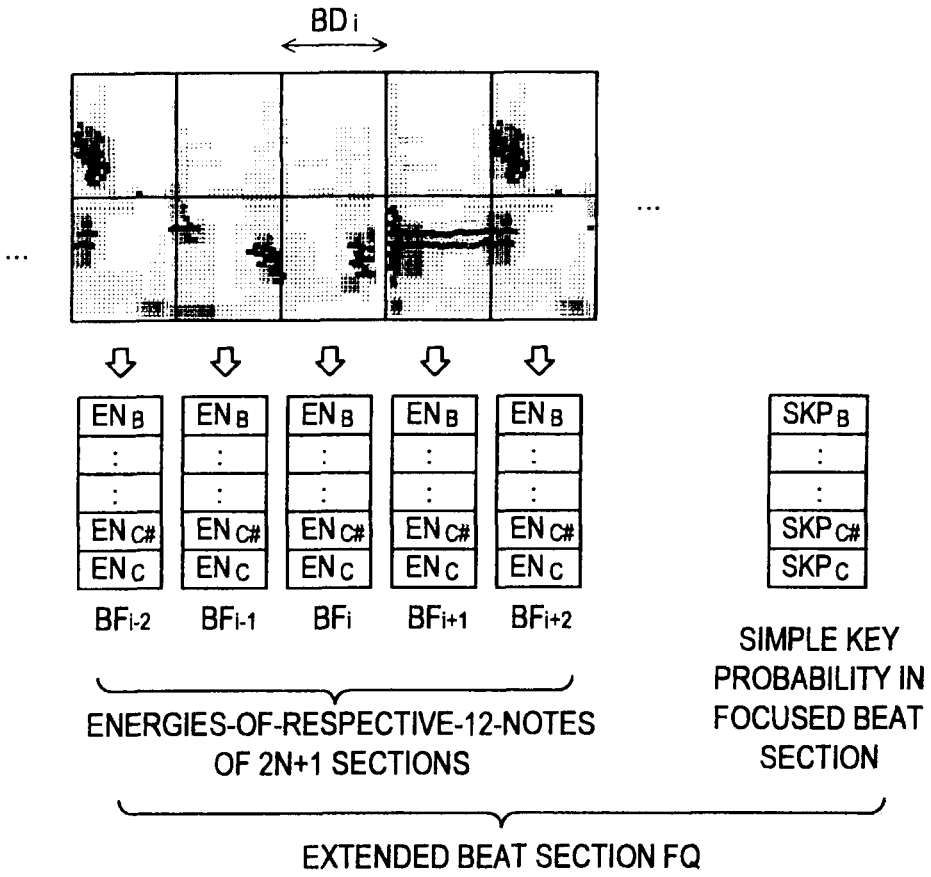
FIG. 63 is an explanatory diagram for describing an extended beat section feature quantity.

FIG. 63 is an explanatory diagram for describing the extended beat section feature quantity generated by the beat section feature quantity calculation unit 192.

Referring to FIG. 63, the energies-of-respective-12-notes, $BF_{i-2}$, $BF_{i-1}$, $BF_i$, $BF_{i+1}$ and $BF_{i+2}$, respectively of a focused beat section $BD_i$ and the preceding and following N sections are extracted by the beat section feature quantity calculation unit 192, for example. Moreover, N here is 2, for example. Also, the simple key probability ($SKP_C$, . . . , $SKP_B$) of the focused beat section $BD_i$ is obtained by the beat section feature quantity calculation unit 192. The beat section feature quantity calculation unit 192 generates, for all the beat sections, the extended beat section feature quantities including the energies-of-respective-12-notes of a beat section and the preceding and following N sections and the simple key probability, and outputs the same to the root feature quantity preparation unit 194.

(2-8-2. Root Feature Quantity Preparation Unit)

The root feature quantity preparation unit 194 shifts the element positions of the extended root feature quantity input from the beat section feature quantity calculation unit 192, and generates 12 separate extended root feature quantities.

Figure 64:
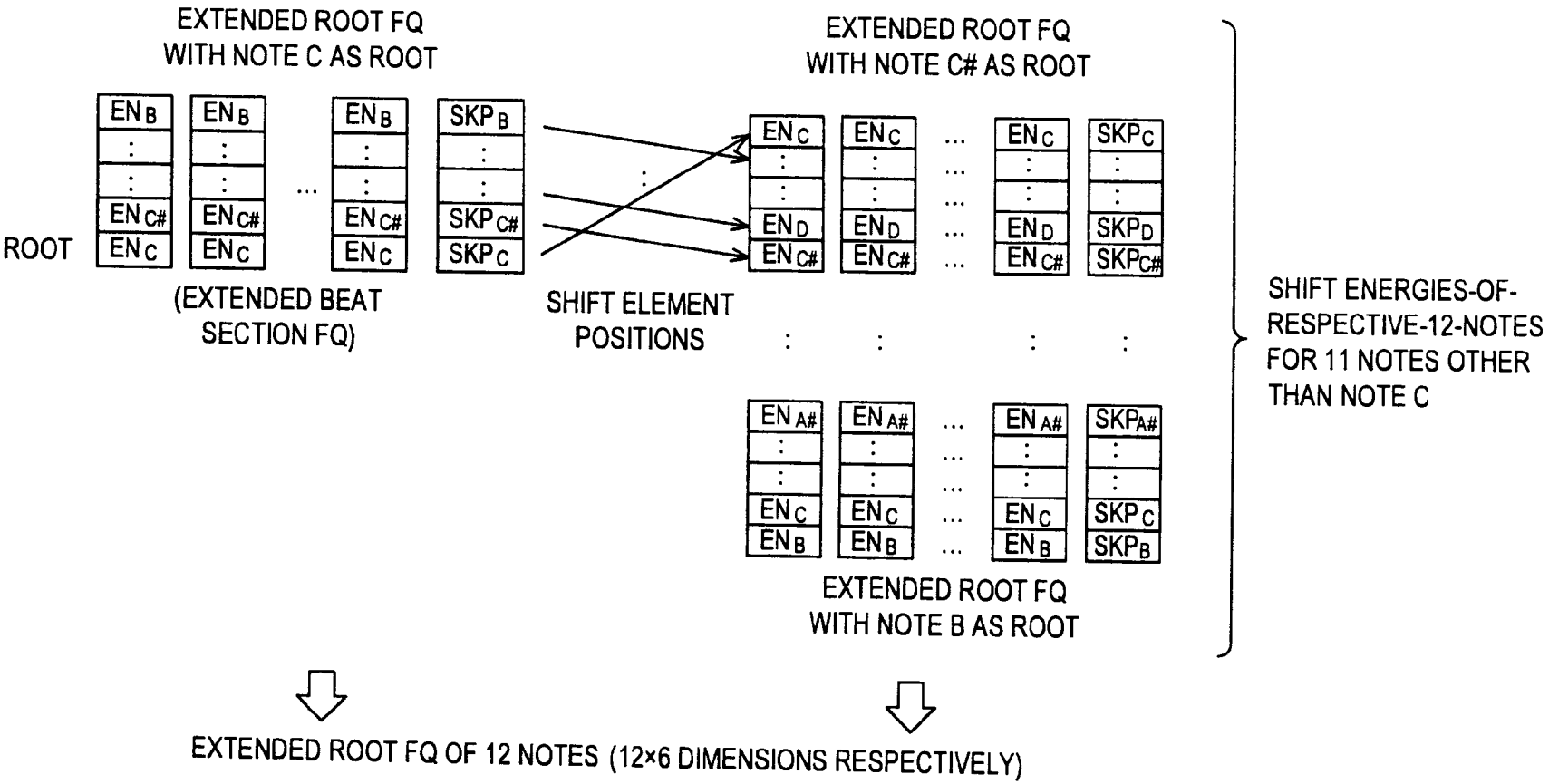
FIG. 64 is an explanatory diagram for describing an extended root feature quantity generation process.

FIG. 64 is an explanatory diagram for describing an extended root feature quantity generation process by the root feature quantity preparation unit 194.

Referring to FIG. 64, first, the root feature quantity preparation unit 194 takes the extended beat section feature quantity input from the beat section feature quantity calculation unit 192 as an extended root feature quantity with the note C as the root. Next, the root feature quantity preparation unit 194 generates 11 separate extended root feature quantities, each having any of the note C# to the note B as the root, by shifting by a specific number the element positions of the 12 notes of the extended root feature quantity having the note C as the root. Moreover, the number of shifts by which the element positions are shifted is the same as the number of shifts used for the root feature quantity generation process by the root feature quantity preparation unit 164 described using FIG. 36.

The root feature quantity preparation unit 194 performs the extended root feature quantity generation process as described for all the beat sections, and prepares extended root feature quantities to be used for the recalculation of the chord probability for each section. The extended root feature quantities generated by the root feature quantity preparation unit 194 are output to the chord probability calculation unit 196.

(2-8-3. Chord Probability Calculation Unit)

The chord probability calculation unit 196 calculates, for each beat section, a chord probability indicating the probability of each chord being played, by using the root feature quantities input from the root feature quantity preparation unit 194. As described above, "each chord" here means each of the chords distinguished by the root (C, C#, D, . . . ), the number of constituent notes (a triad, a 7th chord, a 9th chord), the tonality (major/minor), or the like, for example. An extended chord probability formula learnt in advance by a logistic regression analysis can be used for the computation of the chord probability, for example.

FIG. 65 is an explanatory diagram for describing a learning process for the extended chord probability formula used for the recalculation of the chord probability by the chord probability calculation unit 196.

Moreover, the learning of the extended chord probability formula is performed for each type of chord as in the case for the chord probability formula. That is, a learning process described below is performed for each of an extended chord probability formula for a major chord, an extended chord probability formula for a minor chord, an extended chord probability formula for a 7th chord and an extended chord probability formula for a 9th chord, for example.

First, a plurality of extended root feature quantities (for example, 12 separate 12×6-dimensional vectors described by using FIG. 64), respectively for a beat section whose correct chord is known, are provided as independent variables for the logistic regression analysis.

Furthermore, dummy data (teacher data) for predicting the generation probability by the logistic regression analysis is provided for each of the extended root feature quantities for respective beat sections. For example, when learning the extended chord probability formula for a major chord, the value of the dummy data will be a true value (1) if a known chord is a major chord, and a false value (0) for any other case. Also, when learning the extended chord probability formula for a minor chord, the value of the dummy data will be a true value (1) if a known chord is a minor chord, and a false value (0) for any other case. The same can be said for the 7th chord and the 9th chord.

By performing the logistic regression analysis for a sufficient number of the extended root feature quantities, each for a beat section, by using the independent variables and the dummy data as described above, an extended chord probability formula for recalculating each chord probability from the root feature quantity is obtained in advance.

Then, the chord probability calculation unit 196 applies the extended chord probability formula obtained in advance to the extended root feature quantity input from the extended root feature quantity preparation unit 194, and sequentially computes the chord probabilities for respective beat sections.

Figure 66:
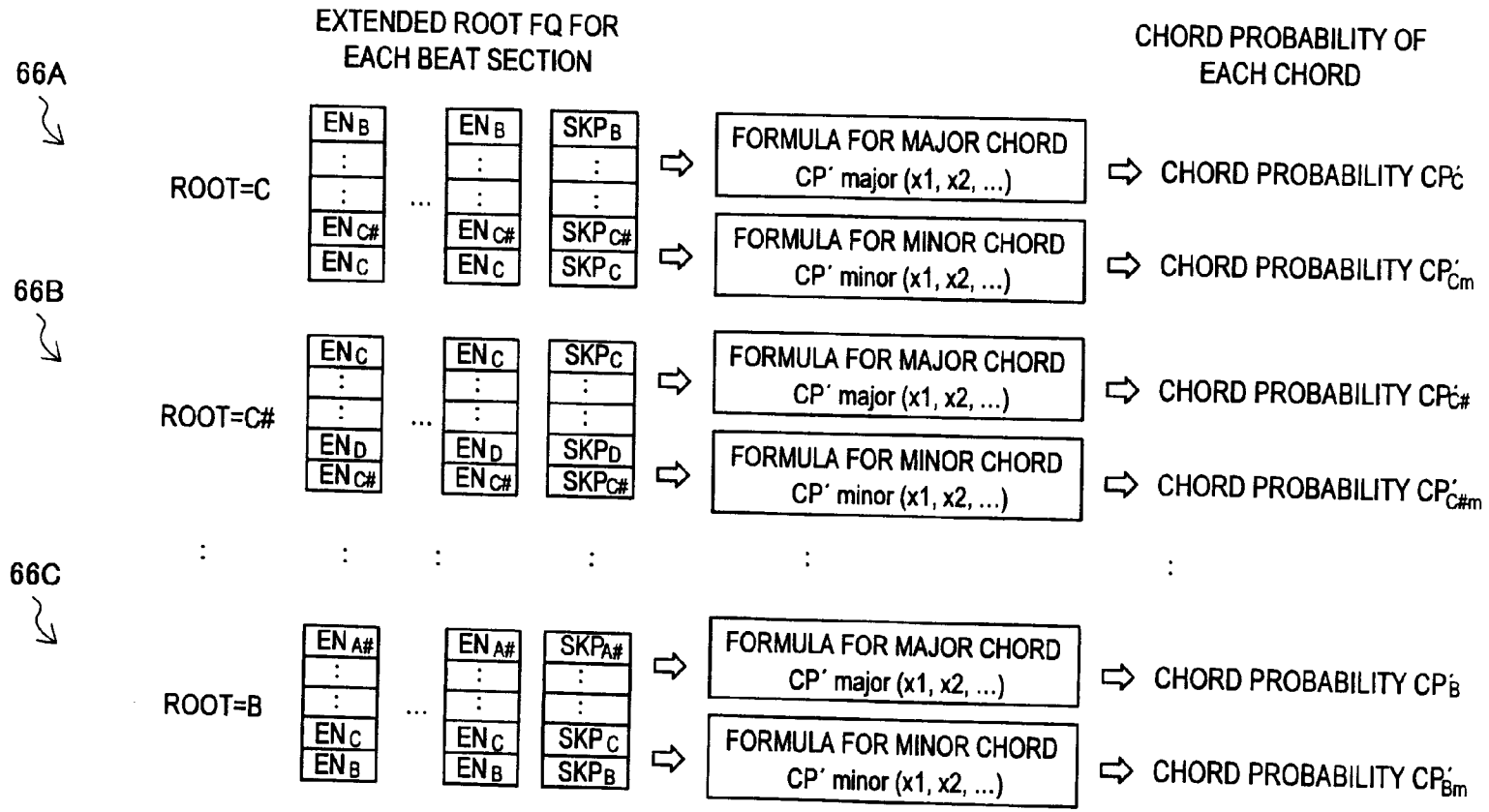
FIG. 66 is an explanatory diagram for describing a recalculation process for a chord probability.

FIG. 66 is an explanatory diagram for describing a recalculation process for the chord probability by the chord probability calculation unit 196.

Referring to FIGS. 66 (66A), an extended root feature quantity with the note C as the root, among the extended root feature quantities for each beat section, is shown. The chord probability calculation unit 196 applies the extended chord probability formula for a major chord obtained in advance by learning to the extended root feature quantity with the note C as the root, for example, and calculates a chord probability $CP'_C$ of the chord being "C" for the beat section. Furthermore, the chord probability calculation unit 196 applies the extended chord probability formula for a minor chord to the extended root feature quantity with the note C as the root, and recalculates a chord probability $CP'_{Cm}$ of the chord being "Cm" for the beat section.

In a similar manner, the chord probability calculation unit 196 applies the extended chord probability formula for a major chord and the extended chord probability formula for a minor chord to the extended root feature quantity with the note C# as the root, and recalculates a chord probability $CP'_{C\#}$ and a chord probability $CP'_{C\#m}$ (66B). The same can be said for the recalculation of a chord probability $CP'_B$, a chord probability $CP'_{Bm}$ (66C), and chord probabilities for other types of chords not shown (including 7th, 9th and the like).

The chord probability calculation unit 196 repeats the recalculation process for the chord probabilities as described above for all the focused beat sections, and outputs the recalculated chord probabilities to the chord probability correction unit 197 described next.

(2-8-4. Chord Probability Correction Unit)

The chord probability correction unit 197 corrects the chord probability recalculated by the chord probability calculation unit 196, based on the similarity probabilities between beat sections input from the structure analysis unit 150.

For example, let us assume that the chord probability for a chord X in an i-th focused beat section is $CP'_x(i)$, and the similarity probability between the i-th beat section and a j-th beat section is SP(i, j). Then, a chord probability after correction $CP''_x(0$ is given by the following equation, for example.

[Equation 6]

$$CP''_x(i) = \sum_j CP'_x(j) \cdot \left( \frac{SP(i, j)}{\sum_k SP(i, k)} \right) \tag{6}$$

That is, the chord probability after correction $CP''_x(i)$ is a value obtained by weighting and summing the chord probabilities by using normalized similarity probabilities where each of the similarity probabilities between a beat section corresponding to a focused beat and another beat section is taken as a weight. By such a correction of probability values, the chord probabilities of beat sections with similar sound contents will have closer values compared to before correction. The chord probabilities for respective beat sections corrected by the chord probability correction unit 197 are output to the chord progression determination unit 198 described next.

(2-8-5. Chord Progression Determination Unit)

The chord progression determination unit 198 determines a likely chord progression by a path search, based on the chord probabilities for respective beat positions input from the chord probability correction unit 197. The Viterbi algorithm described above can be used as the method of path search by the chord progression determination unit 198, for example.

Figure 67:
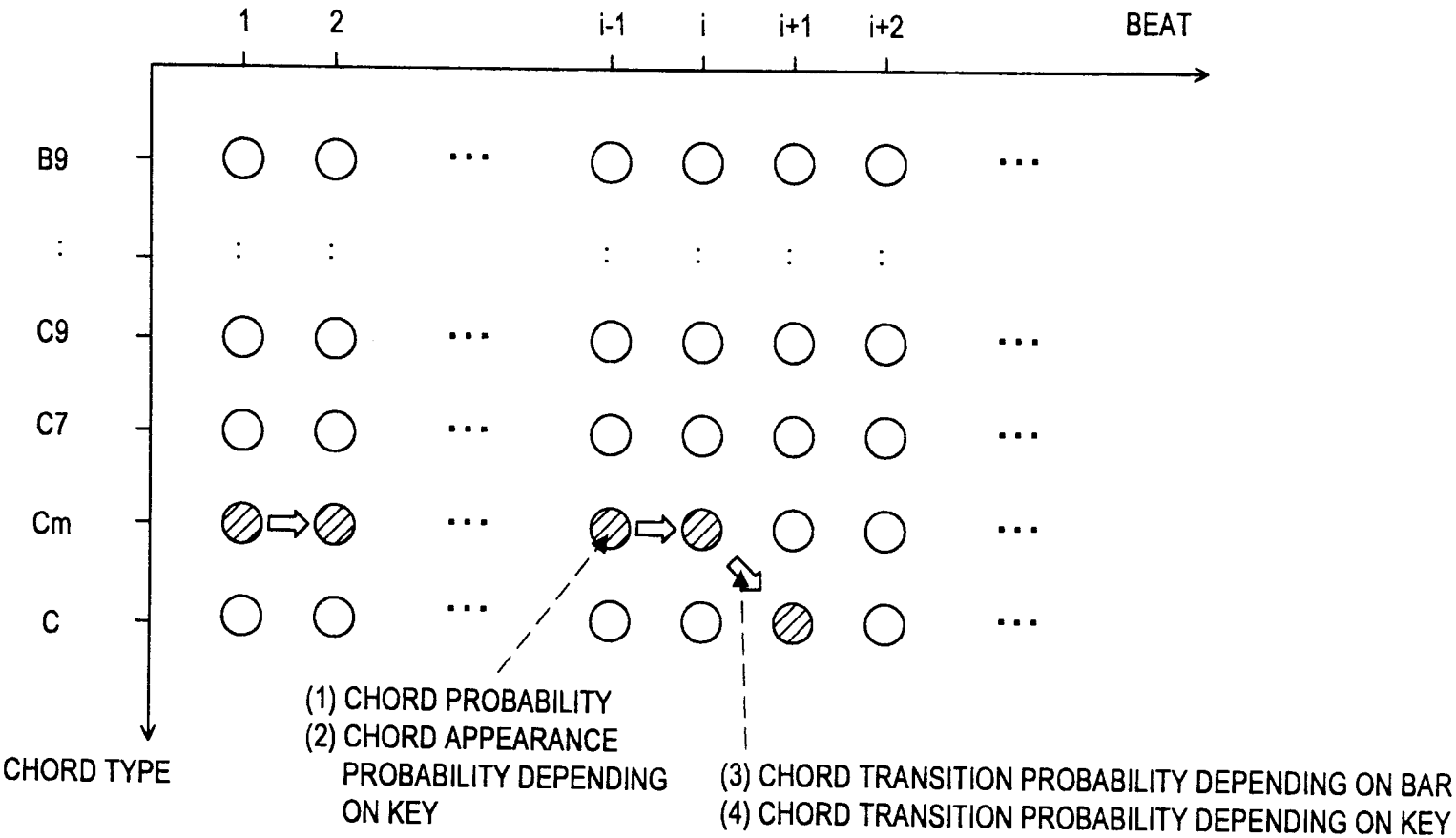
FIG. 67 is an explanatory diagram for describing a path search by a chord progression determination unit.

FIG. 67 is an explanatory diagram for describing the path search by the chord progression determination unit 198.

In case of applying the Viterbi algorithm to the path search by the chord progression determination unit 198, beats are arranged sequentially on the time axis (horizontal axis in FIG. 67). Furthermore, the types of chords for which the chord probabilities have been computed are used for the observation sequence (vertical axis in FIG. 67). That is, the chord progression determination unit 198 takes, as the subject node of the path search, each of all the pairs of a beat section input from the chord probability correction unit 197 and a type of chord.

With regard to the node as described, the chord progression determination unit 198 sequentially selects, along the time axis, any of the nodes. Then, the chord progression determination unit 198 evaluates a path formed from a series of selected nodes by using four evaluation values, (1) chord probability, (2) chord appearance probability depending on the key, (3) chord transition probability depending on the bar, and (4) chord transition probability depending on the key. Moreover, skipping of beat is not allowed at the time of selection of a node by the chord progression determination unit 198.

Among the evaluation values used for the evaluation of a path by the chord progression determination unit 198, (1) chord probability is the chord probability described above corrected by the chord probability correction unit 197. The chord probability is given to each node shown in FIG. 67.

Furthermore, (2) chord appearance probability depending on the key is an appearance probability for each chord depending on a key specified for each beat section according to the key progression input from the key detection unit 170. The chord appearance probability depending on the key is predefined by aggregating the appearance probabilities for chords for a large number of music pieces, for each type of key used in the music pieces. For example, generally, the appearance probability is high for each of chords "C," "F," and "G" in a music piece whose key is C. The chord appearance probability depending on the key is given to each node shown in FIG. 67.

Furthermore, (3) chord transition probability depending on the bar is a transition probability for a chord depending on the type of a beat specified for each beat according to the bar progression input from the bar detection unit 180. The chord transition probability depending on the bar is predefined by aggregating the chord transition probabilities for a number of music pieces, for each pair of the types of adjacent beats in the bar progression of the music pieces. For example, generally, the probability of a chord changing at the time of change of the bar (beat after the transition is the first beat) or at the time of transition from a second beat to a third beat in a quadruple meter is higher than the probability of a chord changing at the time of other transitions. The chord transition probability depending on the bar is given to the transition between nodes.

Furthermore, (4) chord transition probability depending on the key is a transition probability for a chord depending on a key specified for each beat section according to the key progression input from the key detection unit 170. The chord transition probability depending on the key is predefined by aggregating the chord transition probabilities for a large number of music pieces, for each type of key used in the music pieces. The chord transition probability depending on the key is given to the transition between nodes.

The chord progression determination unit 198 sequentially multiplies with each other the evaluation values of the above-described (1) to (4) for each node included in a path, with respect to each path representing the chord progression described by using FIG. 67. Then, the chord progression determination unit 198 determines the path whose multiplication result as the path evaluation value is the largest as the optimum path representing a likely chord progression.

Figure 68:
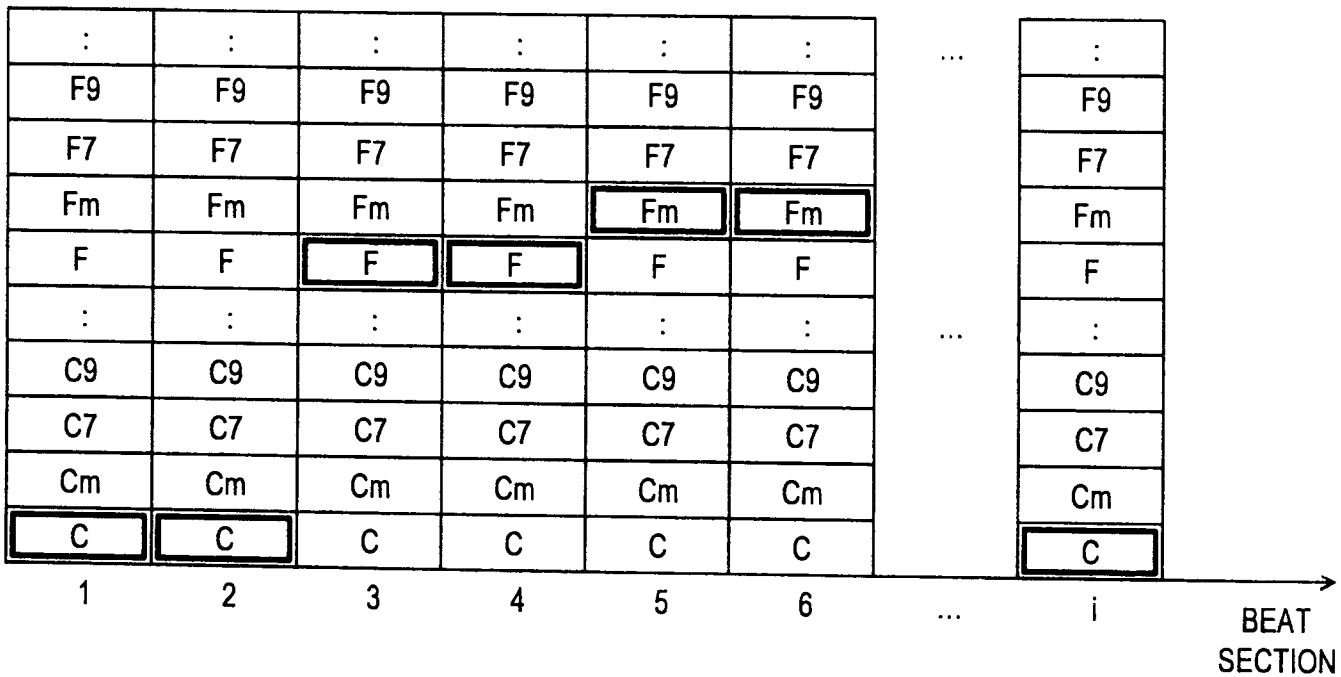
FIG. 68 is an explanatory diagram showing an example of a chord progression determined by the chord progression determination unit.

FIG. 68 is an explanatory diagram showing an example of the chord progression determined by the chord progression determination unit 198 as the optimum path.

In FIG. 68, the chord progression determined by the chord progression determination unit 198 to be the optimum path for first to sixth beat sections and an i-th beat section is shown (see thick-line box). According to this example, the chords of the beat sections are "C," "C," "F," "F," "Fm," "Fm," . . . , "C" sequentially from the first beat section.

After the processing by the beat section feature quantity calculation unit 192 through the chord progression determination unit 198 described above, the chord progression detection process by the chord progression detection unit 190 is ended.

<3. Feature of Information Processing Apparatus According to Present Embodiment>

The information processing apparatus 100 according to the present embodiment provides a highly accurate analysis result of an audio signal compared to a method of a related art owing mainly to the features described next.

Firstly, the bar detection unit 180 determines a likely bar progression of an audio signal based on corrected bar probabilities (indicating to which ordinal in which meter respective beat correspond), which are determined according to the similarity probabilities between beat sections calculated by the structure analysis unit 150. Specifically, at the time of determining the bar progression in the present embodiment, the bar probabilities can be corrected beforehand to have close values for beats in beat sections where similar sound contents are being produced. Thereby, the bar progression can be determined based on the bar probabilities more accurately reflecting the types of the original beats.

Furthermore, the bar detection unit 180 calculates a bar progression before correction by using the similarity probabilities, based on the first feature quantity varying depending on the type of chord or the type of key for each beat section and the second feature quantity varying depending on the beat probabilities. Here, the ordinal and the meter for each beat can normally be determined taking into account the change of chord or the change of key as well as the beat. Accordingly, the bar probability computed based on the first feature quantity and the second feature quantity as described are effective in determining the likely bar progression.

Secondly, the chord progression detection unit 190 determines a likely chord progression based on corrected chord probabilities determined according to the similarity probabilities between the beat sections calculated by the structure analysis unit 150. Specifically, at the time of determining the chord progression in the present embodiment, the chord probabilities can be corrected beforehand to have close values for beats in beat sections where similar sound contents are being produced. Thereby, the chord progression can be determined based on the chord probabilities more accurately reflecting the types of chords actually played.

Furthermore, the chord progression detection unit 190 recalculates the chord probability to be used for the determination of the chord progression by using, in addition to the energies-of-respective-12-notes for a beat section being focused and the beat sections around the focused beat section, the extended beat section feature quantity including the simple key probability computed by the key detection unit 170. Thereby, a more accurate chord progression is determined taking into account the feature of the key of each beat section.

Thirdly, the structure analysis unit 150 computes the above-described similarity probabilities between the beat sections based on the correlation between the feature quantities according to the average energies of respective pitches for each beat section. Here, while the average energies of respective pitches still hold the sound features such as the volume or the pitch of the played sound, they are hardly affected by the temporal fluctuation in tempo. Specifically, the similarity probabilities between the beat sections computed according to the average energies of respective pitches are not affected by the fluctuation in tempo, and are effective in accurately analyzing the beat, the chord or the key of a music piece.

Furthermore, the structure analysis unit 150 calculates the correlation between beat sections by using the feature quantities, each feature quantity being for a beat section being focused and one or more beat sections around the beat section being focused. Specifically, even if the sound feature of a beat section is similar to the sound feature of another beat section, if the sound features of a plurality of beat sections in the vicinity are different, the correlation coefficient that is calculated is not significant. Thereby, the key of a music piece, the chord, the meter or the like which rarely changes for each beat section can be analysed with high accuracy.

Fourthly, the beat search unit 136 of the beat analysis unit 130 selects an optimum path formed from the onsets showing a likely tempo fluctuation, by using the beat score indicating the degree of correspondence of the onset to a beat of a conceivable beat interval. Thereby, the beat positions appropriately reflecting the tempo of the performance can be detected with ease.

Furthermore, when the fluctuation in tempo (variance of beat intervals) for the optimum path determined by the beat search unit 136 is small, the beat re-search unit 140 for constant tempo of the beat analysis unit 130 limits the search range to around the most frequently appearing beat interval and re-searches for the optimum path. Thereby, with respect to a music piece with a constant tempo, errors relating to the beat positions which might partially occur in a result of the path search can be reduced.

Moreover, it is needless to say that other features described in this specification also contribute to the improvement in the accuracy of the analysis result of the information processing apparatus 100 according to the present embodiment.

<4. Conclusion>

Heretofore, the information processing apparatus 100 according to an embodiment of the present invention has been described by using FIGS. 1 to 68.

Moreover, the information finally output from the information processing apparatus 100 may be arbitrary information including any information such as the beat position, the similarity probability between beat sections, the key probability, the key progression, the chord probability or the chord progression described in this specification. Furthermore, it is also possible to partially carry out the operations of the information processing apparatus 100 described in this specification. For example, when it is not necessary for a user to detect the chord progression, the chord progression detection unit 190 described above can be omitted, and the information processing apparatus 100 can be configured as a beat analysis apparatus for detecting only the bar.

Furthermore, in the present embodiment, the Viterbi algorithm is used as the algorithm for the path search by the beat search unit 136, the key determination unit 178, the bar detection unit 188, the chord progression determination unit 198, and the like. However, it is not to be restricted to such an example, and any other path search algorithm may be used by each of the above-described units. Also, other statistical analysis algorithm may be used instead of the logistic regression algorithm used in the present embodiment.

Furthermore, path search by two or more processing units among the beat search unit 136, the key determination unit 178, the bar determination unit 188 and the chord progression determination unit 198 may be simultaneously executed. For example, by simultaneously executing the path search by two or more processing units, the likelihood of a path to be searched out can be comprehensively maximized. However, in this case, it should be noted that the processing cost for the path searches will increase. Furthermore, the range of search may be narrowed at the time of the path search by adding a restrictive condition not described in this specification, thereby reducing, the processing cost.

Furthermore, as described in this specification, a variety of parameters are supplied in advance for the processing according to the present embodiment. For example, the threshold value for onset detection (FIG. 7), the threshold value for constant tempo decision (FIG. 18), the threshold value for limiting the re-search range for a path in relation to a constant tempo (FIG. 19), the weights used for weighting and summing at the time of computation of the energies-of-respective-12-notes (FIG. 30), and the like are examples of such parameters. These parameters can be optimized in advance by using, for example, a local search algorithm, a genetic algorithm, or any other parameter optimization algorithm.

Furthermore, a series of processes by each unit of the information processing apparatus 100 described in this specification can be realized as hardware or software. In case of executing a series of processes or a part of the series of processes by software, a program configuring the software is executed by using a computer built in dedicated hardware or a general-purpose computer shown in FIG. 69, for example.

Figure 69:
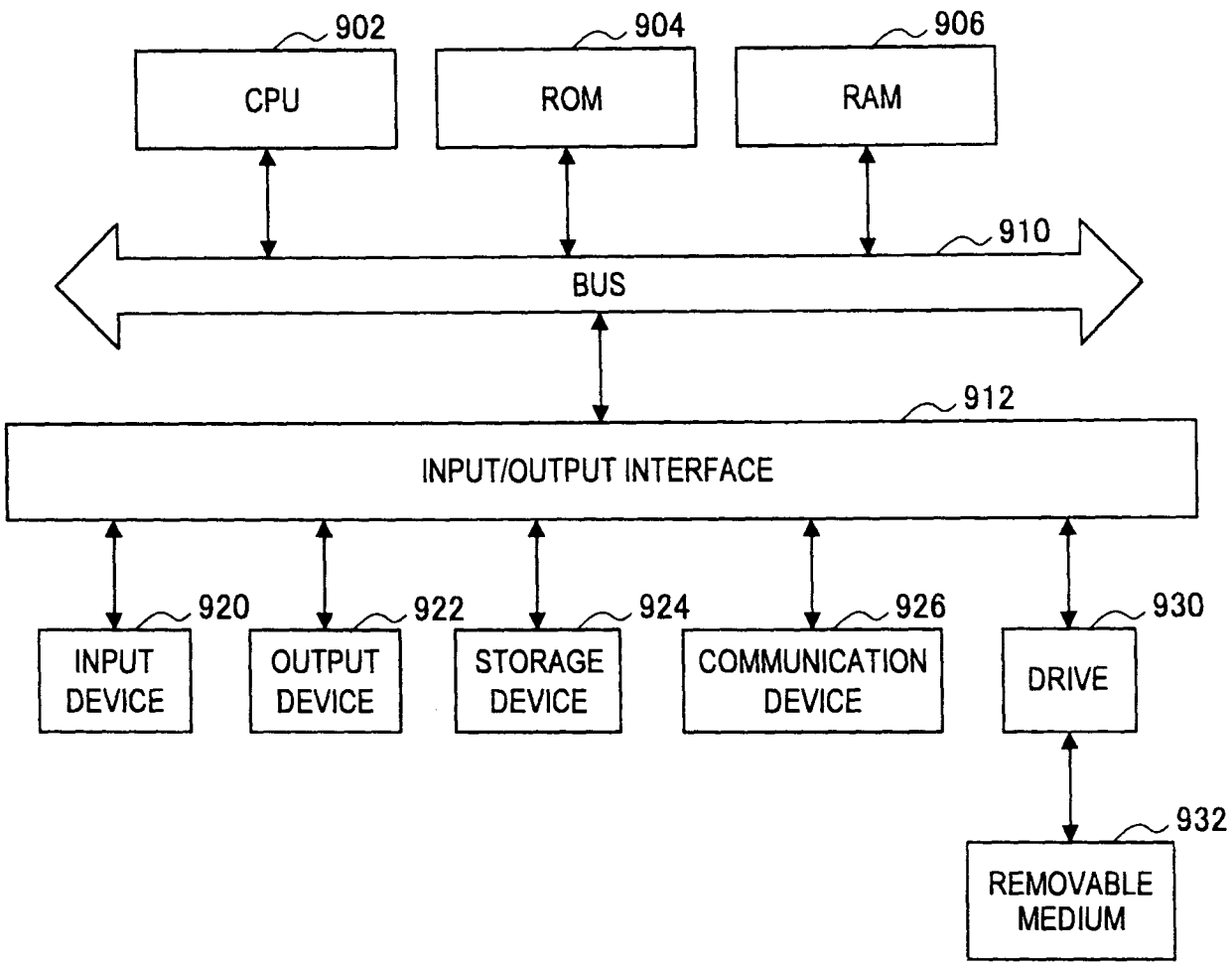
FIG. 69 is a block diagram showing a configuration example of a general-purpose computer.

In FIG. 69, a central processing unit (CPU) 902 controls the overall operation of the general-purpose computer. A read only memory (ROM) 904 stores data or program describing a part or all of the series of processes. A random access memory (RAM) 906 temporarily stores the program or data used by the CPU 902 at the time of execution of the processes.

The CPU 902, the ROM 904, and the RAM 906 are interconnected by a bus 910. The bus 910 is connected to an input/output interface 912.

The input/output interface 912 is an interface for connecting the CPU 902, the ROM 904 and the RAM 906 with an input device 920, an output device 922, a storage device 924, a communication device 926 and a drive 930.

The input device 920 receives instructions or information input from a user via an input device such as a button, a mouse or a keyboard. The output device 922 outputs information to a user via a display device such as a cathode ray tube (CRT), a liquid crystal display, an organic light emitting diode (OLED) or the like, or an audio output device such as a speaker, for example.

The storage device 924 is configured from a hard disk drive or a flash memory, for example, and stores program, program data, input/output data or the like. The communication device 926 performs communication process via a network such as a LAN or the Internet. The drive 930 is provided to the general-purpose computer as appropriate, and a removable medium 932 is attached to the drive 930, for example.

Information output by the information processing apparatus 100 can be used for various applications relating to music. For example, an application can be realized for making a character move in sync with music in a virtual space by using the bar progression detected by the bar detection unit 180 and the chord progression detected by the chord progression detection unit 190. Also, an application can be realized for automatically writing chords on a music sheet by using the chord progression detected by the chord progression detection unit 190, for example.

It should be understood by those skilled in the art that various modifications, combinations, sub-combinations and alterations may occur depending on design requirements and other factors insofar as they are within the scope of the appended claims or the equivalents thereof.

For example, the processes described in flow charts do not have to be executed in the order shown in the flow charts. Each processing step may include processes that are executed in parallel or independently.

The present application contains subject matter related to that disclosed in Japanese Priority Patent Application JP 2008-298567 filed in the Japan Patent Office on 21 Nov. 2008, the entire content of which is hereby incorporated by reference.

What is claimed is:

1. An information processing apparatus comprising:

a beat analysis unit for detecting positions of beats included in an audio signal;

a structure analysis unit for calculating similarity probabilities, each being a probability of similarity between contents of sound of beat sections divided by each beat position detected by the beat analysis unit; and a bar detection unit for determining a likely bar progression of the audio signal based on bar probabilities determined according to the similarity probabilities calculated by the structure analysis unit, the bar probabilities indicating to which ordinal in which meter respective beats correspond.

2. The information processing apparatus according to claim 1, wherein the structure analysis unit includes:

a feature quantity calculation unit for calculating a specific feature quantity by using average energies of respective pitches of each beat section;

a correlation calculation unit for calculating, for the beat sections, correlations between the feature quantities calculated by the feature quantity calculation unit; and a similarity probability generation unit for generating the similarity probabilities according to the correlations calculated by the correlation calculation unit.

3. The information processing apparatus according claim 2, wherein the bar detection unit includes:

a bar probability calculation unit for calculating the bar probabilities based on specific feature quantities extracted from the audio signal;

a bar probability correction unit for correcting, according to the similarity probabilities, the bar probabilities calculated by the bar probability calculation unit; and a bar determination unit for determining the likely bar progression of the audio signal based on the bar probabilities corrected by the bar probability correction unit.

4. The information processing apparatus according to claim 2, wherein the feature quantity calculation unit computes the feature quantity by weighting and summing over a plurality of octaves values of notes bearing same name, the values being included in the average energies of respective pitches.

5. The information processing apparatus according to claim 2, wherein the correlation calculation unit calculates the correlation between the beat sections by using the feature quantities, each feature quantity being for a beat section being focused and one or more beat sections around the beat section being focused.

6. The information processing apparatus according to claim 3, wherein the bar probability calculation unit calculates the bar probability based on a first feature quantity varying depending on a type of chord or a type of key for each beat section and a second feature quantity varying depending on a beat probability indicating a probability of a beat being included in each specific time unit of the audio signal.

7. The information processing apparatus according to claim 3, wherein the bar determination unit determines the likely bar progression by searching for a path according to which an evaluation value varying depending on the bar probability becomes optimum, from among paths formed by sequentially selecting nodes among nodes specified with beats arranged in time series and meters and ordinals of each beat.

8. The information processing apparatus according to claim 3, wherein the bar detection unit further includes:

a bar redetermination unit for re-executing, in a case where both a first meter and a second meter are included in the bar progression determined by the bar determination unit, a path search with a less frequently appearing meter among the first meter and the second meter excluded from a subject of a search.

9. The information processing apparatus according to claim 1, wherein the beat analysis unit includes:

an onset detection unit for detecting onsets included in the audio signal, each onset being a time point a sound is produced, based on beat probabilities, each indicating a probability of a beat being included in each specific time unit of the audio signal;

a beat score calculation unit for calculating, for each onset detected by the onset detection unit, a beat score indicating a degree of correspondence of the onset to a beat with a conceivable beat interval;

a beat search unit for searching for an optimum path formed from the onsets showing a likely tempo fluctuation, based on the beat score calculated by the beat score calculation unit; and a beat determination unit for determining, as beat positions, positions of the onsets on the optimum path and positions supplemented according to the beat interval.

10. The information processing apparatus according to claim 9, wherein the beat analysis unit further includes:

a beat re-search unit for limiting a search range and re-executing a search for the optimum path, in a case a fluctuation in tempo of the optimum path determined by the beat search unit is small.

11. The information processing apparatus according to claim 9, wherein the beat search unit determines the optimum path by using an evaluation value varying depending on the beat score, from among paths formed by sequentially selecting along a time axis nodes specified with the onsets and the beat intervals.

12. The information processing apparatus according to claim 11, wherein the beat search unit determines the optimum path by further using an evaluation value varying depending on an amount of change in tempo between nodes before and after a transition.

13. The information processing apparatus according to claim 11, wherein the beat search unit determines the optimum path by further using an evaluation value varying depending on a degree of matching between an interval between onsets before and after a transition and a beat interval at a node before or after the transition.

14. The information processing apparatus according to claim 11, wherein the beat search unit determines the optimum path by further using an evaluation value varying depending on number of onsets skipped in a transition between nodes.

15. The information processing apparatus according to claim 9, wherein the beat analysis unit further includes:

a tempo revision unit for revising the beat positions determined by the beat determination unit, according to an estimated tempo estimated from a waveform of the audio signal by using an estimated tempo discrimination formula obtained in advance by learning.

16. The information processing apparatus according to claim 15, wherein the tempo revision unit determines a multiplier for revision to be used for revising the beat positions, by evaluating, for each of a plurality of multipliers, a likelihood of a revised tempo by using an average beat probability for revised beat positions and the estimated tempo.

17. A sound analysis method comprising the steps of:

detecting positions of beats included in an audio signal;

calculating similarity probabilities, each being a probability of similarity between contents of sound of beat sections divided by each detected beat position; and determining a likely bar progression of the audio signal based on bar probabilities determined according to the calculated similarity probabilities and indicating to which ordinal in which meter respective beats correspond.

18. A program for causing a computer controlling an information processing apparatus to function as:

a beat analysis unit for detecting positions of beats included in an audio signal;

a structure analysis unit for calculating similarity probabilities, each being a probability of similarity between contents of sound of beat sections divided by each beat position detected by the beat analysis unit; and a bar detection unit for determining a likely bar progression of the audio signal based on bar probabilities determined according to the similarity probabilities calculated by the structure analysis unit, the bar probabilities indicating to which ordinal in which meter respective beats correspond.

* * * * *